US007399563B2

(12) United States Patent
Suzuki et al.

(10) Patent No.: US 7,399,563 B2
(45) Date of Patent: Jul. 15, 2008

(54) ELECTROPHOTOGRAPHIC PHOTOCONDUCTOR, AND IMAGE FORMING PROCESS, IMAGE FORMING APPARATUS AND PROCESS CARTRIDGE FOR AN IMAGE FORMING APPARATUS USING THE SAME

(75) Inventors: Tetsuro Suzuki, Shizuoka (JP); Hiroshi Tamura, Shizuoka (JP); Hiroshi Ikuno, Kanagawa (JP); Kazukiyo Nagai, Shizuoka (JP); Hongguo Ll, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 4 days.

(21) Appl. No.: 11/621,257

(22) Filed: Jan. 9, 2007

(65) Prior Publication Data

US 2008/0020305 A1 Jan. 24, 2008

Related U.S. Application Data

(62) Division of application No. 10/804,030, filed on Mar. 19, 2004, now Pat. No. 7,179,573.

(30) Foreign Application Priority Data

Mar. 20, 2003 (JP) ..... 2003-077303
Mar. 20, 2003 (JP) ..... 2003-077333

(51) Int. Cl.
*G03G 15/00* (2006.01)
*G03G 15/24* (2006.01)

(52) U.S. Cl. ..... 430/56; 430/125.3; 399/153

(58) Field of Classification Search ..... 430/55, 430/56, 125.3; 399/153, 159
See application file for complete search history.

(56) References Cited

U.S. PATENT DOCUMENTS

| | | | |
|---|---|---|---|
| 5,374,494 | A | 12/1994 | Kashimura et al. |
| 6,180,303 | B1 | 1/2001 | Uematsu et al. |
| 6,238,832 | B1 | 5/2001 | Hashizume et al. |
| 6,326,112 | B1 | 12/2001 | Tamura et al. |
| 6,372,397 | B1 | 4/2002 | Maruyama et al. |
| 6,416,915 | B1 | 7/2002 | Kikuchi et al. |
| 6,432,596 | B2 | 8/2002 | Ikuno et al. |
| 6,444,387 | B2 | 9/2002 | Ri et al. |
| 6,489,073 | B2 | 12/2002 | Kotsugai et al. |
| 6,492,079 | B2 | 12/2002 | Shimada et al. |
| 6,548,216 | B2 | 4/2003 | Kawamura et al. |
| 6,576,386 | B1 | 6/2003 | Ri et al. |
| 6,596,449 | B2 | 7/2003 | Shimada et al. |
| 6,625,409 | B2 | 9/2003 | Shakuto et al. |
| 6,641,964 | B2 | 11/2003 | Ikuno et al. |
| 6,654,579 | B2 | 11/2003 | Shakuto et al. |
| 6,664,361 | B2 | 12/2003 | Sasaki et al. |
| 6,686,114 | B2 | 2/2004 | Sakon et al. |
| 7,175,957 | B2 | 2/2007 | Suzuki et al. |
| 2005/0175911 | A1 | 8/2005 | Tamoto et al. |
| 2005/0221210 | A1 | 10/2005 | Suzuki et al. |

OTHER PUBLICATIONS

U.S. Appl. No. 11/616,180, filed Dec. 26, 2006, Suzuki et al.
U.S. Appl. No. 10/543,927, filed Jun. 2, 2006, Tamoto et al.

*Primary Examiner*—John L Goodrow
(74) *Attorney, Agent, or Firm*—Oblon, Spivak, McClelland, Maier & Neustadt, P.C.

(57) ABSTRACT

Disclosed is an electrophotographic photoconductor including at least a photoconductive layer on an electroconductive substrate, which comprises at least a cross-linked surface layer formed by curing a tri- or more-functional radical polymerizable monomer without having a charge transporting structure and a mono-functional radical polymerizable compound having a charge transporting structure wherein the cross-linked surface layer has a surface roughness Rz of 1.3 μm or less.

19 Claims, 4 Drawing Sheets

ELECTROPHOTOGRAPHIC PHOTOCONDUCTOR, AND IMAGE FORMING PROCESS, IMAGE FORMING APPARATUS AND PROCESS CARTRIDGE FOR AN IMAGE FORMING APPARATUS USING THE SAME

BACKGROUND OF THE INVENTION

1. Field of the Invention

The present invention relates to an electrophotographic photoconductor with high durability capable of realizing a high quality image for a long period of time by using a photoconductive layer having high abrasion resistance, smooth surface and excellent electrical properties. Also, it relates to an image forming process, an image forming apparatus and a process cartridge for an image forming apparatus using the long life and high performance photoconductor.

2. Description of the Related Art

Recently, the organic photoconductor (OPC) is widely used in a copying machine, facsimile, laser printer and a composite thereof owing to excellent performance and various advantages, instead of the inorganic photoconductor. The reason includes, for example, (1) optical properties such as range of light absorbing wave length and absorption amount, (2) electrical properties such as high sensitivity, stable charging properties, (3) width of selection range of materials, (4) easiness of preparation, (5) low cost, (6) non-toxicity and the like.

Meanwhile, as the image forming apparatus gets smaller, a photoconductor with smaller diameter has been also sought. Further, tendency of high speed and maintenance free is added and thus there is great demand for high durability of the photoconductor. In this point of view, the organic photoconductor has a defect in that when it is repeatedly used in the electrophotographic process, it is susceptible to abrasion by mechanical load of a developing system or a cleaning system since the surface layer comprises mainly a low molecular charge transport material and an inactive high molecule, which are generally soft. Also, due to the demand for high image quality along with small diameter of toner particles, increase in rubber hardness and increase in contact pressure of a cleaning blade to enhance cleaning property are forcedly required, which is another factor to promote the abrasion of the photoconductor. Such abrasion of the photoconductor leads to deterioration of electrical properties such as sensitivity and chargeability and thereby, deteriorated image with reduction of image density and contamination of the ground surface. Also, a damaged part with local abrasion produces a contaminated image with a striped pattern by cleaning failure. At this moment, the life span of the photoconductor is determined by the abrasion and damage.

Therefore, it is necessary to reduce the above-described abrasion in order to increase durability of the organic photoconductor and this is the most urged matter to be solved in the art.

The techniques to improve abrasion resistance of the photoconductive layer include (1) using a curable binder in the surface layer (for example, Japanese Patent Application Laid-Open (JP-A) No. 56-48637), (2) using a high molecular charge transport material (for example, JP-A No. 64-1728), (3) dispersion an inorganic filler in the surface layer (for example, JP-A No. 4-281461) and the like. Among these techniques, the use of a curable binder in (1) tends to cause reduction in image density since the curable binder has poor compatibility with the charge transporting material and impurities such as a polymerization initiator and unreacted leaving group increases residual potential. Also, the use of a high molecular charge transport material in (2) may somewhat improve the abrasion resistance. However, it is not sufficient for satisfy the durability required in the organic photoconductor. Further, in the case of the high molecular charge transporting material, polymerization and purification is difficult. Thus, it is impossible to obtain it at a high purity and to attain stable electrical properties between materials upon using it. In addition, it may cause problems such as high viscosity of the coating solution in terms of the preparation. The dispersion of the inorganic filler in (3) shows high abrasion resistance, as compared to the conventional photoconductor comprising a low molecular charge transporting material dispersed in an inactive high molecule. However, traps present on the surface of the inorganic filler tends to increase the residual potential, thereby causing reduction in the image density. Also, when unevenness of the inorganic filler and the binder resin on the surface of the photoconductor is severe, cleaning failure may occur, resulting in toner peeling and image deletion. By these (1), (2) and (3) techniques, it is impossible to satisfy the durability required for the organic photoconductor, including electrical durability and mechanical durability.

Furthermore, a photoconductor containing a cured body of a multi-functional acrylate monomer, in order to improve the abrasion resistance and scratch resistance of (1), is disclosed (Japanese Patent No. 3262488). In this patent, the purpose of inclusion of a cured body of this multi-functional acrylate monomer in a protective layer on the photoconductive layer is described. However, whether a charge transporting material may be contained in the protective layer is only described without concrete description. Further, when a low molecular charge transport material is simply added to the surface layer, it may cause problems related with the compatibility to the cured body, whereby crystallization of the low molecular charge transporting material and clouding may occur, resulting in reduction in mechanical properties.

In addition, according to this photoconductor, since the monomer is reacted while it contains a high molecular binder, the curing cannot be sufficiently progressed. Also, the cured body is poorly compatible with the binder resin and surface unevenness by phase separation upon curing may occur, causing cleaning failure.

As technique for inhibiting abrasion of the photoconductive layer to substitute the above techniques, a process for forming a charge transporting layer using a coating solution comprising a monomer having carbon-carbon double bond, a charge transport material having a carbon-carbon double bond and a binder resin (for example, Japanese Patent No. 3194392). The binder resin includes a binder reactive with the charge transport material having a carbon-carbon double bond and a binder non-reactive with the charge transport material without having the double bond. This photoconductor has attracted public attention since it shows abrasion resistance along with excellent electrical properties. However, when a non-reactive resin is used as the binder resin, the binder resin is poorly compatible with the cured body produced by the reaction of the monomer and the charge transport material, whereby surface unevenness during cross-linking forms from the phase separation, resulting in cleaning failure. Also, as described above, in addition to the interference of the binder resin with the curing of the monomer, a bi-functional monomer which can be used in the photoconductor has few functional groups and therefore fails to provide a sufficient cross-linkage density, and accordingly it is not possible to obtain a sufficient abrasion resistance. Also, when a reactive binder is used, since the number of functional groups contained in the monomer and the binder resin is small, the bonding of the charge transporting material and the cross-linkage density cannot be satisfied at the same time and the electrical properties and abrasion resistance are not sufficient.

Also, a photoconductive layer containing a compound formed by curing a hole transporting compound having two or more chain polymerizable functional group in a molecule (for example, JP-A No. 2000-66425).

However, since this photoconductive layer contains the bulky hole transporting compound which has two or more chain polymerizable functional group, distortion may occur in a cured body, causing increase in internal stress, roughness of the surface layer and formation of crack over the time.

Even in a photoconductor having a cross-linked photoconductive layer with a charge transporting structure chemically bonded, it cannot be said that general properties are sufficiently attained.

OBJECTS AND ADVANTAGES

It is an object of the present invention to provide a electrophotographic photoconductor having excellent cleaning property and high durability being capable of realizing high quality image for a long period of time by forming a photoconductive layer with high abrasion resistance and excellent properties, particularly surface smoothness, and an image forming process, image forming apparatus and process cartridge for an image forming apparatus using the long-life high performance photoconductor.

SUMMARY OF THE INVENTION

The present inventors have conducted much research and as a result, discovered that the above object can be accomplished by a photoconductive layer having a surface layer comprising a cross-linked surface layer formed by curing at least a tri- or more-functional radical polymerizable monomer without having a charge transporting structure and a mono-functional radical polymerizable compound having a charge transporting structure, wherein the cross-linked surface layer has a surface roughness Rz or 1.3 μm or less.

Specifically, the present invention provides, in a first aspect, an electrophotographic photoconductor containing at least a photoconductive layer on a conductive substrate, wherein a surface layer of the photoconductive layer contains a cross-linked surface layer formed by curing at least a tri- or more-functional radical polymerizable monomer without having a charge transporting structure and a mono-functional radical polymerizable compound having a charge transporting structure and the cross-linked surface layer has a surface roughness Rz of 1.3 μm or less.

The present invention further provides, in a second aspect, a process forming an image containing at least: a charging step to charge an electrophotographic photoconductor; a light exposure step to exposing the electrophotographic photoconductor charged in the charging step to a recording light to form an electrostatic latent image; a development step to supply a developing agent to the electrostatic latent image to visualize the electrostatic image and form a toner image; and a transferring step to transfer the toner image formed by the development step on a transfer material, wherein the electrophotographic photoconductor contains at least a photoconductive layer on a conductive substrate, a surface layer of the photoconductive layer contains at least a cross-linked surface layer formed by curing a tri- or more-functional radical polymerizable monomer without having a charge transporting structure and a mono-functional radical polymerizable compound having a charge transporting structure, and the cross-linked surface layer has a surface roughness Rz of 1.3 μm or less.

The present invention further provides, in a third aspect, an apparatus for forming an image containing: an electrophotographic photoconductor; a charging means to charge the electrophotographic photoconductor; a light exposing means to expose the electrophotographic photoconductor charged by the charging means to a recording light to form an electrostatic latent image; a development means to supply a developing agent to the electrostatic latent image to visualize the electrostatic image and form a toner image; and a transferring means to transfer the toner image formed by the development means on a transfer material, wherein the electrophotographic photoconductor contains at least a photoconductive layer on a conductive substrate, a surface layer of the photoconductive layer contains at least a cross-linked surface layer formed by curing a tri- or more-functional radical polymerizable monomer without having a charge transporting structure and a mono-functional radical polymerizable compound having a charge transporting structure, and the cross-linked surface layer has a surface roughness Rz of 1.3 μm or less.

The present invention further provides, in a fourth aspect, a process cartridge for an image forming apparatus containing an electrophotographic photoconductor and at least one selected from the group consisting of a charging means to charge the electrophotographic photoconductor; a development means to supply a developing agent to the electrostatic latent image formed by exposure on the electrophotographic photoconductor to visualize the electrostatic image and form a toner image; a transferring means to transfer the toner image formed by the development means on a transfer material; a cleaning means to remove toner remaining on the electrophotographic photoconductor after the transferring; and a discharging means to remove the latent image on the photoconductor after the transferring, forming a monolithic structure, which cartridge is adapted to be attached to and detached from a main body of the image forming apparatus, wherein the electrophotographic photoconductor contains at least a photoconductive layer on a conductive substrate, a surface layer of the photoconductive layer contains at least a cross-linked surface layer formed by curing a tri- or more-functional radical polymerizable monomer without having a charge transporting structure and a mono-functional radical polymerizable compound having a charge transporting structure, and the cross-linked surface layer has a surface roughness Rz of 1.3 μm or less.

DESCRIPTION OF THE PREFERRED EMBODIMENTS

Figure 1A:
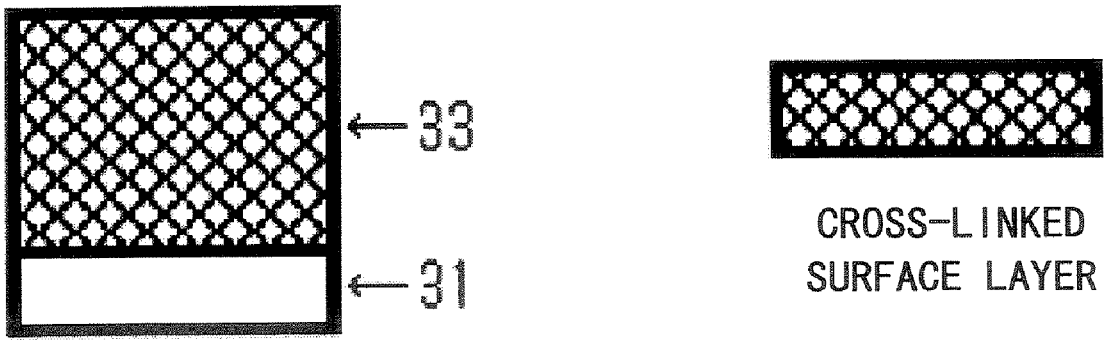
FIGS. 1A and 1B are each a cross-section of an example of the electrophotographic photoconductor according to the present invention.

Now, the present invention will be explained in detail.

According to the present invention, there is provided an electrophotographic photoconductor comprising at least a photoconductive layer on a conductive substrate, wherein the photoconductive layer comprises a cross-linked layer formed by curing at least a tri- or more-functional radical polymerizable monomer without having a charge transporting structure and a mono-functional radical polymerizable compound having a charge transporting structure, and the cross-linked surface layer has a surface roughness Rz of 1.3 μm or less.

The features of the present invention are explained in detail below.

According to the present invention tri- or more-functional radical polymerizable monomer in the formation of the outermost surface layer of the photoconductor according to the present invention, by which a 3-dimensional mesh structure is developed and a surface with high cross-linkage, high hardness and high abrasion resistance are made. When a mono-function or bi-functional radical polymerizable monomer is used instead, the cross-linkage in the cross-linked surface layer is reduced and it is impossible to accomplish a greatly improved abrasion resistance. When a high molecular (polymer) material is contained in the cross-linked surface layer before cross-linking, the development of the 3-dimensional mesh structure is impeded and the cross-linkage is reduced. As a result, it is impossible to obtain sufficient abrasion resistance. Further, since such high molecular material is poorly compatible with the cured body formed by the reaction of the radical polymerizable composition (a radical polymerizable monomer and a radical polymerizable compound having a charge transporting structure), local abrasion may occur from the phase separation, leading scratch on the surface. Also, in the formation of the outermost surface layer according to the present invention, a mono-functional radical polymerizable compound having a charge transporting structure is added in addition to the tri-functional radical polymerizable monomer, which is inserted in the cross-linkage upon curing of the tri- or more functional radical polymerizable monomer. On the other hand, when a low molecular charge transporting material without functional group is contained in the cross-linked surface layer, due to its low compatibility, crystallization of the low molecular charge transporting material itself or clouding occurs and mechanical properties of the cross-linked surface layer are reduced. When a bi or more-functional charge transport compound is used as a main component, it may be fixed in the cross-linked structure by a plurality of bondings. However, the charge transporting structure has a big size, which causes distortion in the cured resin and increases internal stress in the cross-linked surface layer. As a result, crack or scratch often forms upon attachment of a carrier.

Further, the photoconductor according to the present invention has excellent electrical properties, whereby it is possible to produce a high quality image for a long period of time. This is because the mono-functional radical polymerizable compound having a charge transporting structure is fixed like a pendant during cross-linking reaction. As described above, the charge transporting material without a functional group causes deterioration in repeated uses such as crystallization and clouding, reduction of sensitivity and increase of residual potential. When a bi or more-functional charge transport compound is used as a main component, it is fixed in the structure by a plurality of bondings. As a result, it is impossible for an intermediate structure (cationic radical) to maintain a stable state during charge transport, which causes reduction in sensitivity and increase of residual potential by charge trapping. The above-described deterioration of electrical properties results in reduction in image density, character thinning and the like.

Further, by the composition for forming the photoconductor according to the present invention, it is possible to obtain a photoconductor with excellent surface smoothness. Particularly, when the cross-linked surface layer has a surface roughness Rz of 1.3 μm or less, the above-described effects can be sufficiently accomplished. When the surface roughness Rz exceeds 1.3 μm, minute leakage of toner may occur in a cleaning blade, resulting in contamination of a base surface and a striped image. Also, since the strength of the membrane is high, abrasion seldom occurs and it is impossible to sufficiently perform removal of paper fragments attached in a depressed part, oxidizing gas generated from the charger and contaminants on the surface of the photoconductor. As a result, image deletion, character thickening may occur in a high humidity circumstance.

Next, the component materials of the coating solution of the outermost surface layer according to the present invention are described.

The tri- or more-functional radical polymerizable monomer without having charge transporting ability structure which is used in the present invention refers to a monomer which does not contain a hole transporting structure, such as, for example, triarylamine, hydrazone, pyrazoline, carbazole and the like, and an electron transporting structure such as for example fused polycyclic quinone, diphenoquinone and an electron pulling aromatic ring having cyano group or nitro group, but has a three or more of radical polymerizable functional groups. The radical polymerizable functional group may be any one which has a carbon-carbon double bonds and is a radical polymerizable group.

Examples of the radical polymerizable functional group include a 1-substituted ethylene functional group and a 1,1-substituted ethylene functional groups.

(1) Examples of the 1-substituted ethylene functional group include a functional group represented by the following formula:

$$CH_2{=}CH{-}X_1{-} \qquad \text{equation 10}$$

wherein, $X_1$ represents arylene group such as phenylene group, naphthylene group and the like, which may be substituted, alkynylene group which may be substituted, —CO— group, —COO— group, —CON($R_{10}$)— group ($R_{10}$ represents an alkyl group such as hydrogen, methyl group and ethyl group, aralkyl group such as benzyl group, naphthylmethyl group and phenethyl group, aryl group such as phenyl group and naphthyl group), or —S— group.

Concrete examples of these substituents include vinyl group, styryl group, 2-methyl-1,3-butadienyl group, vinylcarbonyl group, acryloyloxy group, acryloylamino group, vinylthioether group and the like.

(2) Examples of the 1,1-substituted ethylene functional group include a functional group represented by the following formula:

$$CH_2{=}C(Y){-}X_2{-} \qquad \text{equation 11}$$

wherein, Y represents an alkyl group which may be substituted, an aralkyl group which may be substituted, an aryl group such as phenyl group, naphthyl group which may be substituted, a halogen atom, a cyano group, a nitro group, an alkoxy group such as methoxy group or ethoxy group, —$COOR_{11}$ group ($R_{11}$ represents a hydrogen atom, an alkyl group such as methyl group, ethyl group and the like which may be substituted, an aralkyl group such as benzyl and phenethyl group which may be substituted, an aryl group such as phenyl group and naphthyl group which may be substituted), or —$CONR_{12}R_{13}$ ($R_{12}$ and $R_{13}$ represent a hydrogen atom, an alkyl group such as methyl group, ethyl group and the like which may be substituted, an aralkyl group such as benzyl group, naphthylmethyl group or phenethyl group which may be substituted, or an aryl group such as phenyl group and naphthyl group which may be substituted and may be identical or different), $X_2$ represents a substituent as defined for $X_1$ of the formula 10 and a single bond, an alkylene group, provided that at least any one of Y and $X_2$ is an oxycarbonyl group, a cyano group, alkenylene group, and an aromatic ring).

Concrete examples of these substituents include α-chloro acryloyloxy group, methacryloyloxy group, α-cyanoethylene group, α-cyanoacryloyloxy group, α-cyanophenylene group, methacryloylamino group and the like.

Examples of the substituent which is additionally substituted to the subsituents of $X_1$, $X_2$ and Y include a halogen atom, a nitro group, a cyano group, an alkyl group such as methyl group, ethyl group and the like, an alkoxy group such as methoxy group, ethoxy group and the like, an aryloxy group such as phenoxy group and the like, an aryl group such as phenyl group, naphthyl group and the like, and an aralkyl group such as benzyl group, phenethyl group and the like.

Among these radical polymerizable functional groups, acryloyloxy group and methacryloyloxy group are particularly useful and compounds having 3 or more of acryloyloxy groups may be prepared, for example, by esterification or transesterification of a compound having 3 or more hydroxy groups in the molecule with acrylic acid (salt), acrylic acid halide, acrylic acid ester. Also, a compound having 3 or more methacryloyloxy groups may be similarly prepared. The radical polymerizable functional groups in a monomer having 3 or more radical polymerizable functional groups may be identical or different.

Concrete examples of the tri- or more-functional radical polymerizable monomer without having a charge transporting structure are illustrated below but are not limited thereto.

That is, the radical polymerizable monomer which can be used in the present invention includes trimethylolpropanetriacrylate (TMPTA), trimethylolpropanetrimethacrylate, HPA-modified trimethylolpropanetriacrylate, EO-modified trimethylolpropane triacrylate, PO-modified trimethylolpropane triacrylate, caprolactone-modified trimethylolpropane triacrylate, lHPA-modified trimethylolpropane trimethacrylate, pentaerythritol triacrylate, pentaerythritol tetraacrylate (PETTA), glycerol triacrylate, ECH-modified glycerol triacrylate, EO-modified glycerol triacrylate, PO-modified glycerol triacrylate, tris(acryloxyethyl)isocyanurate, dipentaerythritol hexacrylate (DPHA), caprolactone-modified dipentaerythritol hexacrylate, dipentaerythritolhydroxy pentaacrylate, alkyl-modified dipentaerythritol pentaacrylate, alkyl-modified dipentaerythritol tetraacrylate, alkyl-modified dipentaerythritol triacrylate, dimethylolpropane tetraacrylate (DTMPTA), pentaerythritolethoxy tetraacrylate, EO-modified phosphonic acid triacrylate, 2,2,5,5,-tetrahydroxymethylcyclopentanone tetraacrylate and the like, which may be used alone or in combination of two or more thereof.

Also, the tri- or more-functional radical polymerizable monomer without having a charge transporting structure which can be used in the present invention a ratio (molecular weight/number of functional group) of molecular weight to the number of functional group in the monomer is preferably 250 or less to form a dense cross-linkage in the cross-linked surface layer. If the ratio is greater than 250, the cross-linked surface layer becomes soft, which may cause somewhat reduction in abrasion resistance. Therefore, in case of using a monomer having a modifying group such as HPA, EO and PO, it is not preferable to use a monomer having an excessively long modifying group alone. The compositional ratio of the tri- or more-functional radical polymerizable monomer without having a charge transporting structure used in the surface layer is 20% to 80% by weight, preferably 30% to 70% by weight relative to the total amount of the cross-linked surface layer and substantially depends on a ratio of the tri- or more-radical polymerizable monomer in the solid content of the coating solution. If the monomer component is less than 20% by weight, 3-dimensional cross-linkage density of the cross-linked surface layer is reduced and thus it cannot accomplish a significant improvement in abrasion resistance as compared to the conventional thermoplastic binder resins. Also, if it exceeds 80% by weight, the content of the charge transport compound is reduced, causing deterioration in electrical properties. Though it is impossible to define a generally preferable range since the required abrasion resistance or electrical properties vary according to a used process, the content is most preferably is in the range of 30% to 70% by weight, considering the balance between both properties.

The mono-functional radical polymerizable compound having a charge transporting structure which is used in the present invention refers to a compound which contains a hole transporting structure, such as, for example, triarylamine, hydrazone, pyrazoline, carbazole and the like, and an electron transporting structure such as for example fused polycyclic quinone, diphenoquinone and an electron pulling aromatic ring having cyano group or nitro group, and has one radical polymerizable functional groups. The radical polymerizable functional group includes functional groups represented by the formulae 10 and 11 above. More concretely, it can be ones as defined for the radical polymerizable monomer, particularly acryloyloxy group, methacyloyloxy group. Also, as the charge transporting structure a triarylamine structure is highly effective, and particularly, a compound represented by the following formulae (1) or (2) can be used to maintain good electrical properties such as sensitivity and residual potential.

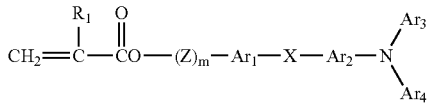
(1)

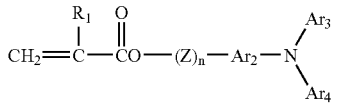
(2)

wherein, $R_1$ represents a hydrogen atom, a halogen atom, an alkyl group which may be substituted, an aralkyl group which may be substituted, an aryl group which may be substituted, a cyano group, a nitro group, an alkoxy group, —$COOR_7$ ($R_7$ represents a hydrogen atom, an alkyl group which may be substituted, an aralkyl group which may be substituted or an aryl group which may be substituted), a halogenated carbonyl group or $CONR_8R_9$ ($R_8$ and $R_9$ represent a hydrogen atom, a halogen atom, an alkyl group which may be substituted, an aralkyl group which may be substituted or an aryl group which may be substituted, which may be identical or different), $Ar_1$ and $Ar_2$ represent a substituted or usubstituted arylene group, which may be identical or different, $Ar_3$ and $Ar_4$ represent a substituted or usubstituted aryl group, which may be identical or different, X represents a single bond, a substituted or usubstituted alkylene group, a substituted or usubstituted cycloalkylene group, a substituted or usubstituted alkylene ether group, a oxygen atom, a sulfur atom or a vinylene group. Z represents a substituted or usubstituted alkylene group, a substituted or usubstituted alkylene ether group or an alkyleneoxycarbonyl group, and "m" and "n" represent an integer of 0 to 3.

Concrete examples of the formulae (1) and (2) are as follows.

In the formulae (1) and (2), the alkyl group as a substituent of $R_1$ includes, for example, methyl group, ethyl group, propyl group, butyl group and the like, the aryl group includes phenyl group, naphthyl group and the like, the aralkyl group includes benzyl group, phenethyl group, naphthylmethyl group and the like, the alkoxy group includes methoxy group, ethoxy group, propoxy group the like, which may be substituted by a halogen atom, a nitro group, a cyano group, an alkyl group such as methyl group, ethyl group and the like, an alkoxy group such as methoxy group, ethoxy group and the like, an aryloxy group such as phenoxy group and the like, an aryl group such as phenyl group, naphthyl group and the like, an aralkyl group such as benzyl group, phenethyl group and the like.

Particularly preferred examples of the substituents of $R_1$ are a hydrogen atom and methyl group.

The substituted or usubstituted $Ar_3$ and $Ar_4$ are an aryl group and the examples of the aryl group include fused polycyclic hydrocarbon groups non-fused cyclic hydrocarbon groups and polycyclic groups.

The fused polycyclic hydrocarbon group is preferably one having 18 or less carbon atoms to form a ring, including, for example, pentanyl group, indenyl group, naphthyl group, azulenyl group, heptaprenyl group, biphenylenyl group, a s-indacenyl group, s-indacenyl group, fluorenyl group, acenaphthylenyl group, pleiadene adenyl group, acenaphthenyl group, phenalenyl group, phenathryl group, antholyl group, fluorandenyl group, acephenanthrylenyl group, aceanthrylenyl group, triphenylenyl group, pyrenyl group, chrysene, and naphthacenyl group.

The non-fused hydrocarbon group includes an univalent group of a monocyclic hydrocarbon compound such as benzene, diphenyl ether, polyethylenediphenyl ether, diphenylthioether and diphenylsulphone, an univalent group of a non-fused polycyclic hydrocarbon compound, such as biphenyl, polyphenyl, diphenylalkane, diphenylalkene, diphenylalkyne, triphenylmethane, distyrylbenzene, 1,1-diphenylcycloalkane, polyphenylalkane and polyphenylalkene, or an univalent group of a cyclic hydrocarbon compound such as 9,9-diphenylfluorene.

The polycylic group includes a univalent group of carbazole, dibenzofuran, dibenzothiphene, oxadiazole, and thiadiazole.

Also, the aryl group represented by $Ar_3$ and $Ar_4$ may be substituted by a substituent, for example, as follows.

(1) a halogen atom, a cyano group, a nitro group and the like.

(2) an alkyl group, preferably a $C_1$ to $C_{12}$, particularly a $C_1$ to $C_8$, more preferably a $C_1$ to $C_4$ straight-chained or branched alkyl group, wherein the alkyl group may be further substituted by a fluorine atom, a hydroxy group, a cyano group, a $C_1$ to $C_4$ alkoxy group, phenyl group, or a phenyl group substituted by a halogen atom, a $C_1$ to $C_4$ alkyl group or a $C_1$ to $C_4$ alkoxy group. Concretely, it includes methyl group, ethyl group, n-butyl group, i-propyl group, t-butyl group, s-butyl group, n-propyl group, trifluoromethyl group, 2-hydroxyethyl group, 2-ethoxyethyl group, 2-cyanoethyl group, 2-methoxyethyl group, benzyl group, 4-chlorobenzyl group, 4-methylbenzyl group, 4-phenylbenzyl group and the like.

(3) an alkoxy group (—$OR_2$), wherein $R_2$ represents an alkyl group as defined in (2). Concretely, it includes methoxy group, ethoxy group, n-propoxy group, i-propoxy group, t-butoxy group, n-butoxy group, s-butoxy group, i-butoxy group, 2-hydroxyethoxy group, benzyloxy group, tri-fluoromethoxy group and the like.

(4) an aryloxy group, wherein the aryl group may be phenyl group and naphthyl group, which may be substituted by a $C_1$ to $C_4$ alkoxy group, a $C_1$ to $C_4$ alkyl group or a halogen atom. Concretely, it includes phenoxy group, 1-naphthyloxy group, 2-naphthyloxy group, 4-methoxyphenoxy group, 4-methylphenoxy group and the like.

(5) an alkylmercapto group or arylmercapto group. Concretely, it includes methylthio group, ethylthio group, phenylthio group, p-methylphenylthio group and the like.

(6)

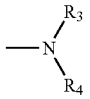

wherein, $R_3$ and R4 represent each independently a hydrogen atom, an alkyl group as defined in (2), or aryl group. The aryl group includes, for example, phenyl group, biphenyl group or naphthyl group, which may be substituted by a $C_1$ to $C_4$ alkoxy group, a $C_1$ to $C_4$ alkyl group or a halogen atom, or $R_3$ and $R_4$ may form a ring together.

Concretely, it includes amino group, diethylamino group, N-methyl-N-phenylamino group, N,N-diphenylamino group, N,N-di(tryl)amino group, dibenzylamino group, piperidino group, morpholino group, pyrrolidono group and the like.

(7) an alkylenedioxy group or alkylenedithio group such as methylenedioxy group or methylenedithio group.

(8) a substituted or usubstituted styryl group, a substituted or usubstituted β-phenylstyryl group, a diphenylaminophenyl group, ditolylaminophenyl group and the like.

The arylene group represented by $Ar_1$ and $Ar_2$ includes a divalent group derived from an aryl group represented by $Ar_3$ and $Ar_4$.

X represents a single bond, a substituted or usubstituted alkylene group, a substituted or usubstituted cycloalkylene group, a substituted or usubstituted alkylene ether group, an oxygen atom, a sulfur atom, or vinylene group.

The substituted or usubstituted alkylene group is a $C_1$ to $C_{12}$, preferably $C_1$ to $C_8$, more preferably $C_1$ to $C_4$ straight chained or branched alkylene group, wherein the alkylene group may be further substituted by a fluorine, a hydroxy group, a cyano group, an $C_1$ to $C_4$ alkoxy group, a phenyl group, or a phenyl group substituted by a halogen atom, a $C_1$ to $C_4$ alkyl group or a $C_1$ to $C_4$ alkoxy group. Concretely, it includes methylene group, ethylene group, n-butylene group, i-propylene group, t-butylene group, s-butylene group, n-propylene group, trifluoromethylene group, 2-hydroxyethylene group, 2-ethoxyethylene group, 2-cyanoethylene group, 2-methoxyethylene group, benzylidene group, phenylethylene group, 4-chlorophenylethylene group, 4-methylphenylethylene group, 4-biphenylethylene group and the like.

The substituted or usubstituted cycloalkylene group is a $C_5$ to $C_7$ cyclic alkylene group, wherein the cyclic alkylene group may be substituted by a fluorine atom, a $C_1$ to $C_4$ alkyl group or a $C_1$ to $C_4$ alkoxy group. Concretely, it includes cyclohexylidene group, cyclohexylene group, 3,3-dimethylcyclohexylidene group and the like.

The substituted or usubstituted alkylene ether group represents ethyleneoxy, propyleneoxy, ethylene glycol, propyleneglycol, diethyleneglycol, tetraethylene glycol or tripropyleneglycol, wherein the alkylene group may be substituted by a hydroxyl group, methyl group, ethyl group and the like.

The vinylene group is represented by the following formula.

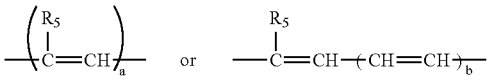

wherein $R_5$ represents hydrogen, an alkyl group (which is the same as defined in (2)) or an aryl group (which is the same with the aryl group represented by $Ar_3$ and $Ar_4$), "a" represents 1 or 2, and "b" represents 1 to 3.

Z represents a substituted or usubstituted alkylene group, a substituted or usubstituted alkylene ether group, or an alkyleneoxycarbonyl group.

The substituted or usubstituted alkylene group includes the alkylene groups as defined for X.

The substituted or usubstituted alkylene ether group includes the alkylene ether groups as defined for X.

The alkyleneoxycarbonyl group includes caprolactone-modified groups.

The mono-functional radical polymerizable compound having a charge transporting structure is more preferably a compound having a structure of formula (3).

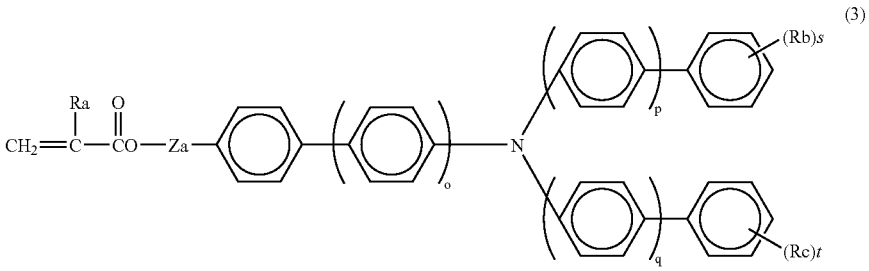

(3)

wherein, "o," "p" and "q" each represent an integer of 0 or 1, Ra represents a hydrogen atom, a methyl group, Rb and Rc represent a substituent other than a hydrogen atom which is a C1-6 alkyl group and may be different when they are two or more, "s" and "t" represent an integer of 0 to 3, and Za represents a single bond, a methylene group, an ethylene group,

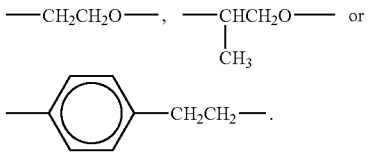

The compound represented by the above formula is preferably a compound wherein Rb and Rc are methyl group or ethyl group.

The radical polymerizable compound having a mono-functional charge transporting structure of the formulae (1) and (2), particularly the formula (3) radical polymerizable compound, which is used in the present invention cannot be a terminal structure, sine the polymerization is accomplished by opening of the carbon-carbon double bond at both sides, but is inserted interposed in a continuous polymer chain. In a polymer cross-linked by polymerization with tri- or more-functional radical polymerizable monomer, it exists in the main chain of the polymer and in the cross-linkage between a main chain and a main chain (the cross-linkage includes a intermolecular cross-linkage between one polymer and the other polymer and an intramolecular cross-linkage between one site where a folded main chain is present in a polymer and the other site which is derived from a monomer polymerized at a position remote from the one site in the main chain). However, even when it is present in the main chain or it is present in the cross-linkage, it has at least three aryl groups radially oriented from a nitrogen atom in the triarylamine structure suspended from the chain and, though being bulky, is not directly bonded to the chain but suspended from the chain, for example, by a carbonyl group, whereby it is versatilely fixed for three dimensional orientation. Therefore, since the triarylamine structures can be properly oriented spatially adjacent to each other in a polymer, they do not lead to large structural distortion in a molecule, and it can be expected that when applied in a surface layer of an electrophotographic photoconductor, it may provide an intramolecular structure relatively avoiding interruption of a charge transport passage.

Concrete examples of the mono-functional radical polymerizable compound having a charge transporting structure according to the present invention are illustrated below (No. 1 to No. 160), but are not limited to compounds of these structures.

No. 1
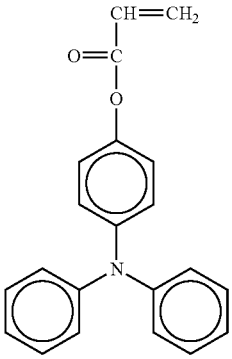
No. 2
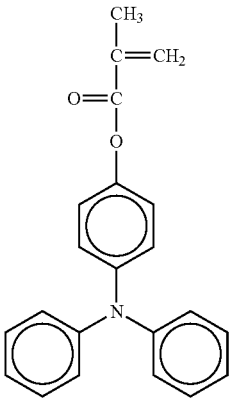
No. 3
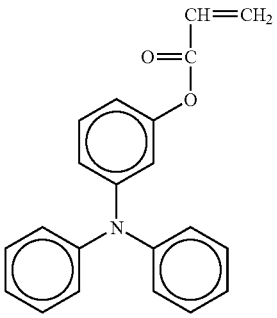
No. 4
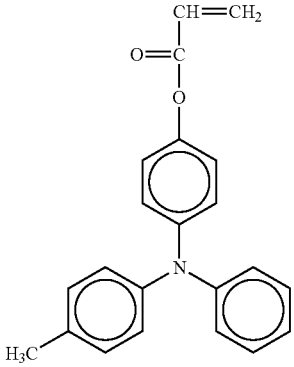
-continued
No. 5
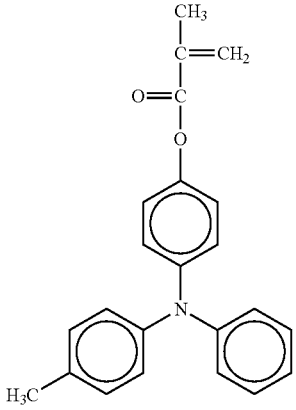
No. 6
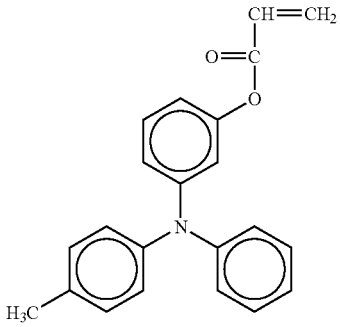
No. 7
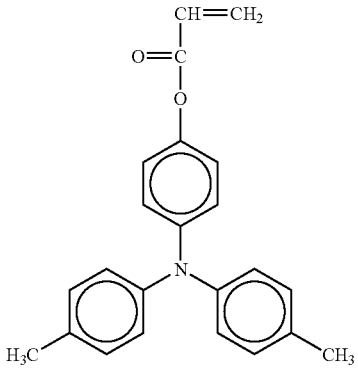

-continued
No. 8
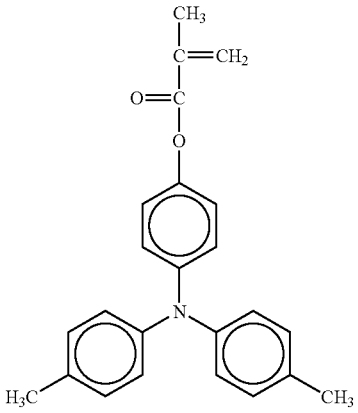
No. 9
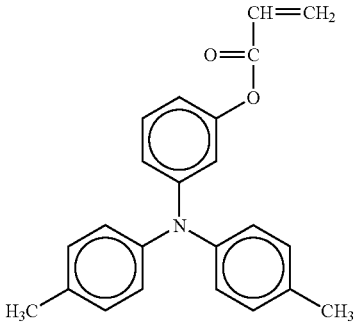
No. 10
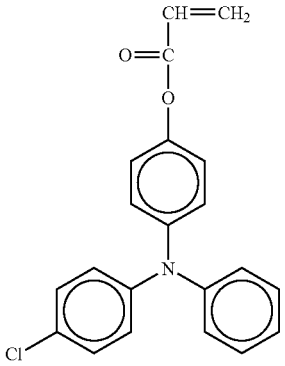
-continued
No. 11
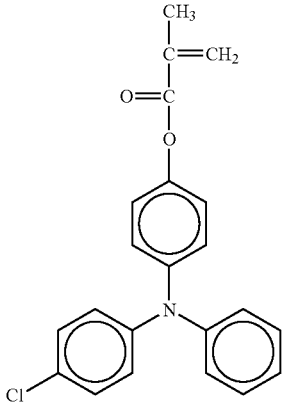
No. 12
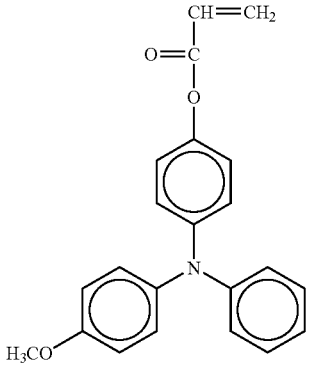
No. 13
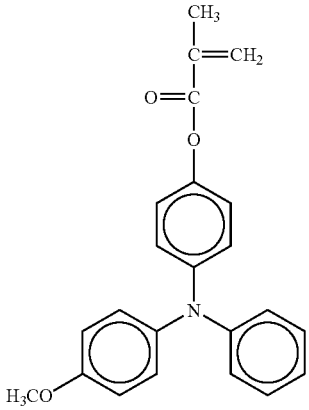
No. 14
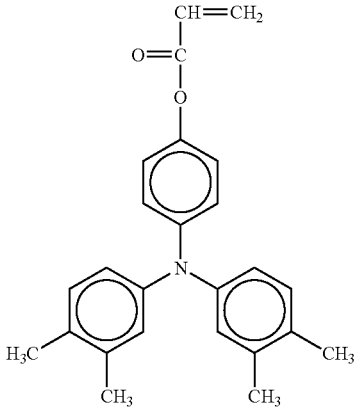

-continued
No. 15
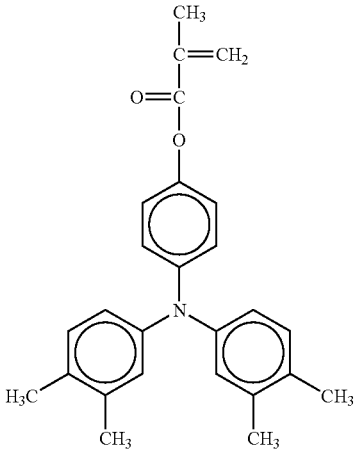
No. 16
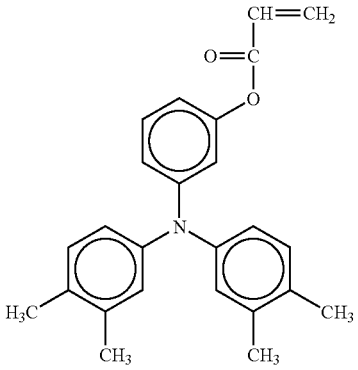
No. 17
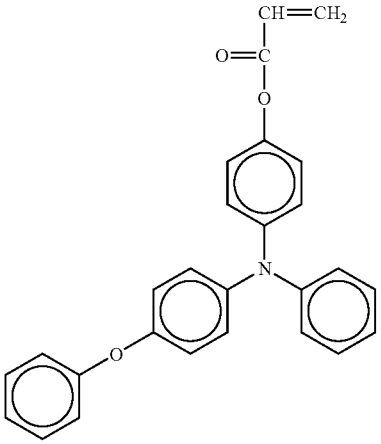
-continued
No. 18
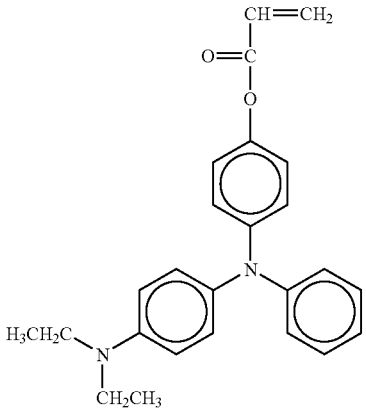
No. 19
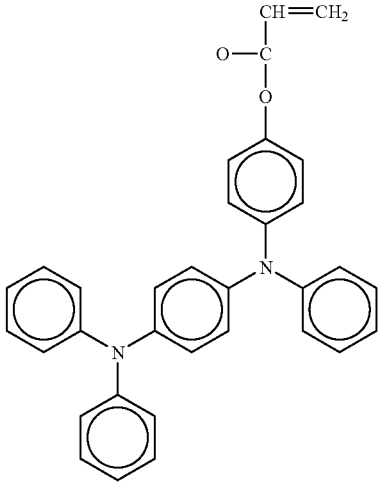
No. 20
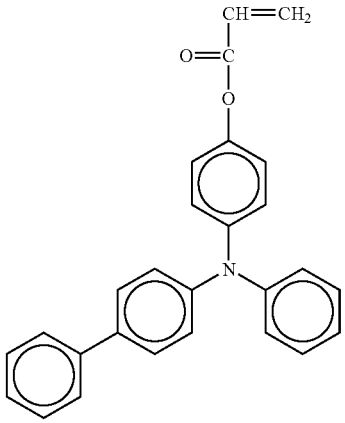

-continued
No. 21
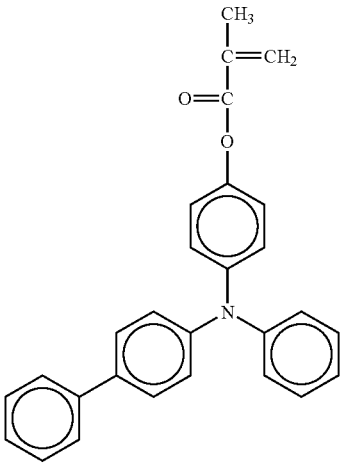
No. 22
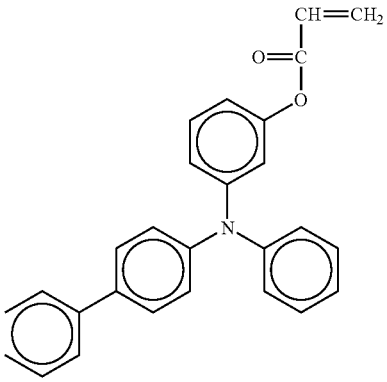
No. 23
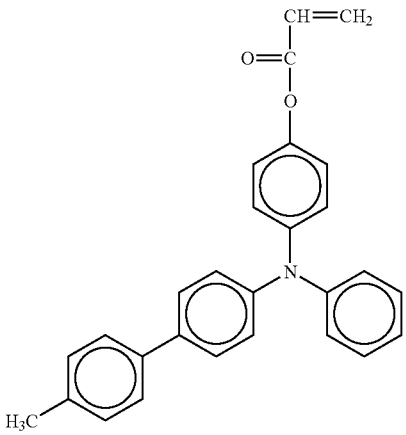
-continued
No. 24
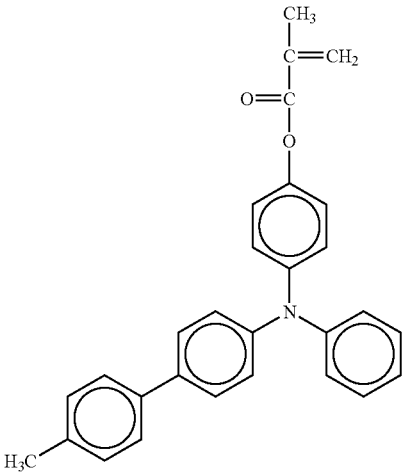
No. 25
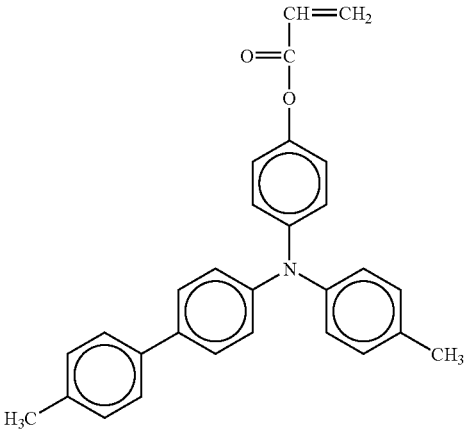
No. 26
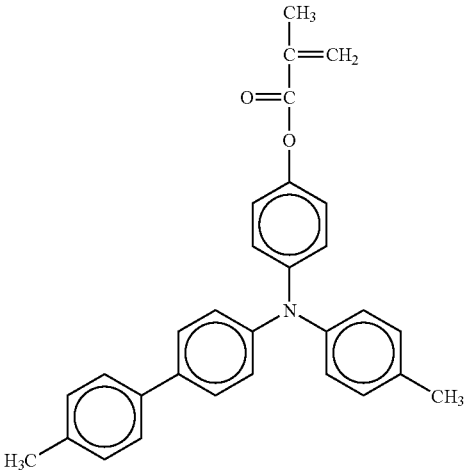

-continued
No. 27
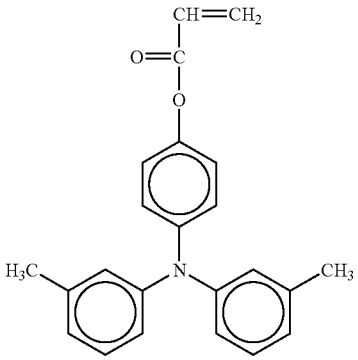
No. 28
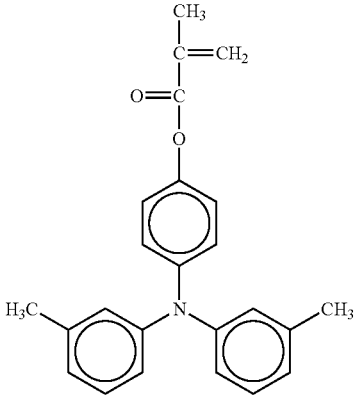
No. 29
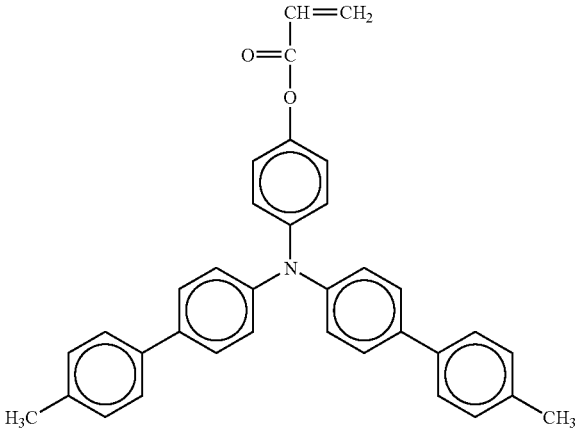
-continued
No. 30
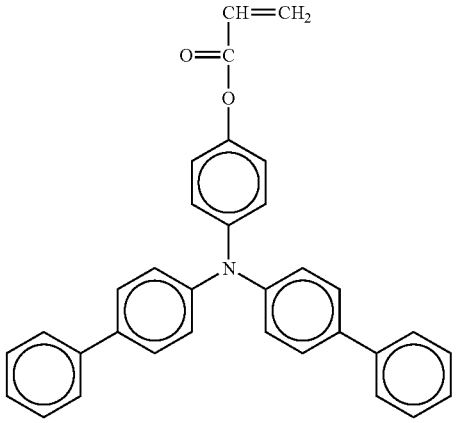
No. 31
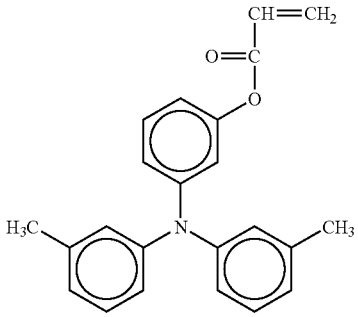
No. 32
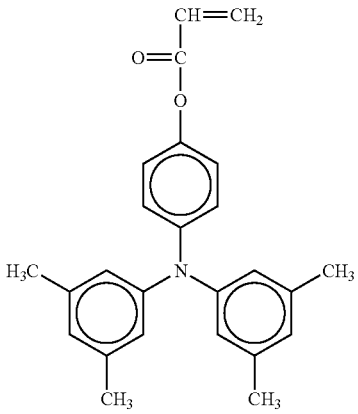

-continued
No. 33
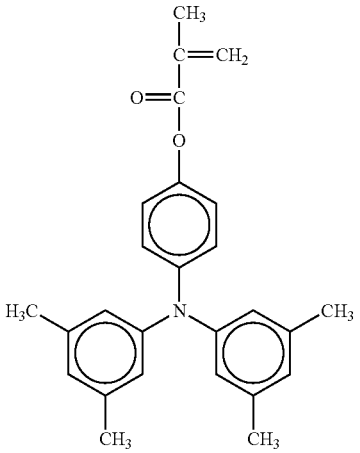
No. 34
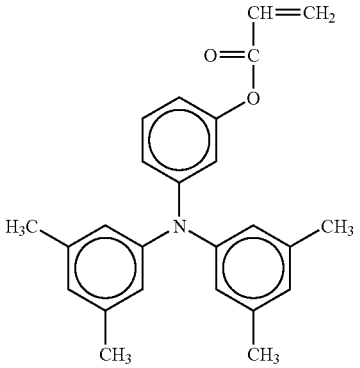
No. 35
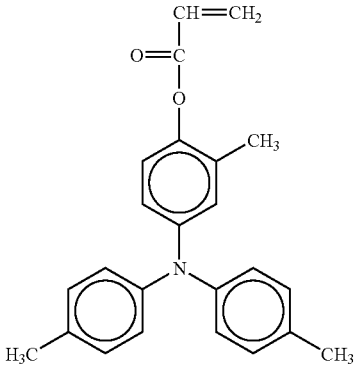
No. 36
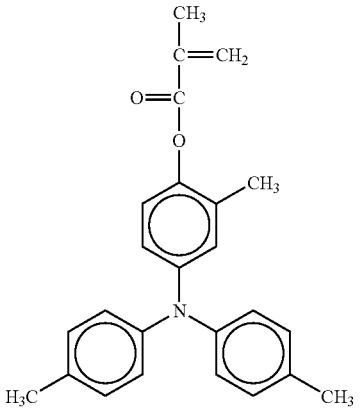
-continued
No. 37
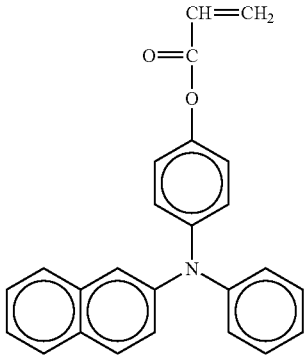
No. 38
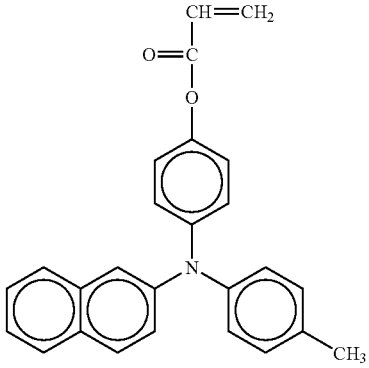
No. 39
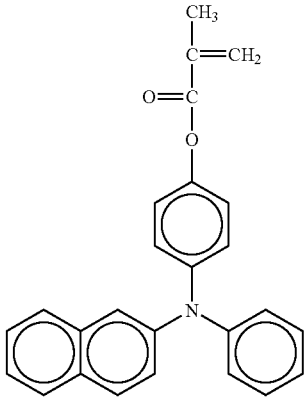
No. 40
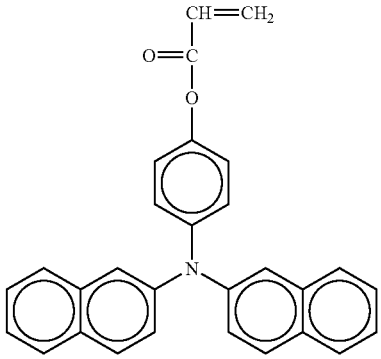

-continued
No. 41
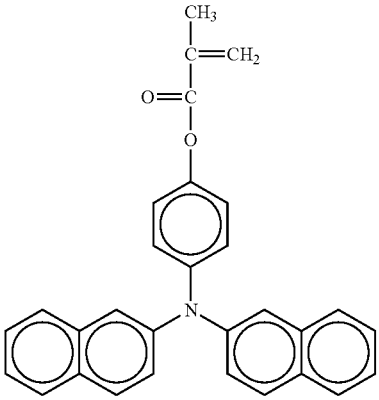
No. 42
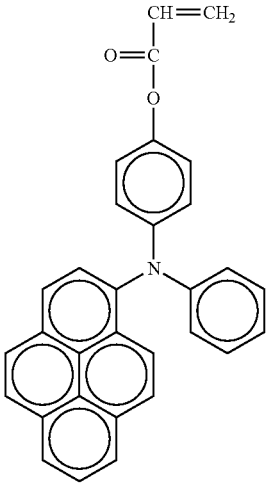
No. 43
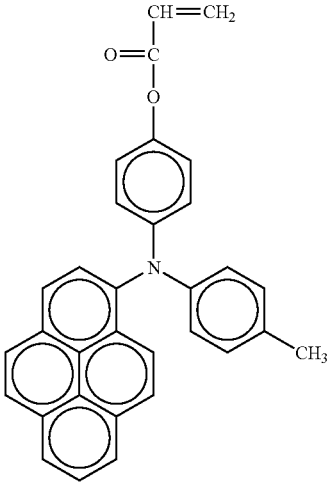
-continued
No. 44
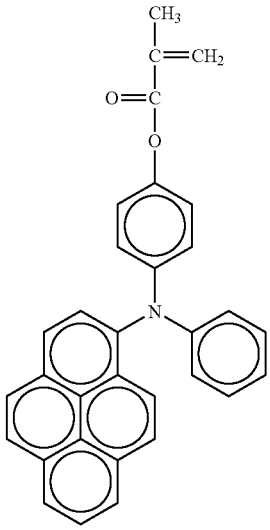
No. 45
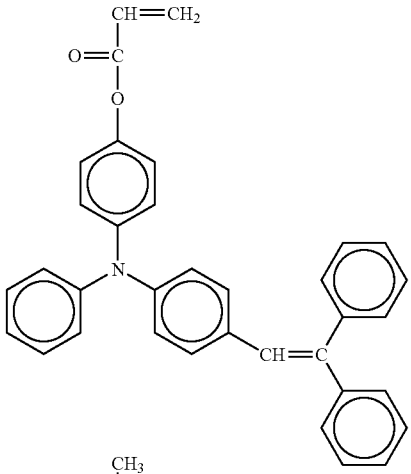
No. 46
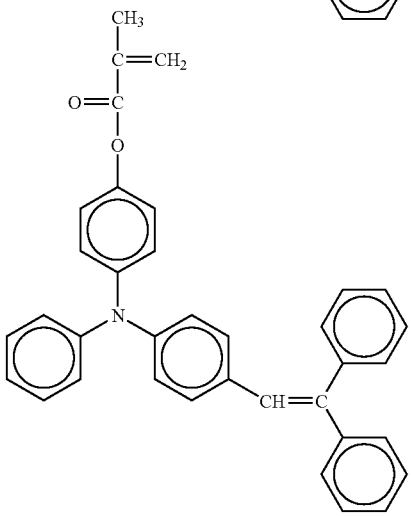

-continued
No. 47
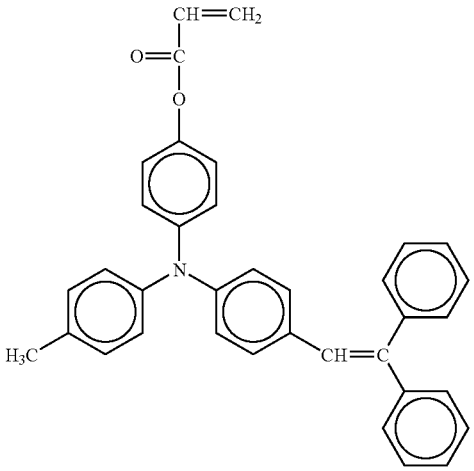
No. 48
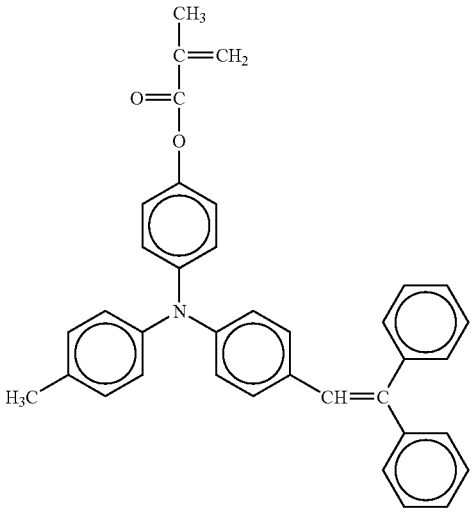
No. 49
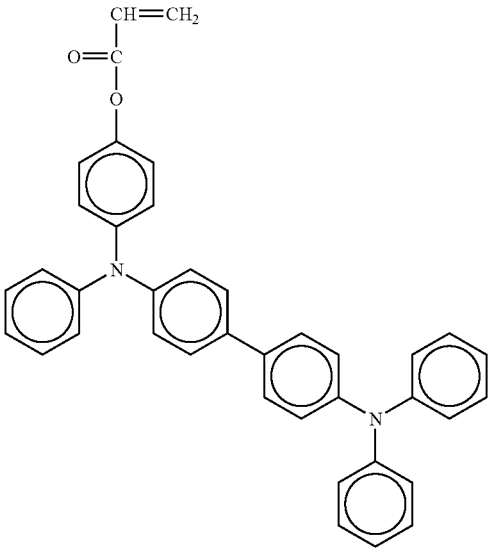
-continued
No. 50
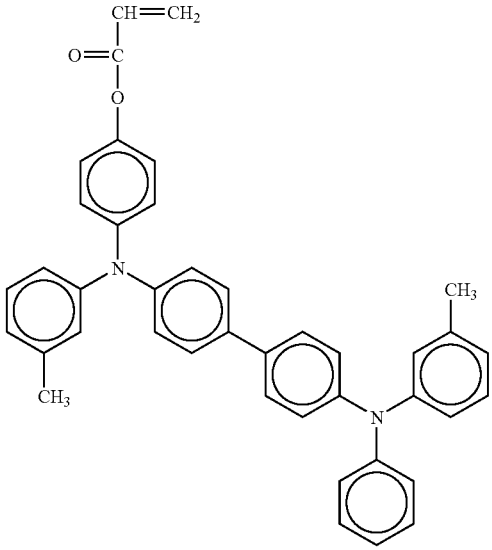
No. 51
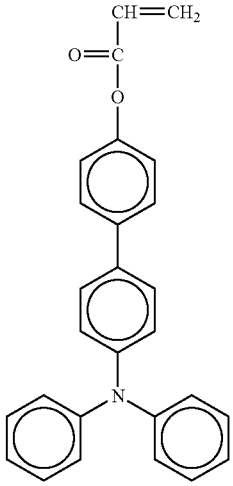
No. 52
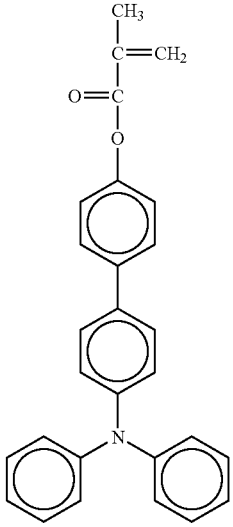

-continued
No. 53
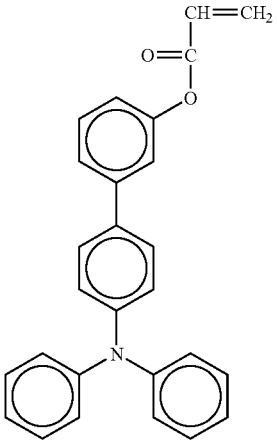
No. 54
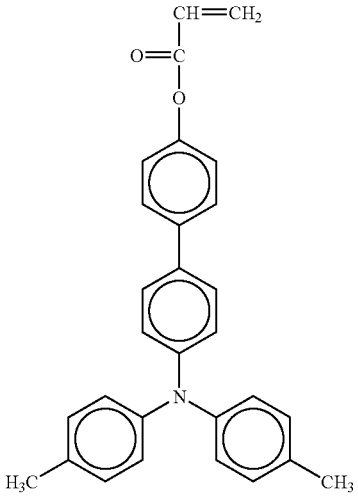
No. 55
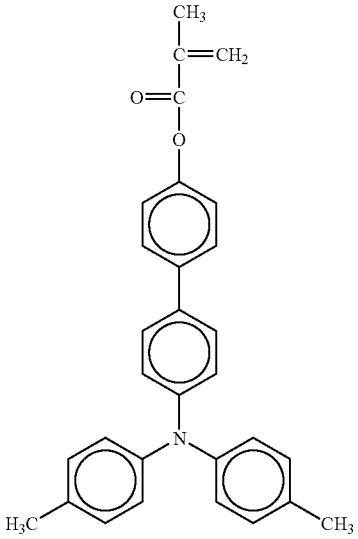
-continued
No. 56
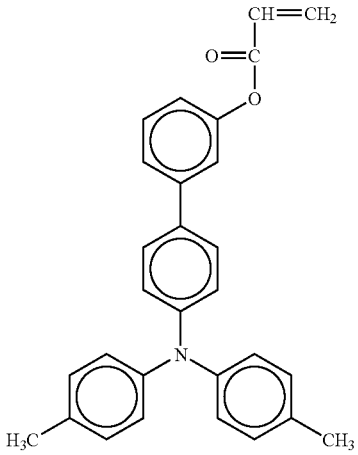
No. 57
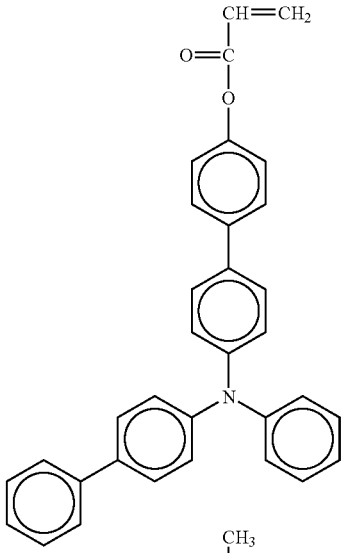
No. 58
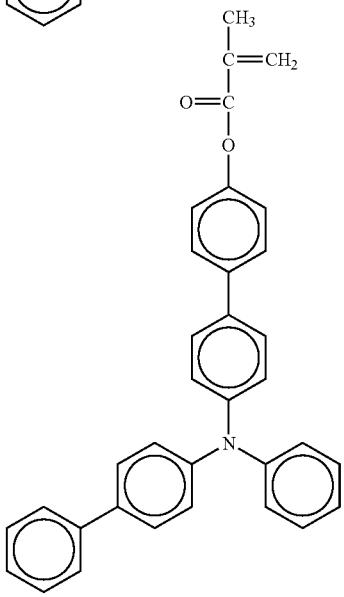

-continued
No. 59
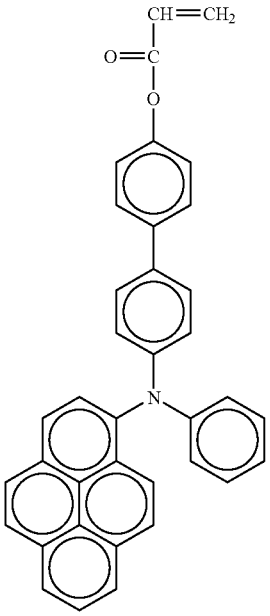
No. 60
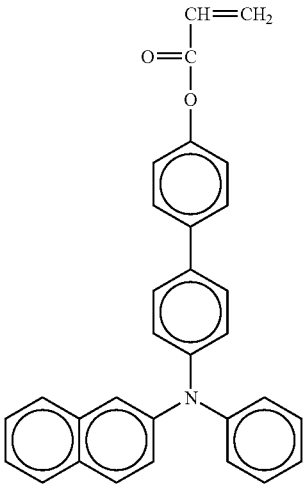
No. 61
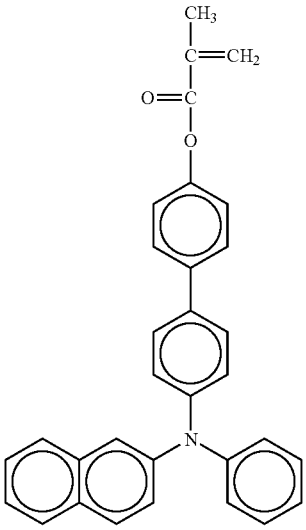
-continued
No. 62
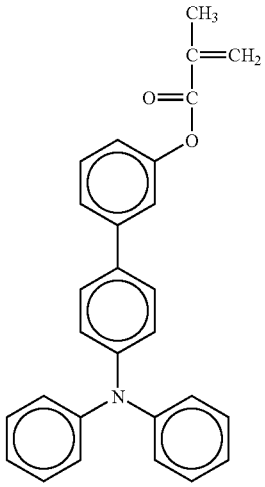
No. 63
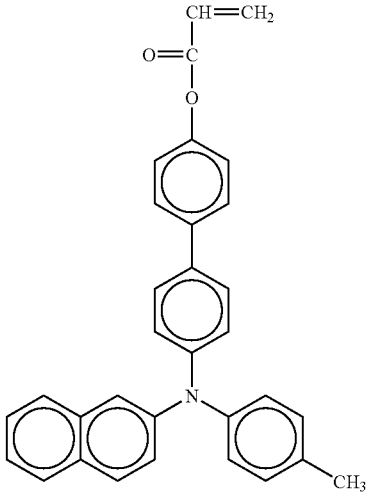
No. 64
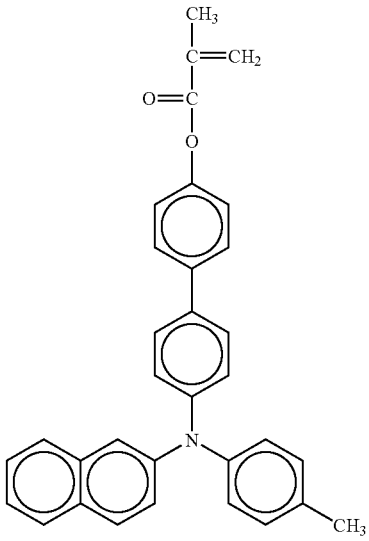

-continued
No. 65
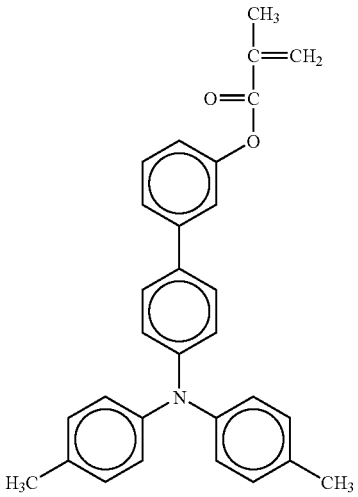
No. 66
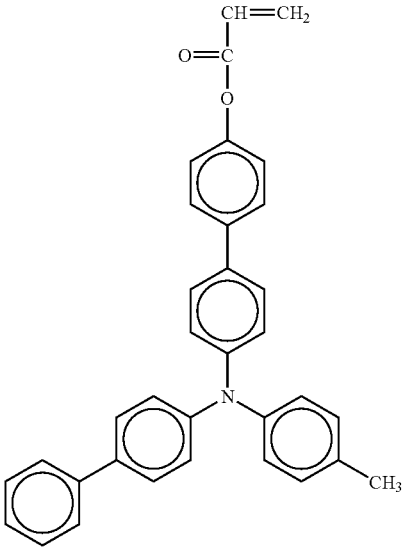
No. 67
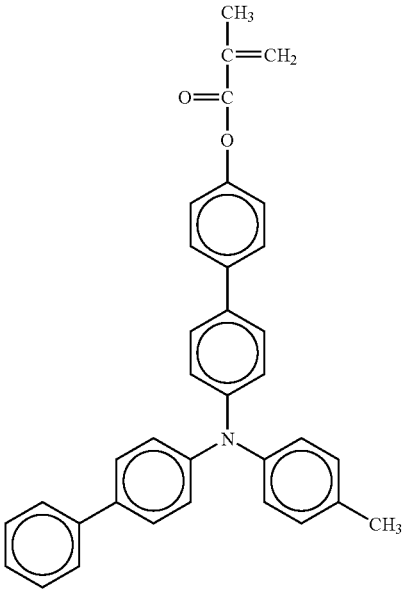
-continued
No. 68
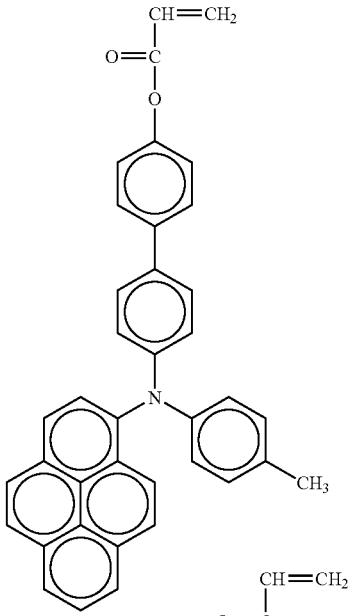
No. 69
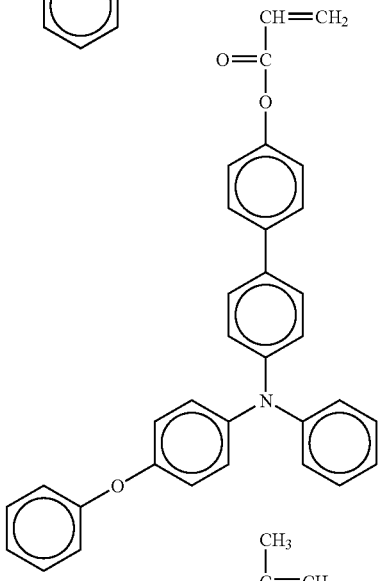
No. 70
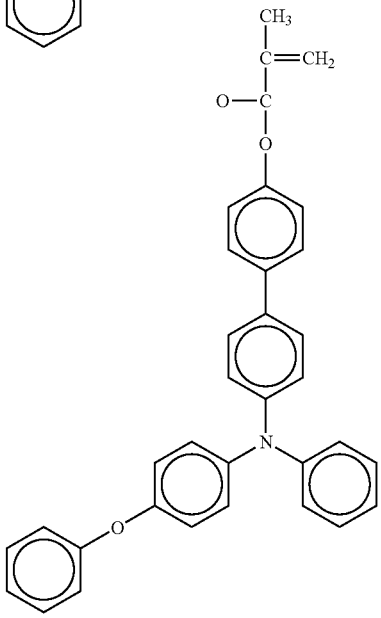

-continued
No. 71
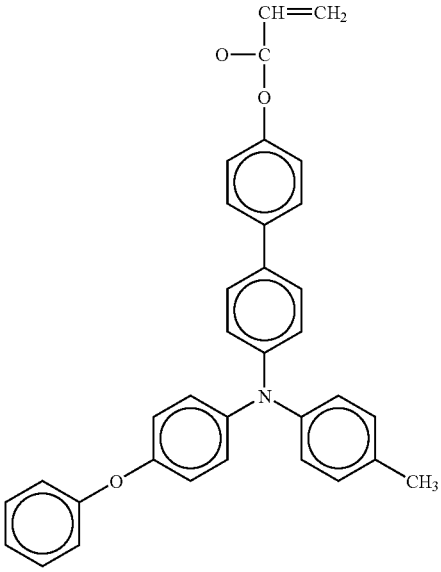
No. 72
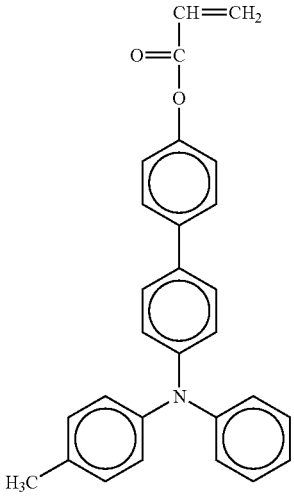
No. 73
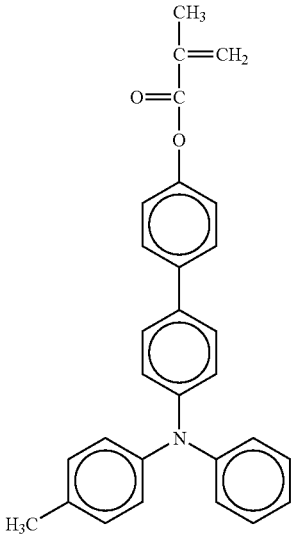
-continued
No. 74
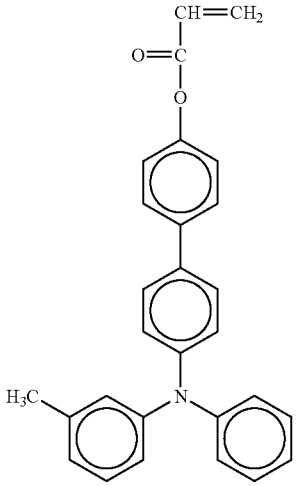
No. 75
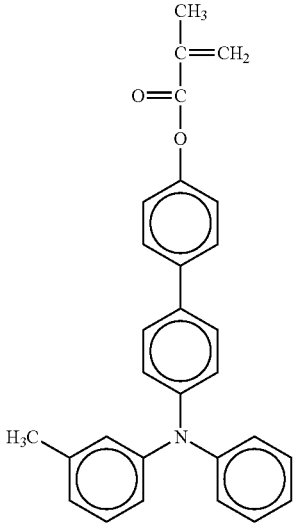
No. 76
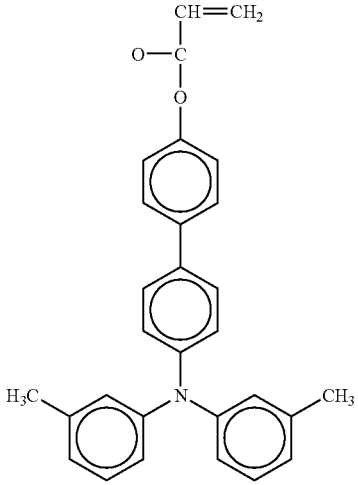

-continued
No. 77
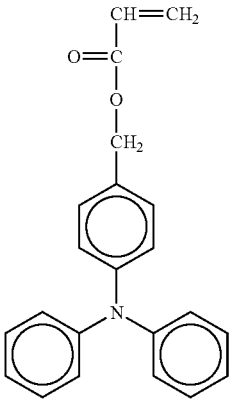
No. 78
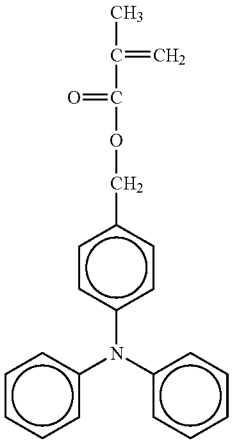
No. 79
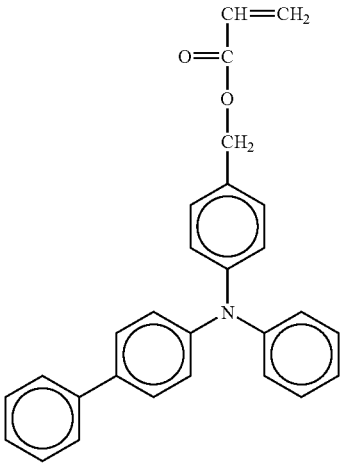
-continued
No. 80
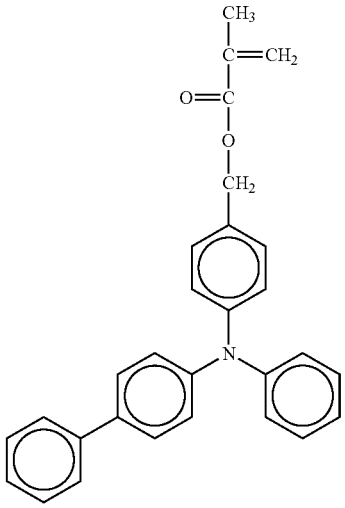
No. 81
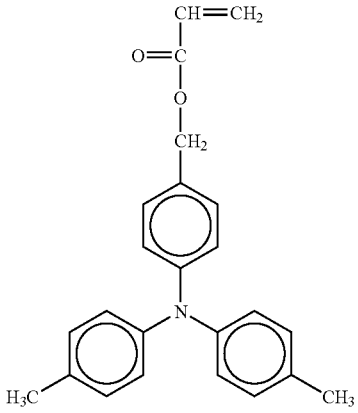
No. 82
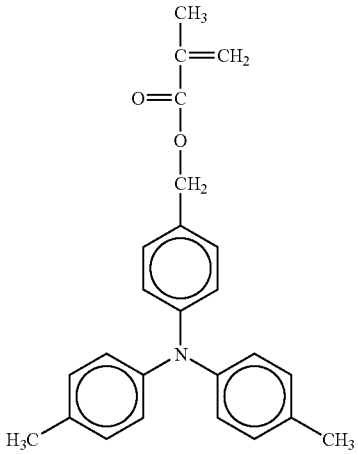

-continued
No. 83
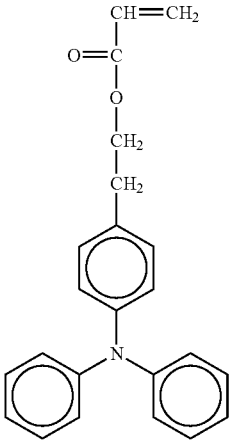
No. 84
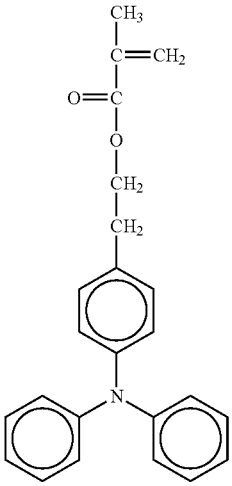
No. 85
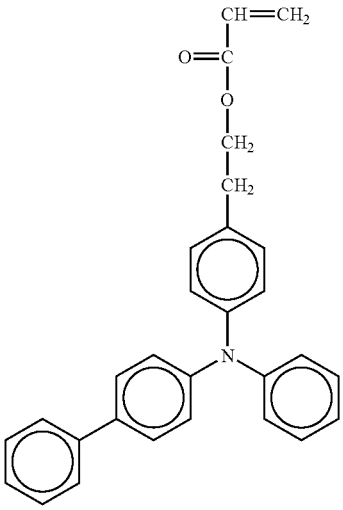
-continued
No. 86
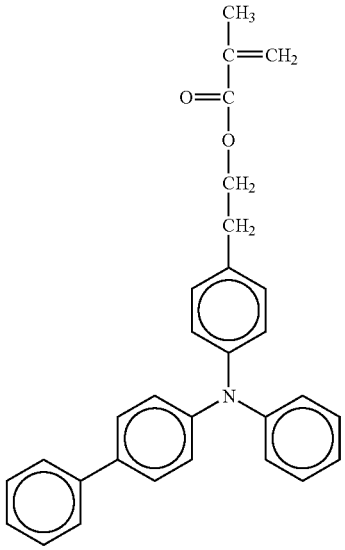
No. 87
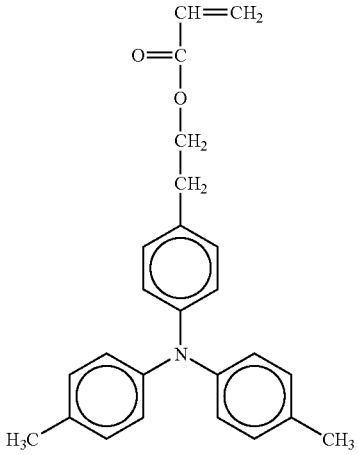
No. 88
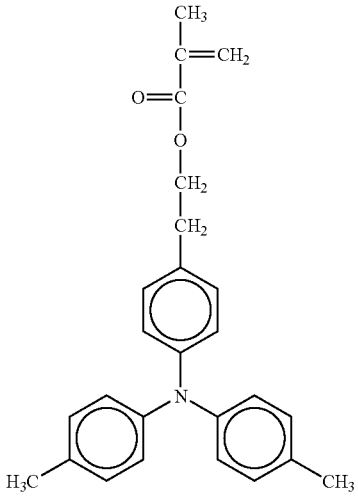

-continued
No. 89
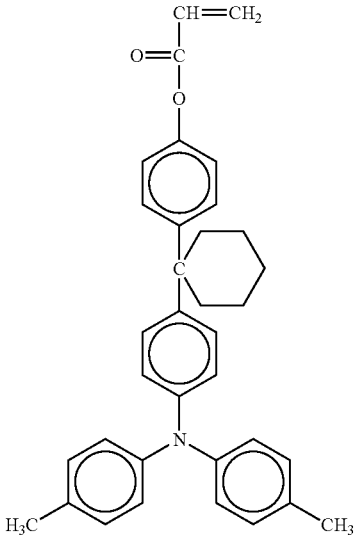
-continued
No. 91
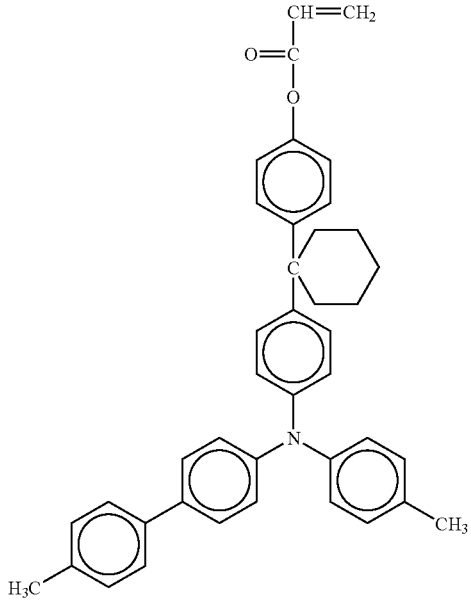
No. 90
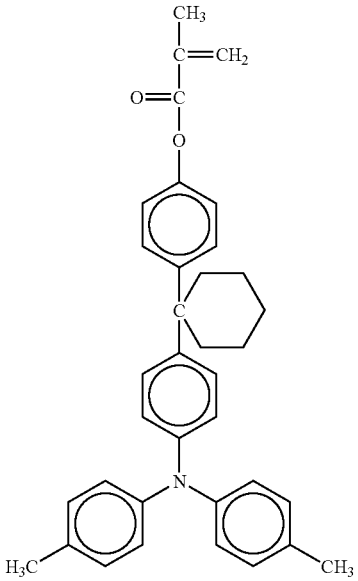
No. 92
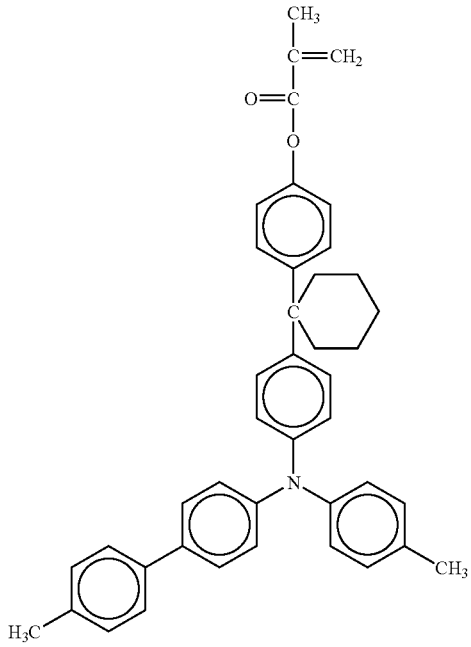

-continued
No. 93
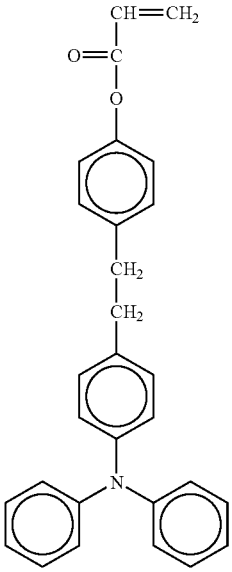
No. 94
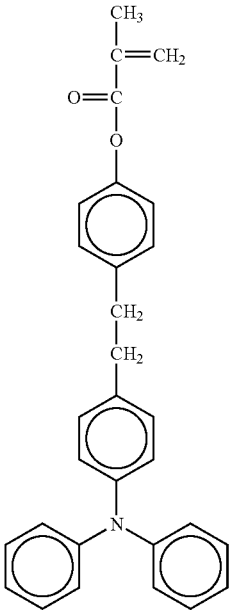
-continued
No. 95
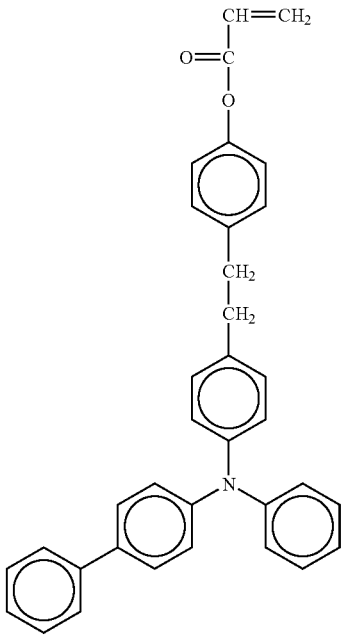
No. 96
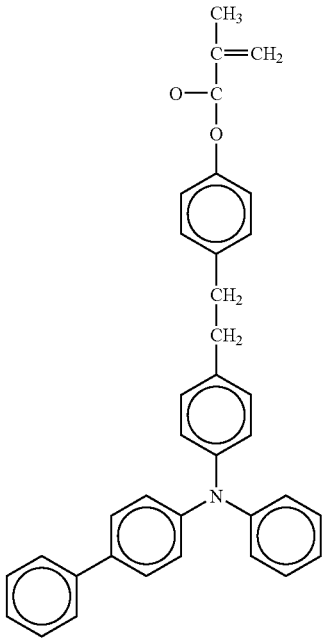

-continued
No. 97
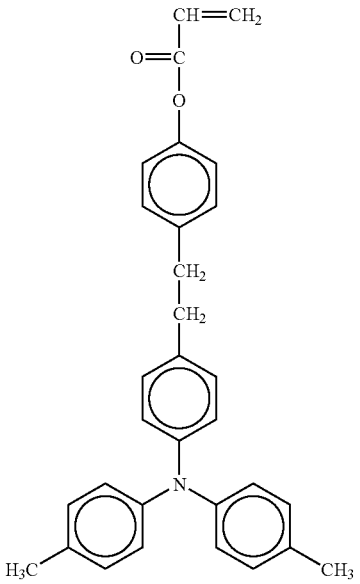
No. 98
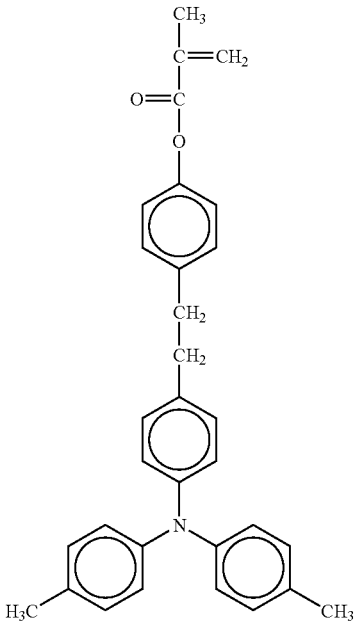
-continued
No. 99
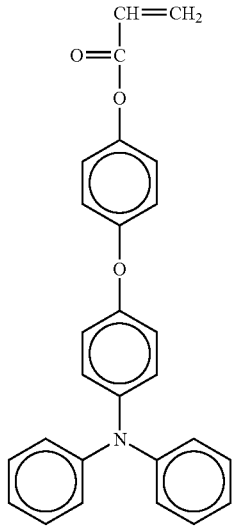
No. 100
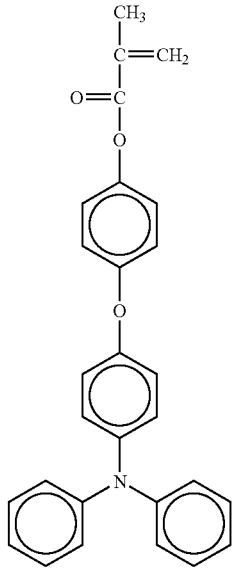

-continued
No. 101
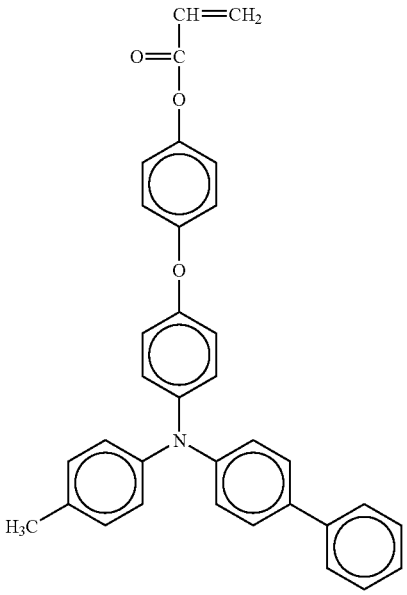
-continued
No. 103
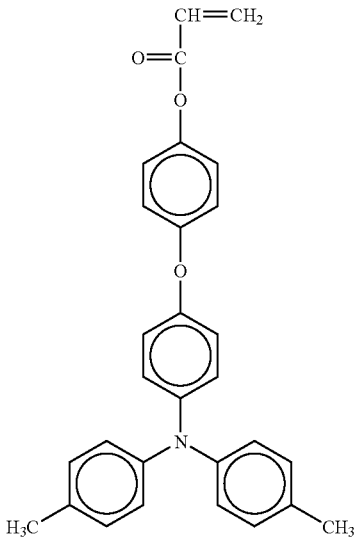
No. 102
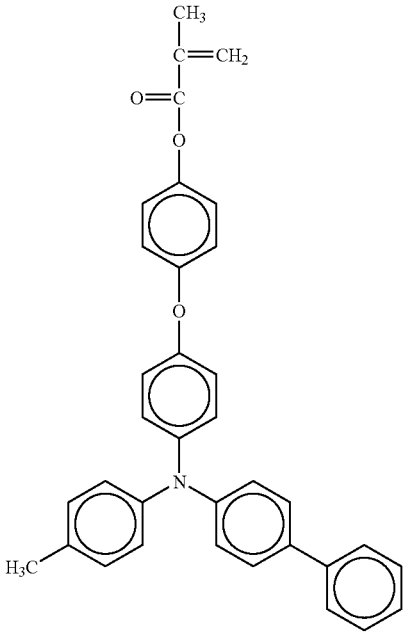
No. 104
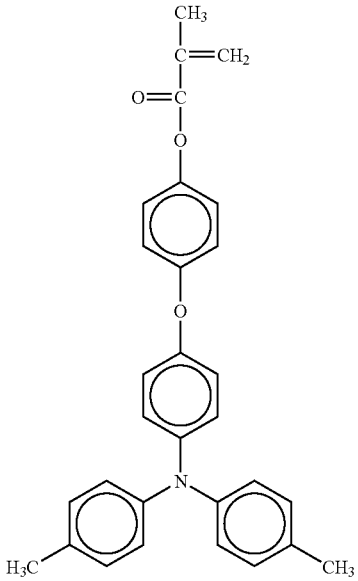

-continued
No. 105
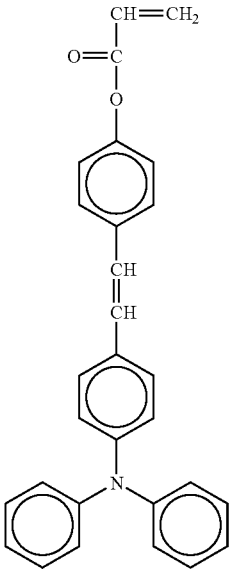
No. 106
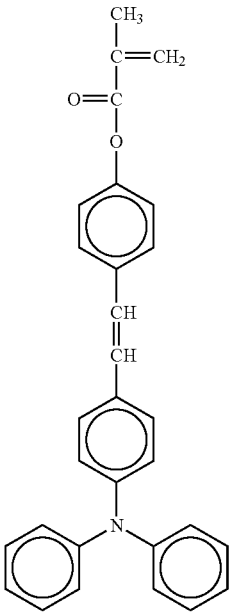
-continued
No. 107
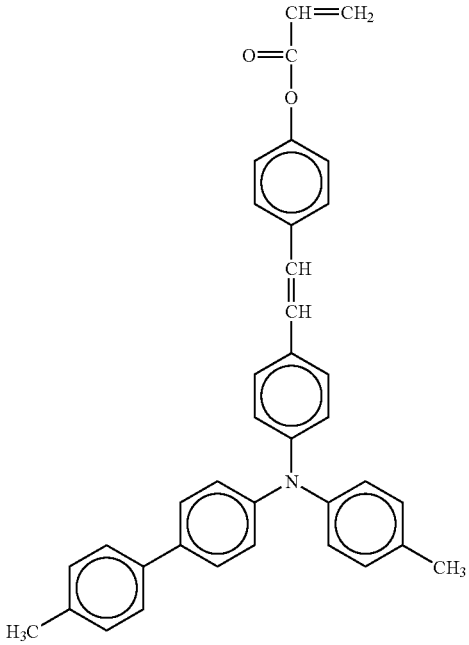
No. 108
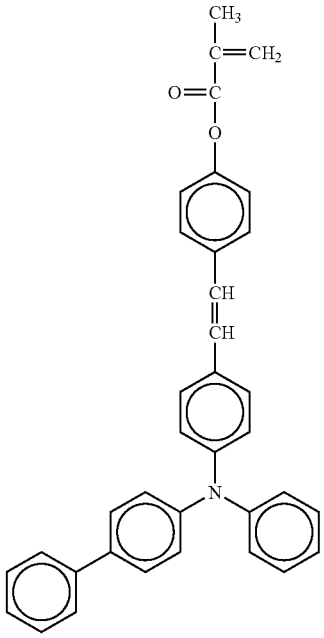

-continued
No. 109
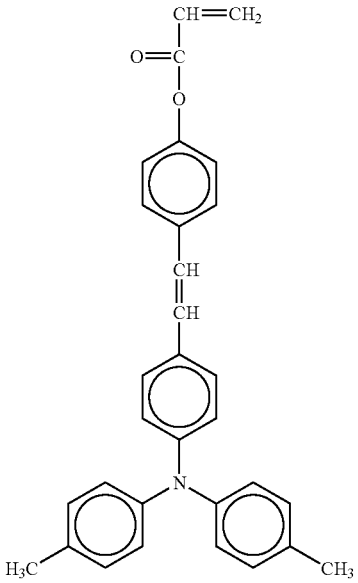
No. 110
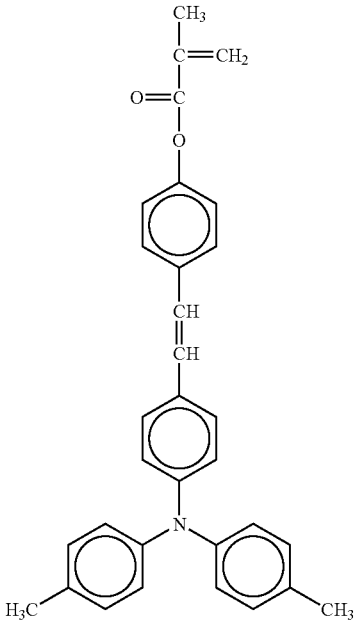
-continued
No. 111
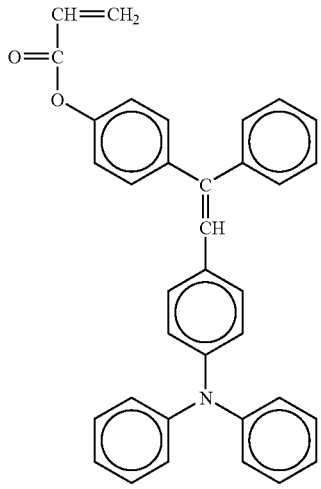
No. 112
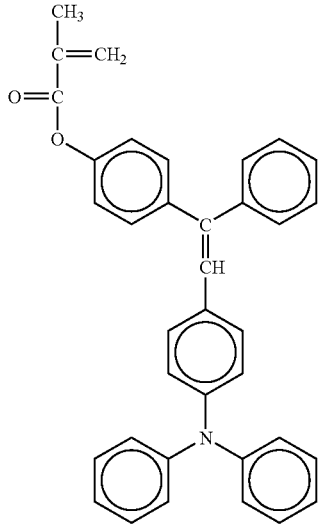

-continued
No. 113
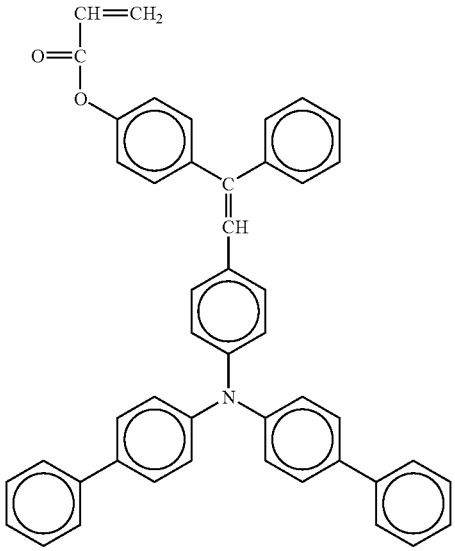
-continued
No. 115
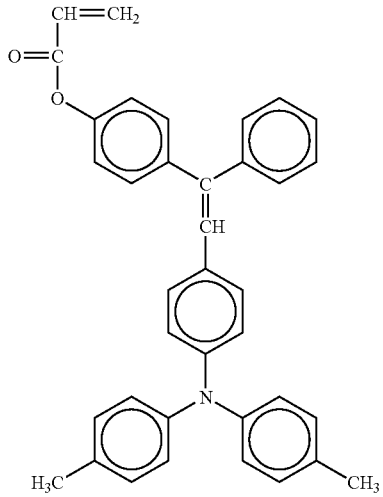
No. 114
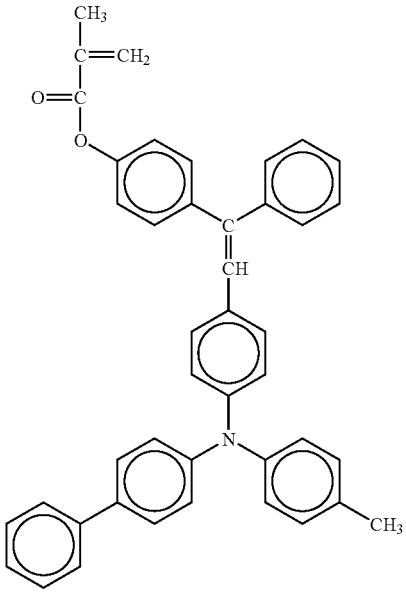
No. 116
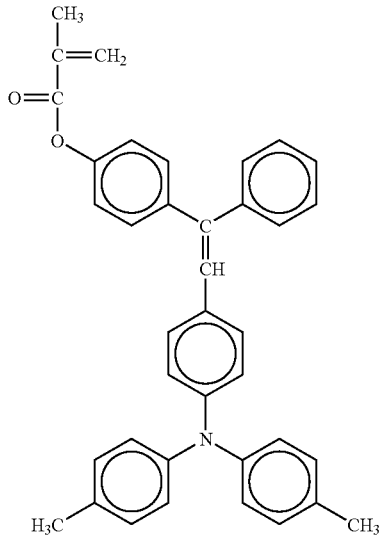

-continued
No. 117
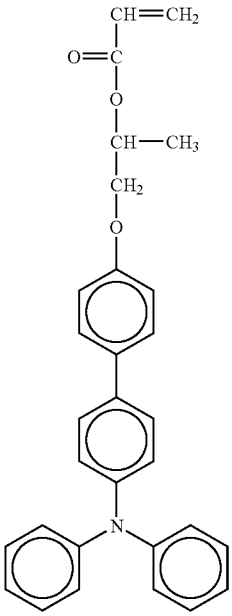
-continued
No. 119
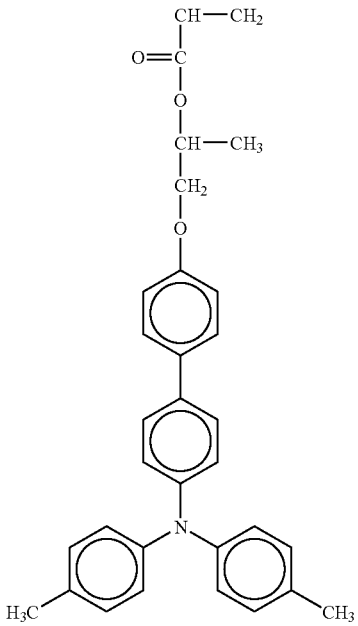
No. 118
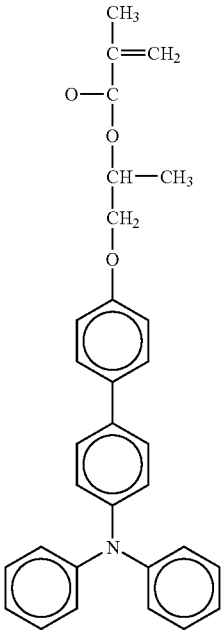
No. 120
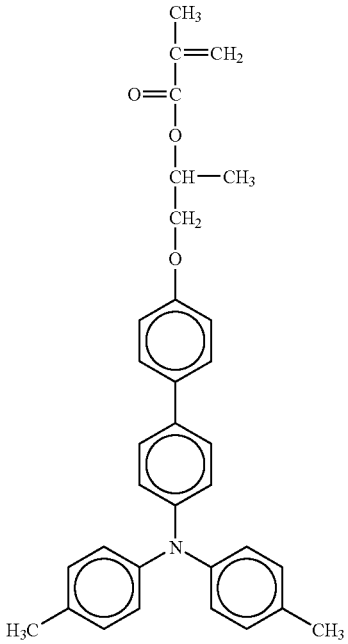

-continued
No. 121
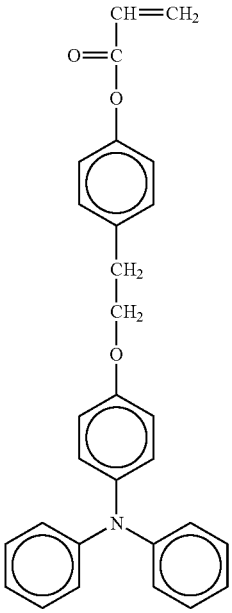
No. 122
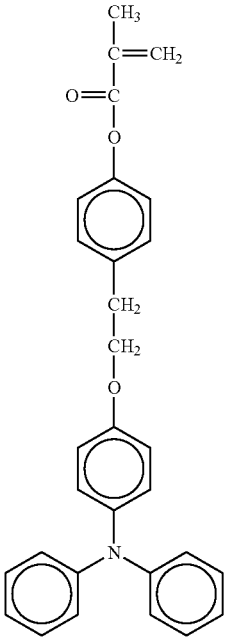
-continued
No. 123
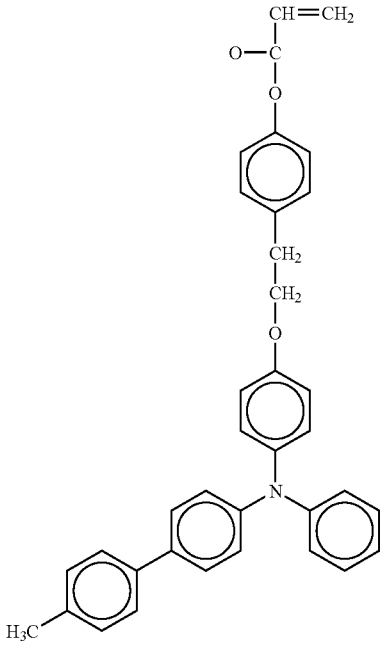
No. 124
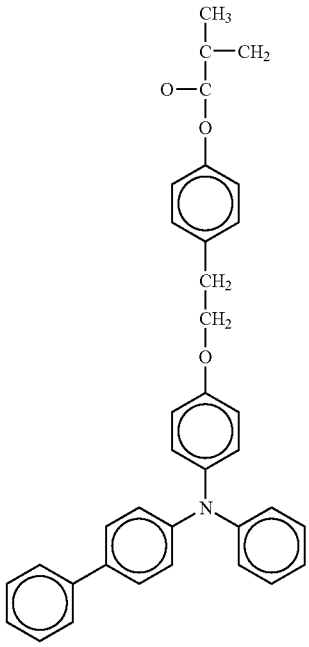

-continued
No. 125
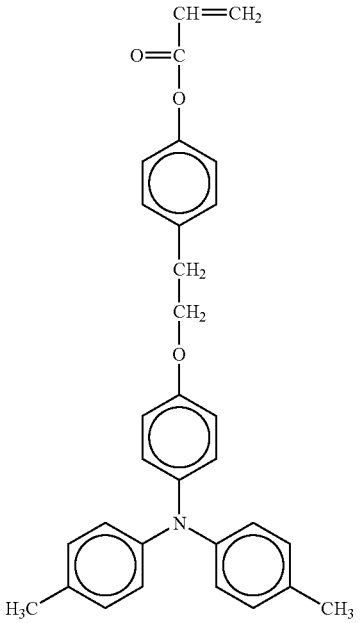
No. 126
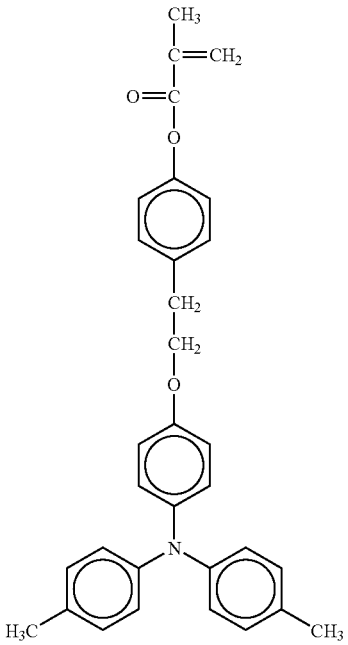
-continued
No. 127
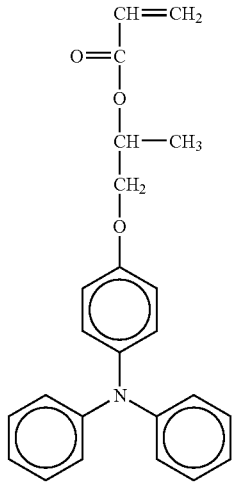
No. 128
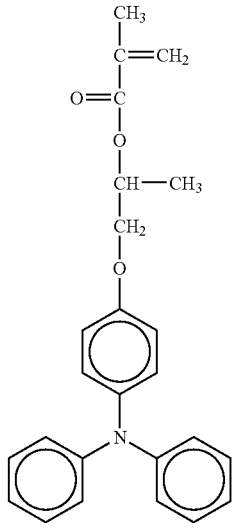

-continued
No. 129
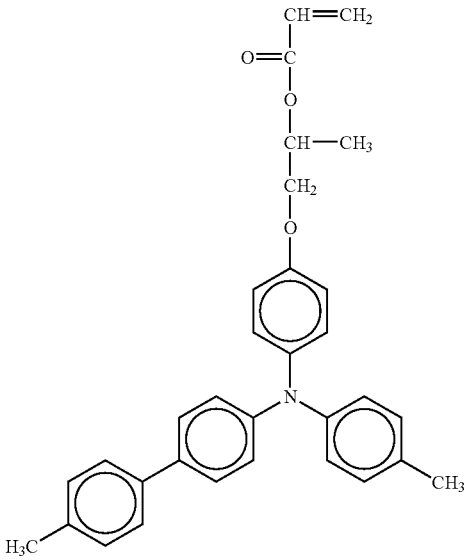
No. 130
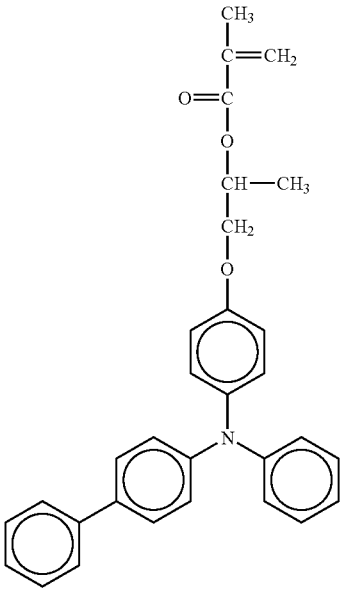
-continued
No. 131
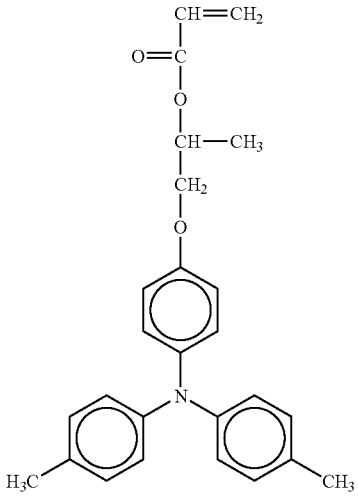
No. 132
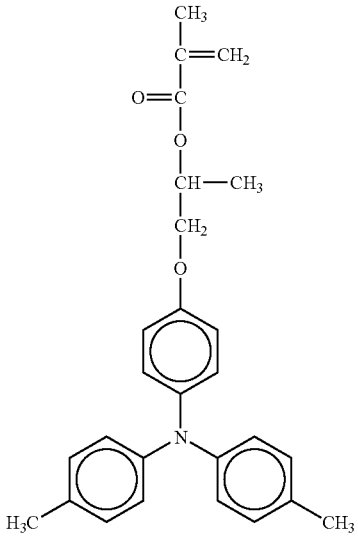

-continued
No. 133
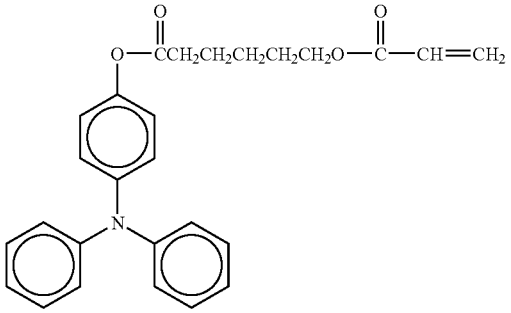
No. 134
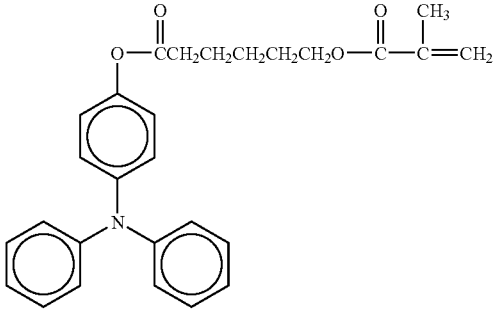
No. 135
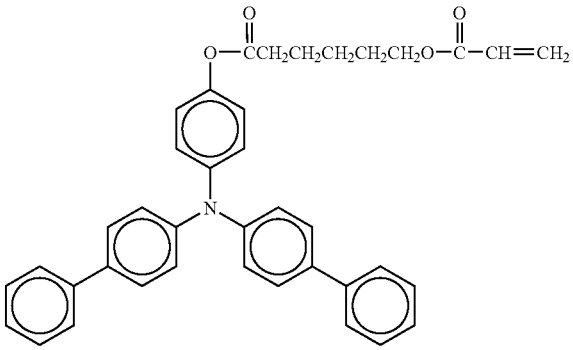
-continued
No. 136
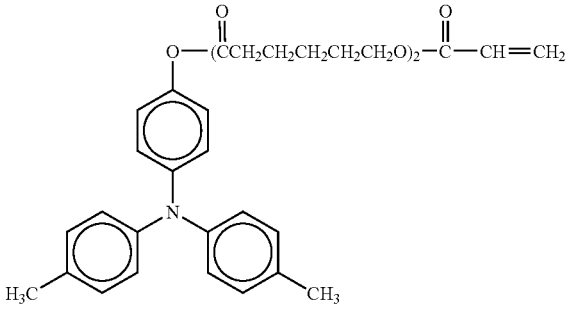
No. 137
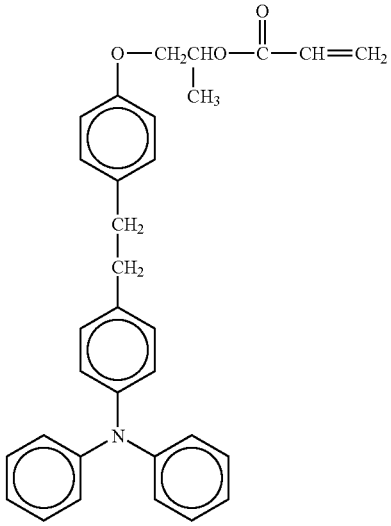
No. 138
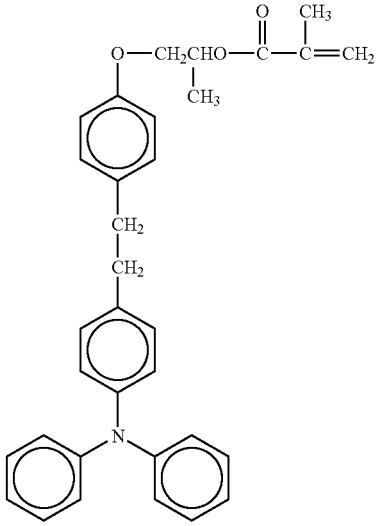

-continued
No. 139
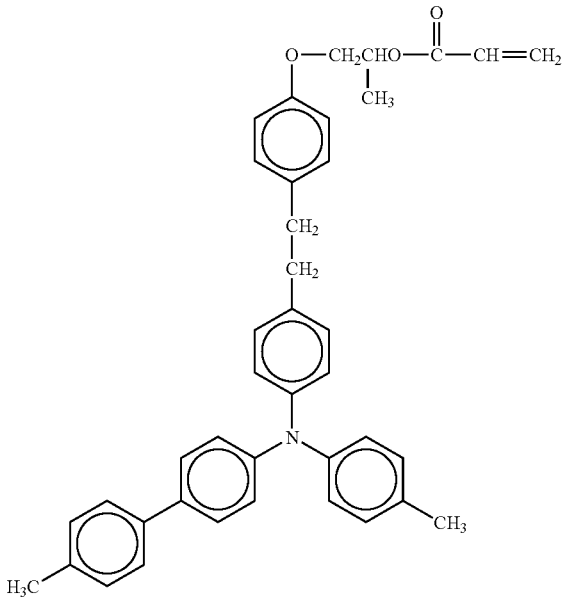
-continued
No. 141
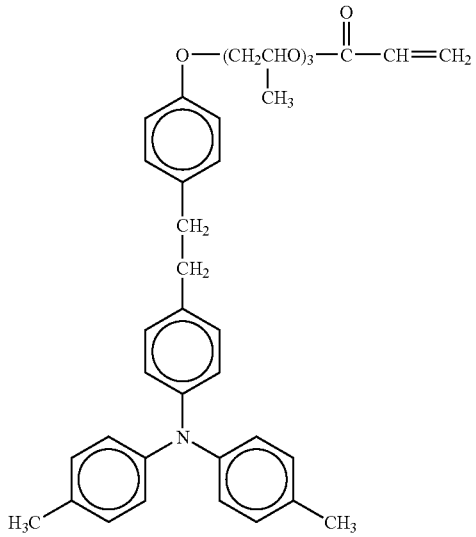
No. 140
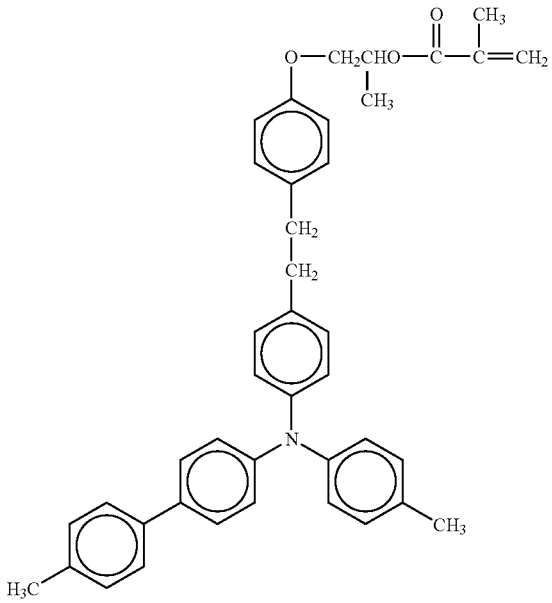
No. 142
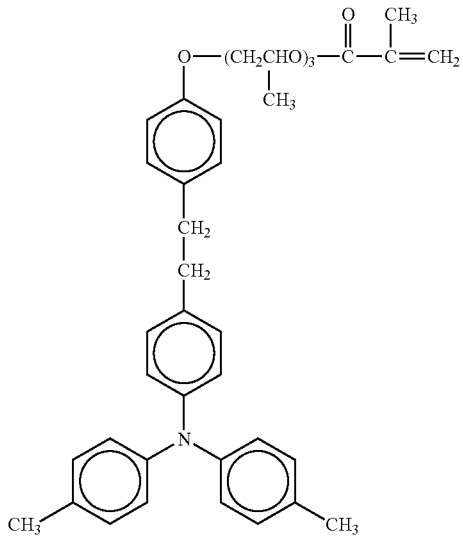

-continued
No. 143
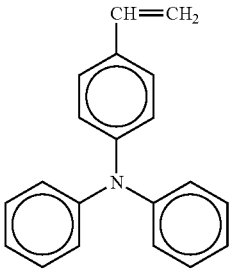
No. 144
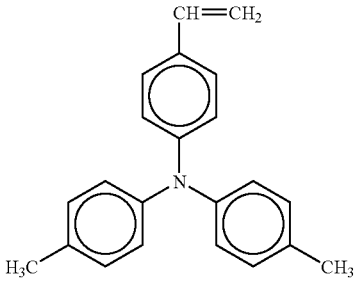
No. 145
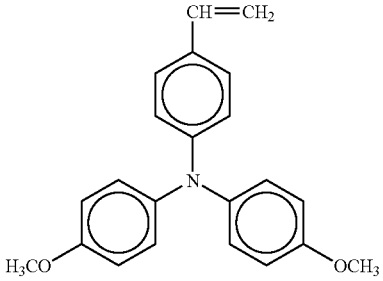
No. 146
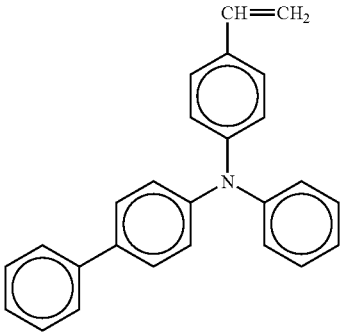
No. 147
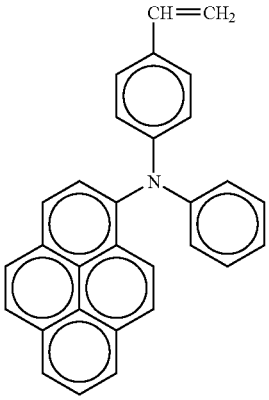
-continued
No. 148
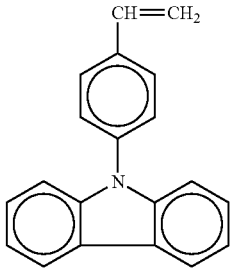
No. 149
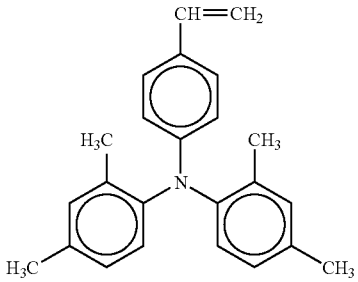
No. 150
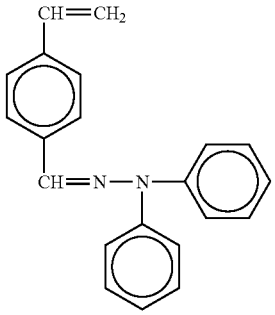
No. 151
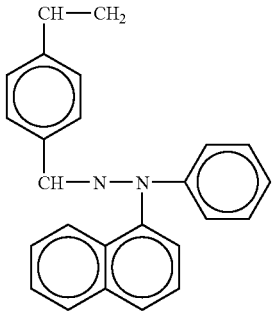
No. 152
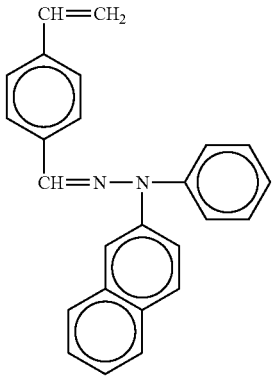

-continued

No. 153

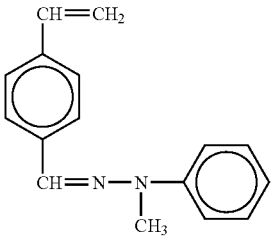

No. 154

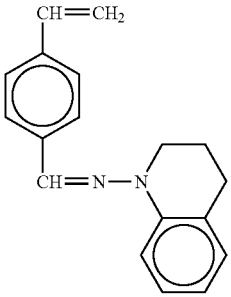

No. 155

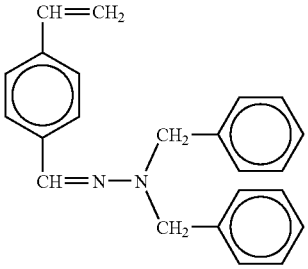

No. 156

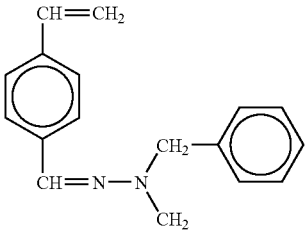

No. 157

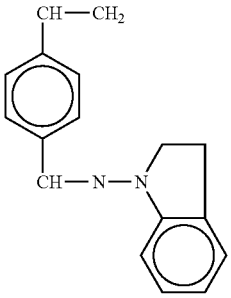

-continued

No. 158

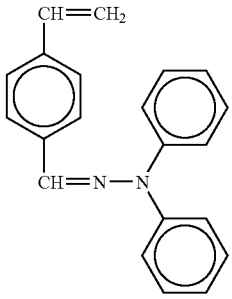

No. 159

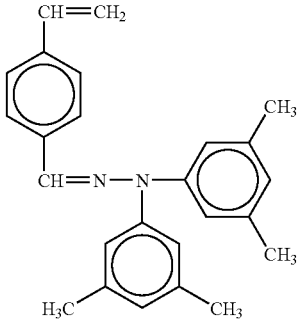

No. 160

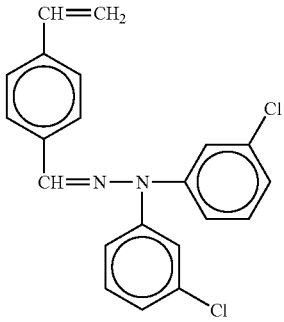

Also, the mono-functional radical polymerizable compound having a charge transporting structure used in the present invention is important, since it provides for the cross-linked surface layer with charge transporting ability. This ingredient is 20% to 80% by weight, preferably 30% to 70% by weight, based on the total amount of the cross-linked surface layer. If this ingredient is less than 20% by weight, the charge transporting ability of the cross-linked surface layer can not be sufficiently maintained, thereby causing deterioration of electrical properties such as reduction of sensitivity, increase of residual potential and the like owing to repeated use. If it exceeds 80% by weight, the content of tri-functional monomer without having a charge transporting structure is reduced, whereby the cross-linked density is reduced and high abrasion resistance cannot be attained. Though it is impossible to uniformly mention the added amount of this ingredient since the required electrical properties and abrasion resistance vary according to processes to be used, the amount is most preferably in the range of 30 to 70% by weight considering balance between two properties.

The surface layer according to the present invention is formed by curing at least a tri- or more-functional radical polymerizable monomer without having a charge transporting structure and a mono-functional radical polymerizable compound having a charge transporting structure. However, in order to control viscosity during coating, to relieve stress of the cross-linked surface layer, to lower the surface energy or to reduce friction coefficient, a mono-functional and bi-functional radical polymerizable monomer or radical polymerizable oligomer may be combinedly used. As the radical polymerizable monomer and the oligomer, known substances can be used.

Examples of the mono-functional radical monomer include 2-ethylhexyl acrylate, 2-hydroxyethyl acrylate, 2-hydroxypropyl acrylate, tetrahydrofurfuryl acrylate, 2-ethylhexylcarbitol acrylate, 3-methoxybutyl acrylate, benzyl acrylate, cyclohexyl acrylate, isoamyl acrylate, isobutyl acrylate, methoxytriethyleneglycol acrylate, phenoxytetraethyleneglycol acrylate, cetyl acrylate, isotearyl acrylate, stearyl acrylate, styrenemonomer and the like.

Examples of the bi-functional radical polymerizable monomer include 1,3-butanediol diacrylate, 1,4-butanediol diacrylate, 1,4-butanediol dimethacrylate, 1,6-hexanediol diacrylate, 1,6-hexanediol dimethacrylate, diethyleneglycol diacrylate, neopentylglycol diacrylate, EO-modified bisphenol A diacrylate, EO-modified bisphenol F diacrylate, neopentylglycoldiacrylate and the like.

Examples of the functional monomer include a fluorinated monomer such as octafluoropentylacrylate, 2-perfluorooctylethyl acrylate, 2-perfluorooctylethyl methacrylate, 2-perfluoroisononylethyl acrylate and the like, a vinyl monomer, acrylate and methacrylate having a polysiloxane group such as acryloylpolydimethylsiloxaneethyl, methacryloylpolydimethylsiloxaneethyl, acryloylpolydimethylsiloxanepropyl, acryloylpolydimethylsiloxanebutyl, diacryloylpolydimethylsiloxanediethyl and the like, which have 20 to 70 siloxane repeating units, as described in JP-B No. 5-60503, JP-B No. 6-45770.

The radical polymerizable oligomer include, for example, epoxy acrylate, urethane acrylate and polyester acrylate oligomers. However, when a large amount of a mono- and bi-functional radical polymerizable monomer or radical polymerizable oligomer is added, the 3-dimensional cross-linkage density of the cross-linked surface layer is substantially reduced, causing reduction of abrasion resistance. Therefore, the content of these monomers or oligomers is limited 50 parts by weight or less, preferably 30 parts by weight or less, relative to 100 parts by weight of the tri- or more-functional radical polymerizable monomer.

Also, the surface layer according to the present invention is formed by curing at least a tri- or more-functional radical polymerizable monomer without having a charge transporting structure and a mono-functional radical polymerizable compound having a charge transporting structure but may further comprise a polymerization initiator in the surface layer, as needed, to effectively perform the cross-linking reaction.

Examples of the thermal polymerization initiator include a peroxide type initiators such as 2,5-dimethylhexane-2,5-dihydroperoxide, diqumyl peroxide, benzoylperoxide, t-butylqumyl peroxide, 2,5-dimethyl-2,5-di(peroxybenzoyl)hexene-3, di-t-butylperoxide, t-butylhydroperoxide, qumene hydroperoxide, lauroyl peroxide and the like, and an azo type initiator such as azobisisobutylnitrile, azobiscyclohexanecarbonitrile, methyl azobisisobutyrate, azobisisobutylamidine hydrochloride, 4,4'-azobis-4-cyanovaleroic acid and the like.

Examples of the photopolymerization initiator include an acetophenone type initiator such as diethoxyacetophenone, 2,2-dimethoxy-1,2-diphenylethan-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl)butanone-1,2-hydroxy-2-methyl-1-phenylpropane-1-one, 2-methyl-2-morpholino(4-methylthiophenyl)propane-1-one, 1-phenyl-1,2-propanedione-2-(o-ethoxycarbonyl)oxime and the like or a ketal type photopolymerization initiator, a benzoinether type photopolymerization initiator such as benzoin, benzoinmethyl ether, benzoinethylether, benzoinisobutylether, benzoinisopropyl ether and the like, a benzophenone type photopolymerization initiator such as benzophenone, 4-hydroxybenzophenone, methyl o-benzoylbenzoate, 2-benzoylnaphthalene, 4-benzoylbiphenyl, 4-benzoylphenylether, acrylated benzophenone, 1,4-benzoylbenzene and the like, a thioxanthone type photopolymerization initiator such as 2-isopropylthioxanthone, 2-chlorothioxanthone, 2,4-dimethylthioxanthone, 2,4-diethylthioxanthone, 2,4-dichlorothioxanthone and the like, and other examples of the photopolymerization initiator include such as ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide, bis(2,4-dimethoxybenzoyl)-2,4,4-trimethylpentylphosphine oxide, methylphenylglyoxyester, 9,10-phenanthrene compounds, acridine compounds, triazine compounds, imidazole compounds and the like. Also, it is possible to use a compound capable of promoting photopolymerization alone or in combination with the photopolymerization initiator, which, for example, includes triethanolamine, methyldiethanolamine, ethyl 4-dimethylaminobenzoate, isoamyl 4-dimethylaminobenzoate, (2-dimethylamino)ethylbenzoate, 4,4'-dimethylaminobenzophenone and the like.

The foregoing polymerization initiators may be used as a mixture of one or more thereof. The content of the polymerization initiator is 0.5 to 40 parts by weight, preferably 1 to 20 parts by weight relative to 100 parts by weight of the total amount of the radical polymerizable component.

Also, the coating solution according to the present invention may contain various additives such as a plasticizer (for the purpose of relieving stress and improving adhesion), a leveling agent, a low molecular charge transporting material non-reactive with radical and the like, as needed. These additives may be any of those known to the art. The plasticizer which can be used in the present invention includes those commonly used in a resin, such as dibutylphthalate, dioctylphthalate and the like, and its added amount is limited to 20% by weight or less, preferably 10% by weight or less, relative to the total solid content of the coating solution. Also, the leveling agent which can be used in the present invention include silicone oils such as dimethyl silicone oil, methylphenyl silicone oil and the like, or polymers or oligomers having a perfluoroalkyl group in a side chain and its added amount is suitably 3% by weight or less, relative to the total solid content of the coating solution.

The cross-linked surface layer according to the present invention is formed by applying a coating solution comprising at least a tri- or more-functional radical polymerizable monomer without having a charge transporting structure and a mono-functional radical polymerizable compound having a charge transporting structure, followed by curing. When the radical polymerizable monomer is a liquid, the coating solution may be applied with another ingredient dissolved therein.

Also, it may be diluted in a solvent before application, as needed. Here, examples of the usable solvent include alcohols such as methanol, ethanol, propanol, butanol and the like, ketones such as acetone, methylethylketone, methyl isobutylketone, cyclohexanone and the like, esters such as ethyl acetate, butyl acetate and the like, ethers such as tetrahydrofuran, dioxane, propylether and the like, halogenated compounds such as dichloromethane, dichloroethane, tolly chloroethane, chlorobenzene and the like, aromatics such as benzene, toluene, xylene and the like, and cellosolves such as methylcellosolve, ethylcellosolve, cellosolve acetate and the like. These solvents may be used alone or as a mixture of two or more thereof. The dilution in the solvent varies according to solubility of the composition, coating process and desired membrane thickness and is not particularly limited. The coating is performed by dipping coating, spray coating, bead coating, ring coating and the like.

According to the present invention, after the coating solution is applied, curing is carried out by applying an external energy to form a cross-linked surface layer. Here, examples of the external energy which can be used include heat, light and radiation. The process for applying heat energy is carried out by heating from the coating surface side or substrate side using air, gas of for example nitrogen, vapor, or various heating media, far infrared rays, electronic wave. The heating temperature is preferably between 100° C. and 170° C. When it is less than 100° C., reaction rate is slow and not completely finished. When it is higher than 170° C., the reaction progresses nonuniformly, causing a large distortion in the cross-linked surface layer. In order to uniformly progress the curing, it is an effective way to complete the reaction by heating at a relatively low temperature of less than 100° C. and further heating at 100° C. or higher. The light energy which can be used includes UV irradiating source such as a high pressure mercury lamp and metal halide lamp having a light emitting wavelength mainly in the UV region. Also, it is possible to select a visible light source in accordance with the absorption wave length of the radical polymerizable components or photopolymerization initiators. The irradiation amount is preferably from 50 mW/cm$^2$ to, 1000 mW/cm$^2$. If it is less than 50 mW/cm$^2$, the curing takes much time. If it is stronger than 1000 mW/cm$^2$, the reaction nonuniformly progresses, whereby the roughness of the cross-linked surface layer becomes severe. The irradiation energy includes those using electronic rays. Among the foregoing energies, owing to easiness of controlling the reaction rate and convenience of the apparatus, heat and light energy may be effectively used.

The thickness of the cross-linked surface layer varies according to the layer structure of the photoconductor containing the cross-linked surface layer and therefore is described in the following sections with respect to the layer structure.

Also, according to the present invention, the cross-linked surface layer has a surface roughness Rz of 1.3 μm or less, preferably 1.0 μm or less.

The surface roughness Rz of the cross-linked surface layer is a ten point average roughness measured according to JIS B 0601-1994 standard and is measured using SURFCOM1400D (TOKYO SEIMITSU CO., LTD) in the present invention. However, any apparatus having equivalent performances may be used.

As described above, it was discovered that if the cross-linked surface layer has a surface roughness Rz exceeding 1.3 μm, contamination of the ground surface due to cleaning failure, striped image deletion in a high humidity circumstance and character thickening tend to occur. The surface roughness of the cross-linked surface layer according to the present invention is related with various conditions and affected by (1) the composition contained in the coating solution for the cross-linked surface layer, and its compositional ratio, (2) the dilution solvent of the coating solution and the solid content, (3) the coating process, (4) the curing means and conditions, (5) the solubility of the sub-layers, though the direction to make the surface roughness Rz 1.3 μm or less is not the same. The detailed description is as follows.

In the composition contained in the coating solution, a bi- or more-functional radical polymerizable compound having a charge transporting structure and binder resin may be added as long as they damage the smoothness of the surface of the photoconductor, electrical properties or durability. However, since the addition of the bi- or more-functional radical polymerizable compound having charge transporting structure causes increase in the volume of the charge transporting structure, which leads generation of internal stress upon curing, whereby causing unevenness of the surface. Also, the addition of a high molecular material such as the binder resin to the coating solution may cause phase separation due the poor compatibility of the radical polymerizable composition (a radical polymerizable monomer and a radical polymerizable compound having a charge transporting structure) with a high molecular (polymer) product produced by the curing reaction and thereby, severe unevenness of the surface of the cross-linked layer. Therefore, it is preferably not to use a bi- or more-functional radical polymerizable compound having a charge transporting structure or binder resin.

When, as the dilution solvent of the coating solution, a solvent to dissolve the sublayer is used in a large amount, the composition of the sublayer resin binder or a low molecular charge transporting material may be introduced to the outermost surface layer, interfering with the curing reaction and further making the circumstance when a non-curable material is previously contained in the coating solution in a large amount, which is one of the reason of disturbance on the cross-linked surface. On the contrary, when a solvent which does not dissolve the sublayer at all is used, the adhesion between the cross-linked surface layer and the sublayer is lowered and a crater type eye hole is formed on the cross-linked surface layer due to the volume contraction upon curing, causing severe unevenness of the surface. In order to solve the foregoing problems, a solvent mixture is used to control the solubility of the sublayer. For example, it is possible to reduce the amount of the solvent contained in the outer surface coating layer by the coating composition or the coating process, to inhibit the introduction of the sublayer components by using a high molecular charge transporting material in the sublayer and by providing a hardly soluble middle layer or a adhesive middle layer between the sublayer and the cross-linked surface layer.

In the cross-linked surface layer according to the present invention, it is necessary to use a charge transporting structure with a big size to maintain electrical properties and to increase the cross-linkage density to increase the strength. In the curing after coating of the surface layer, when an excessively high energy is applied from the outside to rapidly perform the reaction, the curing nonuniformly progresses, causing unevenness of the cross-linked surface layer. Therefore, it is preferable to use an external energy such as heat and light which can control the reaction rate by the heating conditions, the light irradiation intensity and the amount of a polymerization initiator.

In order to provide the surface roughness Rz of 1.3 μm or less in the formation of the cross-linked surface layer, for example, an acrylate monomer having 3 acryloyloxy groups and a triarylamine compound having one acryloyloxy group are used in the coating solution, wherein the ratio of these component is 7:3 to 3:7, a polymerization initiator is added in an amount of 3 to 20% by weight relative to the total amount of the acrylate compound and a solvent is added to prepare a coating solution. For example, in the charge transporting layer as the sublayer of the cross-linked surface layer, a triarylamine doner is used as charge transporting material and a polycarbonate is used as binder resin. The surface layer is formed by spray coating. Here, as the solvent of the coating solution, tetrahydrofuran, 2-butanone or ethyl acetate is preferred and its added amount is 3 times to 10 times relative to the total amount of the acrylate compound.

Subsequently, on the photoconductor comprising an undercoating layer, a charge generating layer and the charge transport layer are sequentially laminated on a substrate of, for example, aluminum cylinder, the prepared coating solution is applied. Then, it is dried in a short period of time at a relatively low temperature (25 to 80° C., 1 to 10 minutes), followed by UV irradiation or heating, to cure the coating layer.

For UV irradiation, a metal halide lamp is used, preferably under conditions including an intensity of 50 mW/cm$^2$ or more and 1000 mW/cm$^2$ or less. For example, using UV light at 500 mW/cm$^2$, the entire surface of a drum to be is irradiated for 20 seconds while rotating the drum. Here, the temperature of the drum should not exceed 50° C.

In case of heat curing, the heating temperature is preferably 100 to 170° C. For example, when the heating temperature is set to 150° C. using a force air oven as a heating means, the heating time is 20 minutes to 3 hours.

After curing, it is heated for further 10 minutes to 30 minutes at 100 to 150° C. to decrease the residual solvent and thus, the photoconductor is formed.

Now, the structure of the present invention will be explained.

<Layer Structure of Electrophotographic Photoconductor>

The electrophotographic photoconductor used in the present invention is explained with reference to the drawings.

Figure 1B:
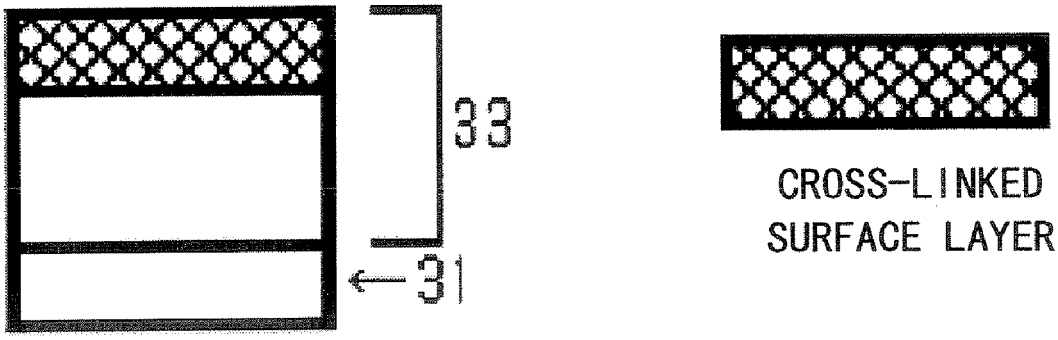

FIGS. 1A and 1B each show a cross-section of the electrophotographic photoconductor according to the present invention, which has a single-layered structure comprising a photoconductive layer 33 having both charge generating ability and charge transporting ability on a conductive substrate 31. FIG. 1A shows the case when the cross-linked surface layer is the whole of the photoconductive layer and FIG. 1B shows the case when the cross-linked surface layer is a surface part of the photoconductive layer.

Figure 2A:
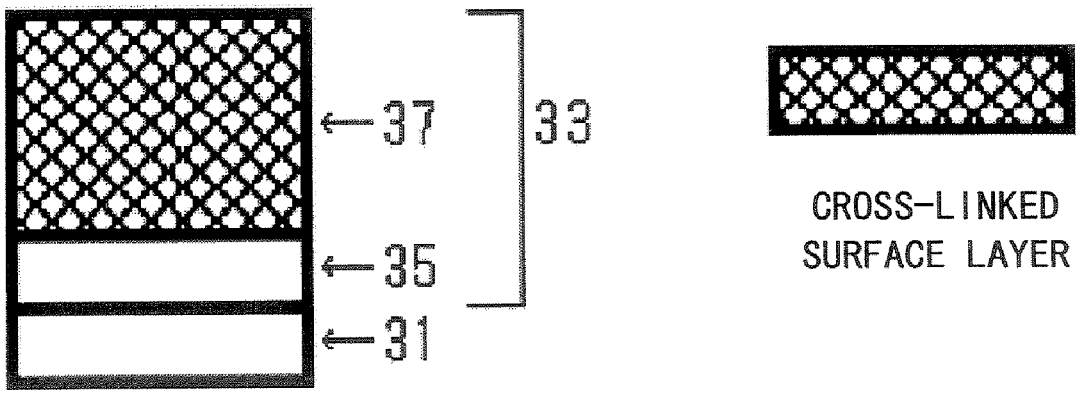
FIGS. 2A and 2B are each a cross-section of another example of the electrophotographic photoconductor according to the present invention.
Figure 2B:
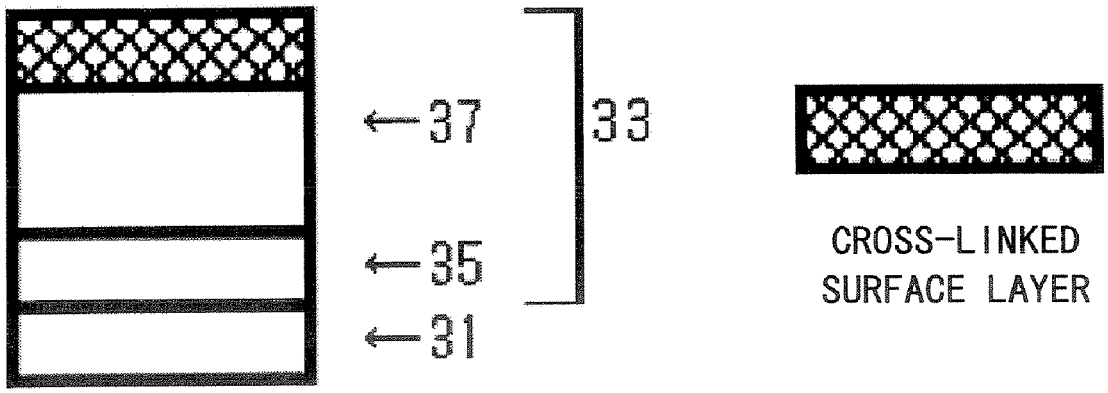

FIGS. 2A and 2B each show a photoconductor having a laminated structure comprising a charge generating layer 35 having charge generating ability and a charge transporting layer 37 having charge transporting ability on a conductive substrate 31. FIG. 2A shows the case when the cross-linked surface layer is the whole of the charge transporting layer and the FIG. 2B shows the case when the cross-linked surface layer is a part of the charge transporting layer.

<Conductive Substrate>

The conductive substrate 31 may be a film-shaped or cylindrically-shaped plastic or paper covered with a conducting material having a volume resistivity of $10^{10}$ Ω·cm, e.g., a metal such as aluminum, nickel, chromium, nichrome, copper, gold, silver or platinum, or a metal oxide such as tin oxide or indium oxide, by vapor deposition or sputtering, or it may be a plate of aluminum, aluminum alloy, nickel or stainless steel, and this may be formed into a tube by extrusion or drawing, cut, polished and surface-treated. The endless nickel belt and endless stainless steel belt disclosed in JP-A No. 52-36016 can also be used as the conductive substrate 31.

In addition, a conductive powder may also be dispersed in the binder resin and coated on the substrate, and used as the conductive substrate 31 of the present invention.

Examples of this conductive powder are carbon black and acetylene black, metal powders such as aluminum, nickel, iron, nichrome, copper, zinc and silver, conductive tin oxide and ITO or the like. The binder resin used together may also comprise a thermoplastic resin, thermosetting resin or photosetting resin such as polystyrene, styrene-acrylonitrile copolymer, styrene-butadiene copolymer, styrene-maleic anhydride copolymer, polyester, polyvinyl chloride, vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin or alkyd resin. Such a conductive layer can be provided by dispersing and applying these conductive powders and binder resin in a suitable solvent, for example, tetrahydrofuran, dichloromethane, methyl ethyl ketone or toluene.

A construction apparatus wherein a conductive layer is provided on a suitable cylindrical substrate by a heat-shrinkable tubing containing these conductive powders in a material such as polyvinyl chloride, polypropylene, polyester, polystyrene, polyvinylidene chloride, polyethylene, chlorinated rubber or polytetrafluoroethylene fluoro-resin, can also be used as the conductive substrate 31 of the present invention.

<Photoconductive Layer>

Next, the photoconductive layer is explained. The photoconductive layer may be a laminated structure or a single-layered structure.

When it is a laminated structure, the photoconductive layer comprises a charge generating layer having a charge generating ability and a charge transporting layer having a charge transporting ability. When it is a single-layered structure, the photoconductive layer is a layer having both charge generating ability and charge transporting ability.

Now, the photoconductive layer of the laminated structure and the photoconductive layer of the single-layered structure are explained, respectively.

<Photoconductive Layer Comprising a Charge Generating Layer and a Charge Transporting Layer>

(Charge Generating Layer)

The charge generating layer 35 is a layer comprising mainly a charge generating material having charge generating ability and may be used in combination with a binder resin, as needed. Usable charge generating material includes an inorganic material and an organic material.

Examples of inorganic materials are crystalline selenium, amorphous selenium, selenium-tellurium, selenium-tellurium-halogen, selenium-arsenic compound and amorphous silicon. The amorphous silicon may have dangling bonds terminated with hydrogen atoms or halogen atoms, or it may be doped with boron atoms or phosphorus atoms.

The organic material can be any of the known materials. It includes, for example, phthalocyanine pigments such as metal phthalocyanine, non-metal phthalocyanine and the like, azulenium salt pigments, squaric acid methine pigment, azo pigments having a carbazole skeleton, azo pigments having a triphenylamine skeleton, azo pigments having a diphenylamine skeleton, dibenzothiophene skeleton, azo pigments having a fluorenone skeleton, azo pigments having a oxadiazole skeleton, azo pigments having a bisstylbene skeleton, azo pigments having a distyryoxide azole skeleton, azo pigments having a distyrylcarbazole skeleton, pherylene pigments, anthraquinone or polycyclic quinone pigments, quinone imine pigments, diphenylmethane and triphenylmethane pigments, benzoquinone and haphtoquinone pigments, cyanine and azomethine pigments, indigoido pigments, bisbenzimidazole pigments and the like. These charge generating materials can be used alone or as a mixture of two or more thereof.

The binder resins which can be used in the charge generating layer 35, as needed, include a polyamide, polyurethane, epoxy resin, polyketone, polycarbonate, silicone resin, acrylic resin, polyvinyl butyral, polyvinyl formal, polyvinyl ketone, polystyrene, poly-N-vinyl carbazole and polyacrylamide. These binder resins can be used alone, or two or more may be used in admixture. Also, in addition to the binder resin of the charge generating layer, as described above, it includes a high molecular (polymer) charge transporting material having charge transporting ability, for example, a polycarbonate, a polyester, a polyurethane, a polyether, a polysiloxane, an acrylic resin and the like, which have a arylamine skeleton, a benzidine skeleton, a hydrazone skeleton, a carbazole skeleton, a stylbene skeleton, a pyrazoline skeleton and the like or a high molecular material having a polysilane skeleton.

Concrete examples of the former are a high molecular charge transport material described in JP-A No. 01-001728, JP-A No. 01-009964, JP-A No. 01-013061, JP-A No. 01-019049, JP-A No. 01-241559, JP-A No. 04-011627, JP-A No. 04-175337, JP-A No. 04-183719, JP-A No. 04-225014, JP-A No. 04-230767, JP-A No. 04-320420, JP-A No. 05-232727, JP-A No. 05-310904, JP-A No. 06-234836, JP-A No. 06-234837, JP-A No. 06-234838, JP-A No. 06-234839, JP-A No. 06-234840, JP-A No. 06-234841, JP-A No. 06-239049, JP-A No. 06-236050, JP-A No. 06-236051, JP-A No. 06-295077, JP-A No. 07-056374, JP-A No. 08-176293, JP-A No. 08-208820, JP-A No. 08-211640, JP-A No. 08-253568, JP-A No. 08-269183, JP-A No. 09-062019, JP-A No. 09-043883, JP-A No. 09-71642, JP-A No. 09-87376, JP-A No. 09-104746, JP-A No. 09-110974, JP-A No. 09-110976, JP-A No. 09-157378, JP-A No. 09-221544, JP-A No. 09-227669, JP-A No. 09-235367, JP-A No. 09-241369, JP-A No. 09-268226, JP-A No. 09-272735, JP-A No. 09-302084, JP-A No. 09-302085, JP-A No. 09-328539 and the like.

Also, the concrete examples of the latter are polysilylene polymers illustrated in, for example, JP-A No. 63-285552, JP-A No. 05-19497, JP-A No. 05-70595 and JP-A No. 10-73944.

Also, the charge generating layer 35 may further contain a low molecular charge transporting material.

The low molecular charge transporting material which can be combined in the charge generating layer 35 includes a hole transporting material and an electron transporting material.

Examples of the electron transporting material are electron acceptors such as chloranyl, bromanyl, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide and diphenoquinone derivatives. These charge transporting materials can be used alone, or two or more may be used in admixture.

The hole transporting material may be any of the electron donor materials represented below which may be used without problem. Examples of the hole transporting material are oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triaryl methane derivatives, 9-stylanthracene derivatives, pyrazoline derivatives, divinylbenzene derivatives, hydrazone derivatives, indene derivatives, butadiene derivatives and pyrene derivatives, and other known materials may be used. These hole transporting materials can be used alone, or two or more can be used in admixture.

Broadly speaking, the charge generating layer 35 may be formed by vacuum thin film manufacturing processes or by the process of casting from a solution dispersion.

The former process includes the vacuum deposition process, glow discharge electrolysis, ion plating process, sputtering process, reactive-sputtering process and CVD process, which form a satisfactory inorganic material or organic material.

To provide the charge generating layer by the casting process, an inorganic or organic charge-generating material is dispersed, together with a binder resin if necessary, by a ball mill, attriter, sand mill or bead mill using an organic solvent such as tetrahydrofuran, dioxane, dioxolane, toluene, dichloromethane, monochlorobenzene, dichloroethane, cyclohexanone, cyclopentanone, anisole, xylene, methyl ethyl ketone, acetone, ethyl acetate or butyl acetate, moderately diluting the dispersion liquid, and applying it. Also, as needed, a leveling agent such as dimethyl silicone oil, methylphenyl silicone oil and the like may be added. Its application is carried out by dip coating, spray coating, bead coating, ring coating and the like.

The thickness of the charge generating layer provided as mentioned above may conveniently be approximately 0.01 to 5 μm, but is preferably 0.05 to 2 μm.

(Charge Transporting Layer)

The charge transport layer 37 is a layer having the charge transporting ability. The cross-linked surface layer having a charge transporting structure according to the present invention can be usefully used as the charge transport layer. When cross-linked surface layer is the whole charge transport layer 37, as described in the process for preparing the cross-linked surface layer, a coating solution containing the radical polymerizable composition according to the present invention (this includes a tri- or more-functional radical polymerizable monomer without having a charge transporting structure and a mono-functional radical polymerizable compound having a charge transporting structure; hereinafter the same) is applied on the charge generating layer 35, followed by drying, as needed and cured by an external energy to form a cross-linked surface layer. Here, the cross-linked surface layer has a thickness of 10 to 30 μm, preferably 10 to 25 μm. If it is thinner than 10 μm, it is impossible to maintain a sufficient charge potential. If it is thicker than 30 μm, separation of undercoating layer may occur owing to volume contraction upon curing.

Also, when the charge transport layer 37 has a laminated structure comprising the cross-linked surface layer formed on the surface of the charge transport layer 37, the sublayer part of the charge transport layer is formed by dissolving or dispersing a charge transport material having charge transporting ability and a binder resin in a proper solvent and applying the resulting solution or dispersion on the charge generating layer 35, followed by drying. Subsequently, a coating solution containing the radical polymerizable composition according to the present invention is applied and cross-linked cured by an external energy.

As the charge transport material, an electron transporting material, a hole transporting material and a high molecular charge transport material described for the charge generating layer 35 may be used. As described above, the high molecular charge transport material is particularly useful, since it can reduce the solubility of the sublayer upon coating of the surface layer.

Examples of the binder resin are thermoplastic or thermosetting resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin and alkyd resin.

The amount of charge transport material is 20-300 parts by weight, but preferably 40-150 parts by weight to 100 parts by weight of the binder resin. However, when a high molecular charge transporting material is used, it can be used alone or in combination with a binder resin.

The solvent which can be used in the coating of a sublayer part of the charge transport layer may be the same as for the charge generating layer and suitably those which can well dissolve the charge transporting material and a binder resin. The solvents may be used alone or as a mixture of two or more thereof. Also, the formation of the sublayer part of the charge transport layer may use the same coating process as for the charge generating layer 35.

A plasticizer or leveling agent may also be added if necessary.

The plasticizer which can be used together in the sublayer part of the charge transport layer may be any common resin plasticizer such as dibutyl phthalate and dioctyl phthalate which can be used without modification, the usage amount being approximately 0 to 30 parts by weight relative to 100 parts by weight of binder resin.

Examples of leveling agents which can be used together in the sublayer part of the charge transport layer are silicone oils such as dimethyl silicone oil and methylphenyl oil, or polymers and oligomers having a perfluoralkyl group in the side chain. They may be used in a proportion of approximately 0 to 1 parts by weight relative to 100 parts by weight of binder resin.

The sublayer part of the charge transport layer properly has a thickness of 5 to 40 μm, preferably 10 to 30 μm.

When the cross-linked surface layer is formed on the surface of the charge transport layer 37, the cross-linked surface layer has a thickness of 1 μm or more and 10 μm or less, more preferably, 2 μm or more and 8 μm or less so that the produced photoconductor has high abrasion resistance and scratch resistance and excellent electrical properties without crack and layer separation. Also, in case when the cross-linked surface layer is insoluble in an organic solvent, more excellent properties can be obtained, whereby it is possible to produce a photoconductor with a long life span.

As reasons for the foregoing effects, the following factors are related.

An electrophotographic photoconductor is used in a circumstance where a series of steps by charging means, development means, transferring means, cleaning means and discharge means are repeated, wherein the photoconductor can be abraded or get scratched, leading deterioration of a produced image and consuming of its life span. Factors causing abrasion and scratch include (1) decomposition on the surface of the photoconductor by charging and discharging and chemical deterioration by oxidizing gases, (2) attachment of a carrier upon development, (3) friction with paper during transferring, (4) friction with a cleaning brush a cleaning blade during cleaning and the toner or carrier attached thereto and the like. In order to design a photoconductor strong against such hazard, it is important for the surface layer to have high and uniform hardness and elasticity. Also, in terms of the membrane structure, the surface layer preferably has a dense and homogeneous 3-dimensional mesh structure. The cross-linked charge transport layer forming the surface layer according to the present invention has a cross-linked structure obtained by curing tri- or more-functional radical polymerizable monomer and thereby, 3-dimensional mesh structure. Consequently, it is possible to obtain a surface layer with a high hardness and a high elasticity, satisfying excellent abrasion resistance and scratch resistance. Like this, though it is important to increase the density of cross-linkage, that is, the number of cross-linkage per unit volume, on the surface of the photoconductor, it may cause internal stress by volume contraction since a large number of bondings are formed in a moment during the curing. Such internal stress increases as the thickness of the cross-linked layer increases. Therefore, upon curing of the entire charge transport layer, crack or membrane separation may occur. Though this phenomenon may not initially occur, it may occur over the time, as the photoconductive boy is repeatedly used in an electrophotographic process and affected by the hazard and thermal fluctuation by charging, development, transferring and cleaning. The process to solve this problem includes (1) to introduce a high molecular ingredient to the cross-linked layer and cross-linked structure, (2) to use a large amount of mono-functional and bi-functional radical polymerizable monomer and (3) to use a multi-functional monomer having a flexible group to soften the cured resin layer. However, all of these processes lead to reduction of the cross-linkage density of the cross-linked layer, and therefore it is impossible to attain progressively improved abrasion resistance. On the other hand, the photoconductor according to the present invention is provided with a cross-linked surface layer having a high cross-linkage density with a 3-dimensional mesh structure on the charge transport layer in a thickness of 1 μm or more and 10 μm or less. As a result, it is possible to prevent crack or membrane separation and provide high abrasion resistance. By providing a cross-linked surface layer having a thickness of 2 μm or more and 8 μm or less, it is possible to increase allowance against the foregoing problem and to select materials for the formation of the cross-linkage leading improvement of abrasion resistance. The reasons the photoconductor can inhibit crack or membrane separation is because the cross-linked surface layer can be formed in a thin layer, thereby reducing internal stress, and has the charge transport layer in the sublayer which can relieve the internal stress of the cross-linked surface layer on the surface. Thus, there is no need for the cross-linked surface layer to contain a high molecular material in a large amount, whereby scratch or toner pilling which may caused by incompatibility with a cured body formed by the reaction of the high molecular material and a radical polymerizable composition (radical polymerizable monomer or radical polymerizable compound having a charge transporting structure) seldom occurs. Also, when the thick layer provided over the entire charge transport layer is cured by light irradiation, light transmission to the inside may be restricted by the adsorption of the charge transporting structure and consequently, the curing may not be sufficiently carried out. In the cross-linked surface layer according to the present invention, the curing is uniformly carried out from the thin layer of 10 μm or less to the inside, whereby the inside can maintain high abrasion resistance like the surface. Also, in the formation of the outermost surface layer according to the present invention, in addition to the 3- or more-functional radical polymerizable monomer, a mono-functional radical polymerizable compound having a charge transporting structure is further contained, which is inserted in the cross-linkage upon curing of the 3- or more-functional radical polymerizable monomer. On the other hand, when a low molecular charge transporting material without functional groups is contained in the cross-linked surface layer, since its compatibility is low, crystallization of the low molecular charge transporting material or clouding may occur, causing deterioration in mechanical strength of the cross-linked surface layer. Meanwhile, when a bi- or more-functional charge transport compound is used as a main component, it can be fixed in the cross-linked structure by a plurality of bondings to increase the cross-linkage density. However, since the volume of the charge transporting structure is increased, the cured resin structure shows significant distortion, which contributes to increase of the internal stress in the cross-linked surface layer.

Also, according to the photoconductor of the present invention, it is possible to apply a design having a high mobility with a few charge trap of the conventional photoconductor as the charge transport layer in the sublayer and thereby, to minimize the electrical side effects of the cross-linked charge transport layer.

Further, the cross-linked surface layer which is insoluble in an organic solvent according to the present invention has greatly improved abrasion resistance. The cross-linked surface layer according to the present invention is formed by curing a tri- or more-functional radical polymerizable monomer without having a charge transporting structure and a mono-functional radical polymerizable compound having a charge transporting structure and thereby, has a 3-dimensional mesh structure all over the layer. If a component other than the above-described component (for example, an additive such as a 1 or 2-functional monomer, a polymer binder, an antioxidant, a leveling agent, a plasticizer and the like, and a component extracted from the sublayer) is added or curing conditions are different, the cross-linkage density is locally reduced or aggregates of cured bodies at a high cross-linkage density may be formed. This cross-linked surface layer has a weak bonding power between cured bodies, is soluble in an organic solvent and will cause local abrasion and separation of fine cured body units as it is repeatedly used in the electrophotographic process. According to the present invention, by making the cross-linked surface layer insoluble in an organic solvent, it is possible to provide an improved 3-dimensional structure to increase the cross-linkage and further to provided considerably improved abrasion resistance since the chain reaction is carried out over a large area, whereby the cured body has a high molecular weight.

<Single-layered Photoconductive Layer>

The photoconductive layer having a single-layered structure is a layer having both charge generating function and charge transport function and the cross-linked surface layer containing the charge transporting structure according to the present invention can be usefully used as a photoconductive layer having a single-layered structure by containing a charge generating material showing charge generating function. As described in the casting process of the charge generating layer, a charge generating material is dispersed in a coating solution containing a radical polymerizable composition, applied on a charge generating layer 35, followed by drying, as needed, and subjected to the curing reaction by an external energy to form a cross-linked surface layer. Also, the charge generating material which has previously dispersed in a solvent may be added to the coating solution for the cross-linked surface layer. Here, the cross-linked surface layer has a thickness of 10 to 30 μm, preferably 10 to 25 μm. If it is less than 10 μm, it is impossible to maintain a sufficient charge potential while if it exceeds 30 μm, generation of conductive gases or separation of undercoating layer may occur owing to volume contraction upon curing.

Also, when the cross-linked surface layer is a surface part having a single-layered structure of the photoconductive layer, the sublayer of the photoconductive layer is formed by dissolving or dispersing a charge generating material having charge generating ability, a charge transporting material having charge transferring ability and a binder resin in a proper solvent and applying it, followed by drying. Also, a plasticizer, a leveling agent and the like may be added, as needed. The dispersion process of the charge generating material, the charge generating material, the charge transporting material, the plasticizer, the leveling agent may be the same as described for the charge generating layer 35 and the charge transport layer 37. As the binder resin, in addition to the binder resins described for the charge transport layer 37, the binder resins described for the charge generating layer 35 may be used in combination. Also, the above-described high molecular charge transport material may be used, which is useful in that they can reduce the introduction of the composition of the lower photoconductive layer composition to the cross-linked surface layer. The sublayer of the photoconductive layer has a thickness of 5 to 30 μm, preferably 10 to 25 μm.

When the surface part of the photoconductive layer is the cross-linked surface layer having a single-layered structure, the cross-linked surface layer is formed applying a coating solution containing the radical polymerizable composition and a charge generating material on the sublayer part of the photoconductive layer, followed by drying, as needed and curing the coating by an external energy such as heat or light, as described above. Here, the cross-linked surface layer has a thickness of, 1 to 20 μm, preferably 2 to 10 μm. If it is thinner than 1 μm, the durability may vary owing to the deviation of the thickness.

The charge generating material contained in the photoconductive layer having a single-layered structure is preferably 1 to 30% by weight relative to the total amount of the photoconductive layer and the binder resin contained in the photoconductive layer is 20 to 80% by weight, and the charge transport material is 10 to 70 parts by weight.

<Middle Layer>

In the photoconductor according to the present invention, when the cross-linked surface layer is the surface part of the photoconductive layer, a middle layer may be provided to inhibit introduction of the sublayer component to the cross-linked surface layer or improve the adhesion with the sublayer. The middle layer prevents curing destruction and unevenness of the cross-linked surface layer caused by introduction of the sublayer photoconductive layer composition in the outermost surface layer containing the radical polymerizable composition. Also, it can improve the adhesion between the lower photoconductive layer and the surface cross-linked layer.

Generally, a binder resin is used as the principal component of the middle layer. Examples of these resins are polyamide, alcohol-soluble nylon, water-soluble polyvinyl butyral, polyvinyl butyral and polyvinyl alcohol. To form the middle layer, the usual coating processes can be used as described above. The thickness of the middle layer may be approximately 0.05 to 2 μm.

<Base Layer>

In the photoconductor of the present invention, a base layer can be provided between the conductive substrate 31 and the photosensitive layer. Although the base layer generally uses a resin as principal component, considering that a photosensitive layer will be applied onto it with a solvent, it is preferred that it is a resin with high solvent resistance rather than a common organic solvent. Examples of such resins are water-soluble resins such as polyvinyl alcohol, casein, sodium polyacrylate, alcohol-soluble resins such as copolymer nylon and methoxymethylated nylon, and curing resins which form a three-dimensional network such as polyurethane, melamine resin, phenol resin, alkyde-melamine resin and epoxy resin. Also, metal oxide fine powder pigments such as titanium oxide, silica, alumina, zirconium oxide, tin oxide or indium oxide may also be added to the base layer to prevent Moire patterns, and to reduce residual potential.

These base layers can be formed using a suitable solvent and coating process as for the above-mentioned photosensitive layer. A silane coupling agent, titanium coupling agent or chromium coupling agent, etc. can be used as the base layer of the present invention. $Al_2O_3$ prepared by anodic oxidation, organic materials such as polyparaxylylene (parylene) and inorganic materials such as $SiO_2$, $SnO_2$, $TiO_2$, ITO, $CeO_2$ prepared by the vacuum thin film-forming process, can be used for the base layer of the present invention. Other materials known in the art may also be used. The film thickness of the base layer is in the range of 0 to 5 μm.

<Addition of Antioxidant to Respective Layers>

Also, according to the present invention, an antioxidant may be added to the surface cross-linked layer, the photoconductive layer, the charge generating layer, the charge transport layer, the base layer and the middle layer to improve environmental resistance and particularly, to prevent reduction of sensitivity and increase of residual potential.

Examples of the antioxidant which can be used in the present invention are as follows.

(Phenol Compounds)

2,6-di-t-butyl-p-cresol, butylated hydroxyanisole, 26-di-t-butyl-4-ethylphenol, stearyl β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidene bis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl) butylic acid] crecol ester, and tocopherols.

(Paraphenylenediamines)

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine.

(Hydroquinones)

2,5-di-t-octyl hydroquinone, 2,6-didodecyl hydroquinone, 2-dodecyl hydroquinone, 2-dodecyl-5-chloro hydroquinone, 2-t-octyl-5-methyl hydroquinone, 2-(2-octadecenyl-5-methyl hydroquinone.

(Organosulfur Compounds)

dilauryl-3,3'-thiodipropionate, distearyl-3,3'-thiodipropionate, ditetradecyl-3,3'-thiodipropionate.

(Organophosphorus Compounds)

Triphenylphosphine, tri(nonylphenyl)phosphine, tri(dinonylphenyl)phosphine, tricresylphosphine, tri(2,4-dibutylphenoxy)phosphine.

These compounds are known as antioxidants of rubber, plastics, oils and fats and are commercially available.

The added amount of the antioxidant according to the present invention is 0.01 to 10% by weight relative to the total amount of the layer.

<Image Forming Process and Apparatus>

Now, the image forming process and image forming apparatus are described in detail with reference to the drawings.

The image forming process and image forming apparatus according to the present invention use a photoconductor having a smooth charge transport surface cross-linked layer and involves a process of at least, for example, subjecting the photoconductor to charging, image exposure, development, transferring a toner image on an image keeper (transfer paper), fixation and cleaning of the surface of the photoconductor.

In an image forming process including directly transferring an electrostatic latent image to a transfer material for development, the process is not necessary, where appropriate.

Figure 3:
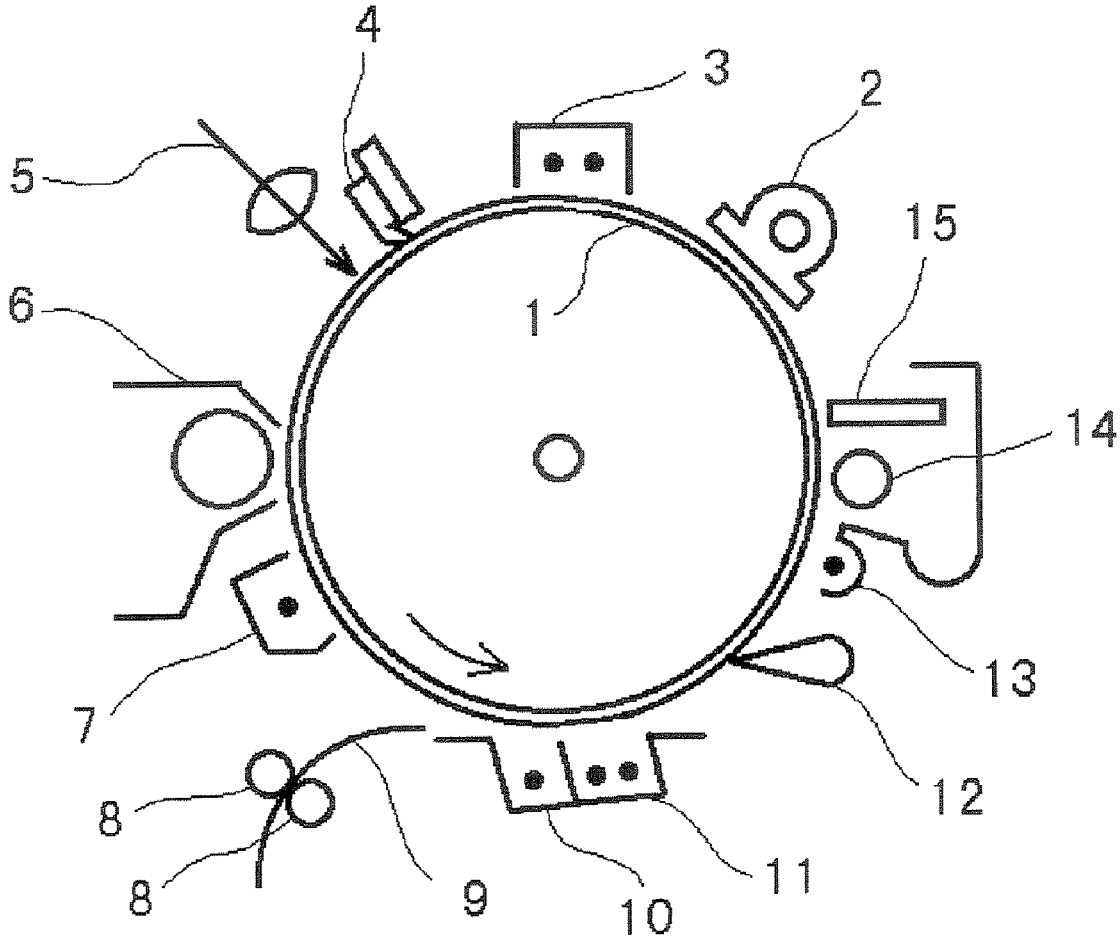
FIG. 3 is a schematic view showing an example of the image forming apparatus according to the present invention.

FIG. 3 is a schematic view illustrating an example of the image forming apparatus. A chager 3 is used as a charging means for evenly charging a photoconductor. Examples of the charging means include a corotron device, a scorotron device, a solid discharging device, a pin electrode device, a roller charging device, a conductive brush device and the like and employed according to a known process.

Particularly, the construction of the present invention is effectively carried by using a charging means, by which the photoconductor composition is composed by close discharge by the charging means of a contact charging type or non-contact close charging type. Here, the contact charging type refers to a charging process carried out by directly contacting a charging roller, charging brush or charging blade to the photoconductor. The close charging type refers to a charging process, wherein, for example, a charging roller is located in non-contact state at distance of 200 μm or less from the surface of the photoconductor. When the distance is excessively great, the charging may be unstable while when it is excessively small, the surface of the charging member may be stained by toner remaining on the photoconductor. Therefore, the distance is suitably in the range of 10 to 200 μm, preferably 10 to 100 μm.

Next, an image exposure part 5 is used to form an electrostatic latent image on the uniformly-charged photoconductor 1. The light source may be any luminous body such as a fluorescent lamp, tungsten lamp, halogen lamp, mercury-vapor lamp, sodium-vapor lamp, light emitting diode (LED), semiconductor laser (LD) and electroluminescence (EL). To irradiate only with light of a desired wavelength band, various filters, such as a sharp cut filter, band pass filter, near-infrared cut-off-filter, dichroic filter, interference filter and color conversion filter can also be used.

Next, a developing unit 6 is used to render the electrostatic latent image formed on the photoconductor 1, visible. The developing process may be a one-component developing process or a two-component developing process using a dry toner, or a wet developing process using a wet toner. When a positive (negative) charge is given to the photoconductor and image exposure is performed, a positive (negative) electrostatic latent image will be formed on the photoconductor surface. If this is developed with a toner (charge detecting particles) of negative (positive) polarity, a positive image will be obtained, and a negative image will be obtained if the image is developed with a toner of positive (negative) polarity.

Next, a transferring charger 10 is used to transfer the visualized toner image from the photoconductor to a transfer material 9. Also, in order to more effectively carry out the transferring, a pre-transfer charger 7 may be used. For the transferring, the electrostatic transferring using a transfer charger and a bias roller, the mechanical transferring process such as adhesion transfer, pressure transfer and the like, or the magnetic transferring process can be used. By the electrostatic transferring process, the foregoing charging means can be used.

Next, a separation charger 11 or a separation claw 12 is used as a means to separate the transfer material 9 from the photoconductor 1. Other separations which can be used include stripping by electrostatic adsorption-induction, stripping using a side belt, stripping by tip grip transportation, self stripping and the like. As the separation charger 11, the foregoing charging means can be used.

Next, a fur brush 14 and a cleaning blade 15 are used to remove the toner remaining on the photoconductor after the transferring. Also, in order to more effectively carry out the cleaning, a pre-cleaning charger 13 may be used. Other cleaning means include the wave process, magnet brush process and the like, which may be used alone or in combination.

Next, as needed, a discharging means can be used to remove the latent image on the photoconductor. The discharging means which can be used includes a discharging lamp 2 and a discharging charger, which use the light source for light exposure and the charging means, respectively.

In FIG. 3, 4 is an eraser and 8 is a resist roller.

In addition, processes for script reading, paper supplying, fixing, paper releasing and the like are those known to the art.

The present invention is directed to an image forming process using an electrophotographic photoconductor in an image forming unit and an image forming apparatus.

Figure 4:
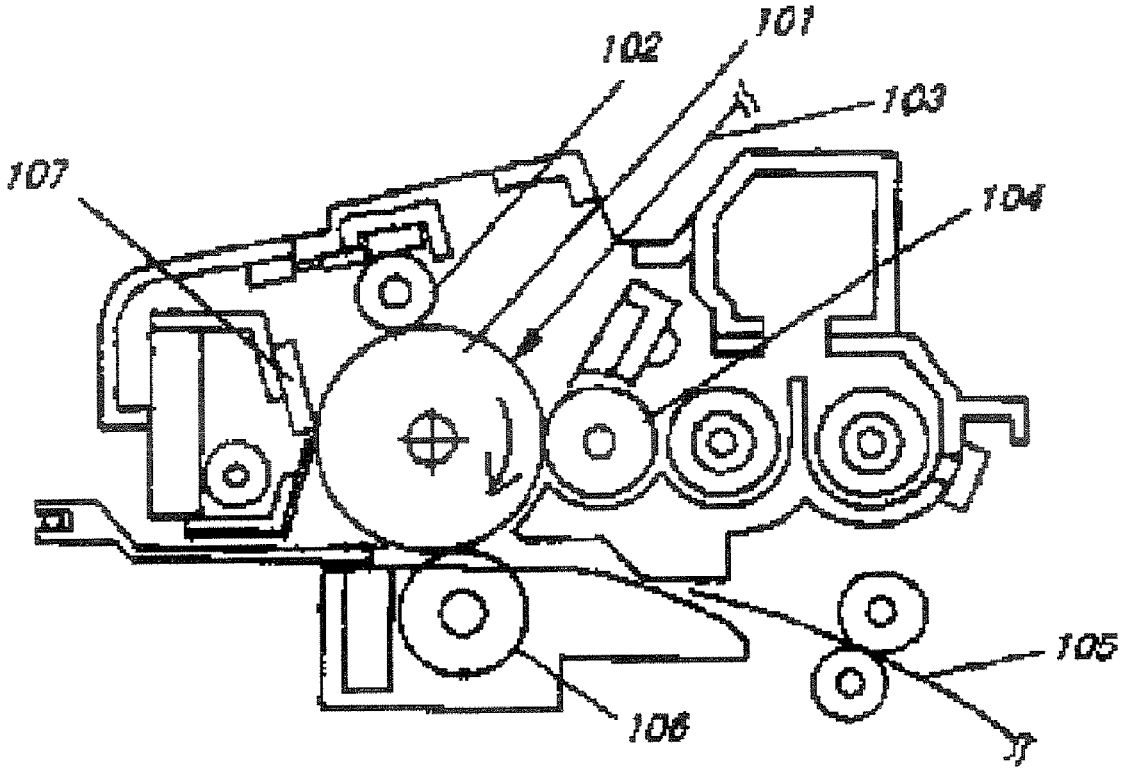
FIG. 4 is a schematic view showing an example of the process cartridge for an image forming apparatus.

The image forming unit may be incorporated into copying devices, fax machines and printers, or they may be built into these devices in the form of a process cartridge which can be freely attached or removed. FIG. 4 shows an example of a process cartridge.

The process cartridge for an image forming apparatus comprises a photoconductor 101, and at least one of a charging unit 102, a development unit 104, a transferring unit 106, a cleaning unit 107 and discharging unit (not shown) and is a device (part) adapted to be attached to or detached from a main body of the image forming apparatus.

Referring to the image forming process by the apparatus shown in FIG. 4, the photoconductor 101, while rotating in the arrow direction, is charged by the charging unit 102, light-exposed by a light exposing unit 103 to form an electrostatic latent image corresponding to the exposed image on its surface. The electrostatic latent image is developed with a toner by the development unit 104. The toner image is transferred to a transfer material by the transferring unit 106 to be printed out. Subsequently, after the image transferring, the surface of the photoconductor is cleaned by the cleaning unit 107 and discharged by a discharging unit (not shown). Again, the foregoing procedures are repeated.

According to the present invention, there is also provided a process cartridge for an image forming apparatus comprising a photoconductor having a smooth cross-linked surface layer with charge transporting ability, and at least one of charging, development, transferring, cleaning and discharging units which are integrated in a single body.

As clearly seen from the above description, the electrophotographic photoconductor according to the present invention can be widely used in an electrophotographic copier and also, in electrophotographic applied field such as laser beam printer, CRT printer, LED printer, liquid crystal printer and laser engraving.

<Synthesis of Mono-functional Compound Having a Charge Transporting Structure>

According to the present invention, the mono-functional compound having a charge transporting structure is synthesized by, for Example, the process described in Japanese Patent No. 3164426. Also, an Example is described below.

1) Synthesis of Hydroxy Group-substituted Triarylamine Compound (Structural Formula B)

113.85 g (0.3 mol) of a synthetic methoxy group-substituted triarylamine compound (structural formula A) of a hydroxy group-substituted triarylamine compound (structural formula B) and 138 g (0.92 mol) of sodium iodide are added to 240 ml of sulforane and heated to 60° C. with nitrogen purge. 99 g (0.91 mol) of trimethylchlorosilane is dropwisely added for 1 hour and stirred at about 60° C. for 4 hours and 30 minutes, and the reaction is completed. About 1.5 L or toluene is added to the reaction, cooled to room temperature, and repeatedly washed with water and an aqueous sodium carbonate solution. Then, the solvent is removed from the toluene solution and the residue is purified by column chromatography (adsorption medium: silica gel, developing solvent: toluene:ethyl acetate=20:1). The resulting light yellow oil is crystallized with cyclohexane. Thus, 88.1 g of white crystals of the structural formula B (yield=80.4%) is obtained.

m.p.: 64.0 to 66.0° C.

TABLE 1

| | Element analysis (%) | | |
|---|---|---|---|
| | C | H | N |
| Found | 85.06 | 6.41 | 3.73 |
| Calculated | 85.44 | 6.34 | 3.83 |

formula A

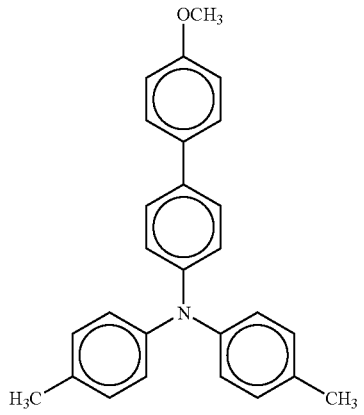

formula B

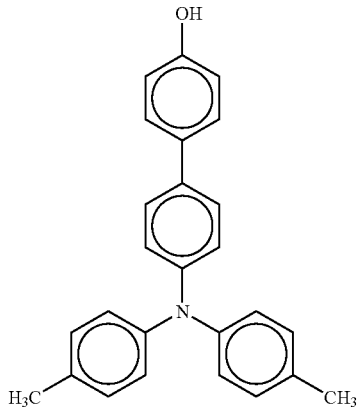

2) Triarylamino Group-substituted Acrylate Compound (Compound No. 54 Described Above)

82.9 g (0.227 mol) of hydroxy group-substituted triarylamine compound (structural formula B) obtained from 1) is dissolved in 400 ml of tetrahydrofuran and an aqueous sodium hydroxide solution (NaOH:12.4g, water: 100 ml) is dropwisely added thereto. The resulting solution is cooled to 5° C. and 25.2 g (0.272 mol) of acrylic acidchloride is added thereto over 40 minutes. Then, the reaction is stirred at 5° C. for 3 hours and completed. The reaction is poured to water and extracted with toluene. The extract is repeatedly washed with an aqueous sodium bicarbonate solution and water. The solvent is removed from the toluene solution and the residue is purified by column chromatography (adsorption medium: silica gel, developing solvent: toluene). The resulting colorless oil is crystallized with n-hexane. Thus, 73 g of white crystals of the comound No. 54 (yield=84.8%) is obtained.

M.p.: 117.5 to 119.0° C.

TABLE 2

| | Element analysis (%) | | |
|---|---|---|---|
| | C | H | N |
| Found | 83.13 | 6.01 | 3.16 |
| Calculated | 83.02 | 6.00 | 3.33 |

EXAMPLES

Now, the present invention will be explained in further detail by the following Example s. However, the present invention is not limited thereto. Also, all parts in the text are by weight.

Example 1

On a ϕ30 mm aluminum cylinder, a coating solution for a under coating layer, a coating solution for a charge generation layer, a coating solution for a charge transport layer, each coating solution has a composition described below, were sequentially applied and dried to form a under coating layer of 3.5 μm, a charge generation layer of 0.2 μm and a charge transport layer of 18 μm. On the charge transport layer, a coating solution for a cross-linked surface layer of a composition described below was spray coated, irradiated under conditions of a metal halide lamp: 160 W/ cm, irradiation distance: 120 mm, irradiation intensity: 500 mW/cm$^2$, irradiation time: 30 seconds, and further dried at 130° C. for 20 minutes to prepare a surface cross-linked layer of 4 μm. Thus, an electrophotographic photoconductor according to the present invention is formed.

[Coating solution for a under coating layer]

| | |
|---|---|
| Alkyd resin (Bekozole 1307-60-EL, DAINIPPON INK AND CHEMICALS, INCORPORATED) | 6 parts |
| Melamine resin (Super Bekamine G-821-60, DAINIPPON INK AND CHEMICALS, INCORPORATED) | 4 parts |
| Titanium oxide | 40 parts |
| Methyl ethyl ketone | 50 parts |

[Coating solution for a charge generation layer]

| | |
|---|---|
| Bis-azo pigment having the following structural formula (I) | 2.5 parts |
| Polyvinyl butyral (XYHL, from UCC) | 0.5 parts |
| Cyclohexanone | 200 parts |
| Methyl ethyl ketone | 80 parts |

formula (I)

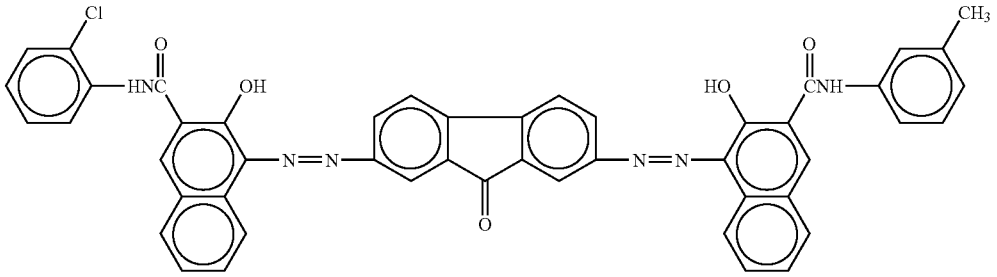

-continued

| | |
|---|---|
| [Coating solution for a charge transport layer] | |
| Bisphenol Z polycarbonate (Panlite TS- 2050, Teijin Chemicals) | 10 part |
| Low molecular weight charge transport material (D-1) having the following structural formula (II) | 7 parts |
| Tetrahydrofuran | 100 parts |
| 1% tetrahydrofuran solution in silicone oil (KF50-100CS, Shin-Etsu Chemical Co., Ltd.) | 0.2 part |

formula (II)

(D-1)

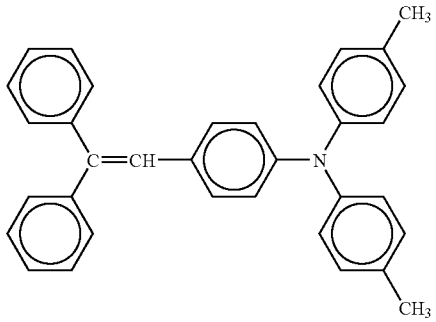

| [Coating solution for a cross-linked surface layer] | |
|---|---|
| Tri- or more-functional radical polymerizable monomer without having a charge transporting structure Trimethylolpropane triacrylate (KAYARAD TMPTA, Nippon Kayaku Co., Ltd.) Molecular weight: 296, number of functional group: 3 functionality, molecular weight/number of functional group = 99 | 10 parts |
| Mono-functional radical polymerizable compound having a charge transporting structure (Compound No. 54) | 10 parts |
| Photopolymerization initiator 1-hydroxy-cyclohexyl-phenyl-ketone (IRGACURE 184, Ciba Specialty Chemicals) | 2 parts |
| Tetrahydrofuran | 100 parts |

Example 2

An electrophotographic photoconductor was prepared following the procedures in Example 1 except that the tri- or more-functional radical polymerizable monomer without having a charge transporting structure contained in the coating solution for a cross-linked surface layer of Example 1 was substituted with the following monomer.

Tri- or more-functional radical polymerizable monomer without having a charge transporting structure 10 parts Ditrimethylolpropane tetraacrylate (SR-355, Sartomer Company Inc.)

Molecular weight: 466, number of functional group: 4 functionality, molecular weight/number of functional group=117

Example 3

An electrophotographic photoconductor was prepared following the same procedures as in Example 1 except that the tri- or more-functional radical polymerizable monomer without having a charge transporting structure contained in the coating solution for a cross-linked surface layer of Example 1 was substituted with the following monomer and the photopolymerization initiator was substituted with the following compound.

| | |
|---|---|
| Tri- or more-functional radical polymerizable monomer without having a charge transporting structure Pentaerythritol tetraacrylate (SR-295, Sartomer Company Inc.) Molecular weight: 352, number of functional group: 4 functionality, molecular weight/number of functional group = 88 | 10 parts |
| Photopolymerization initiator 2,2-dimethoxy-1,2-diphenylethan-1-one (IRGACURE 651, Ciba Specialty Chemicals) | 2 parts |

Example 4

An electrophotographic photoconductor was prepared following the same procedures as in Example 1 except that the tri- or more-functional radical polymerizable monomer without having a charge transporting structure contained in the coating solution for a cross-linked surface layer of Example 1 was substituted with the following 2-component monomer.

| | |
|---|---|
| Tri- or more-functional radical polymerizable monomer without having a charge transporting structure Dipentaerythritol hexacrylate (KAYARAD DPHA, Nippon Kayaku Co., Ltd.) Molecular weight: 536, number of functional group: 5.5 functional, molecular weight/number of functional group = 97 | 5 parts |
| Tri- or more-functional radical polymerizable monomer without having a charge transporting structure Caprolactone-modified dipentaerythritol hexacrylate (KAYARAD DPCA-60, Nippon Kayaku Co., Ltd.) Molecular weight: 1263, number of functional group: 6 functionality, molecular weight/number of functional group = 211 | 5 parts |

Example 5

An electrophotographic photoconductor was prepared following the same procedures as in Example 1 except that the tri- or more-functional radical polymerizable monomer without having a charge transporting structure contained in the coating solution for a cross-linked surface layer of Example 1 was substituted with the following monomer.

| | |
|---|---|
| Tri- or more-functional radical polymerizable monomer without having a charge transporting structure Caprolactone-modified dipentaerythritol hexacrylate (KAYARAD DPCA-60, Nippon Kayaku Co., Ltd.) Molecular weight: 1263, number of functional group: 6 functionality, molecular weight/number of functional group = 211 | 10 parts |

Example 6

An electrophotographic photoconductor was prepared following the same procedures as in Example 1 except that the tri- or more-functional radical polymerizable monomer without having a charge transporting structure contained in the coating solution for a cross-linked surface layer of Example 1 was substituted with the following monomer.

| | |
|---|---|
| Tri- or more-functional radical polymerizable monomer without having a charge transporting structure Caprolactone-modified dipentaerythritol hexacrylate (KAYARAD DPCA-120, Nippon Kayaku Co., Ltd.) Molecular weight: 1947, number of functional group: 6 functionality, molecular weight/number of functional group = 325 | 10 parts |

Example 7

An electrophotographic photoconductor was prepared following the same procedures as in Example 1 except that the tri- or more-functional radical polymerizable monomer without having a charge transporting structure contained in the coating solution for a cross-linked surface layer of Example 1 was substituted with the following 2-component monomer.

| | |
|---|---|
| Tri- or more-functional radical polymerizable monomer without having a charge transporting structure Dipentaerythritol hexacrylate (KAYARAD DPHA, Nippon Kayaku Co., Ltd.) Molecular weight: 536, number of functional group: 5.5 functional, molecular weight/number of functional group = 97 | 5 parts |
| Tri- or more-functional radical polymerizable monomer without having a charge transporting structure PO-modified glycerol triacrylate (KAYARAD FM-280, Nippon Kayaku Co., Ltd.) Molecular weight: 463, number of functional group: 3 functionality, molecular weight/number of functional group = 154 | 5 parts |

Example 8

An electrophotographic photoconductor was prepared following the same procedures as in Example 1 except that the mono-functional radical polymerizable compound having a charge transporting structure contained in the coating solution for a cross-linked surface layer of Example 1 was substituted with 10 parts of the Compound No. 127.

Example 9

An electrophotographic photoconductor was prepared following the same procedures as in Example 1 except that the tri- or more-functional radical polymerizable monomer without having a charge transporting structure contained in the coating solution for a cross-linked surface layer of Example 1 was substituted with the following monomer and the mono-functional radical polymerizable compound having a charge transporting structure was substituted with 10 parts of the Compound No. 138.

| | |
|---|---|
| Tri- or more-functional radical polymerizable monomer without having a charge transporting structure Dipentaerythritolhexacrylate (KAYARAD DPHA, Nippon Kayaku Co., Ltd.) Average molecular weight: 536, number of functional group: 5.5 functionality, molecular weight/number of functional group = 97 | 10 parts |

Example 10

The coating solution for a cross-linked surface layer of Example 1, in which the mono-functional radical polymerizable compound having a charge transporting structure was substituted with 10 parts of the Compound No. 94 and the photopolymerization initiator was substituted with the following thermal polymerization initiator, which was coated on a charge transporting layer, heated in a forced air flow oven at 70° C. for 30 minutes and further heated at 150° C. for 1 hour to prepare a cross-linked surface layer of 4 μm. Thus, a photoconductor according to the present invention was formed.

| | |
|---|---|
| Thermal polymerization initiator 2,2-bis(4,4-di-t-butylperoxycyclohexyl)propane (Perakdox 12-EB20, Kayaku Akzo Corporation) | 1 parts |

Example 11

An electrophotographic photoconductor was prepared following the same procedures as in Example 10 except that the mono-functional radical polymerizable compound having a charge transporting structure contained in the coating solution for a cross-linked surface layer of Example 10 was substituted with 10 parts of the Compound No. 138.

Example 12

An electrophotographic photoconductor was prepared following the same procedures as in Example 1 except that the amount of the tri- or more-functional radical polymerizable monomer without having a charge transporting structure was changed to 6 parts and the amount of the mono-functional radical polymerizable compound having a charge transporting structure was changed to 14 parts.

Example 13

An electrophotographic photoconductor was prepared following the same procedures as in Example 1 except that the amount of the tri- or more-functional radical polymerizable monomer without having a charge transporting structure was changed to 14 parts and the amount of the mono-functional radical polymerizable compound having a charge transporting structure was changed to 6 parts.

Example 14

A solution containing a high molecular charge transport material (PD-1) as described below instead of the coating solution for charge transport layer of Example 1 was applied on the same charge generation layer and dried to form a charge transport layer of 18 μm. On the charge transport layer, a surface cross-linked layer as described in Example 1 was prepared to form an electrophotographic photoconductor.

| [Coating solution for a charge transport layer] | |
|---|---|
| High molecular charge transport material (PD-1) of the following structural formula | 15 parts |

(PD-1)

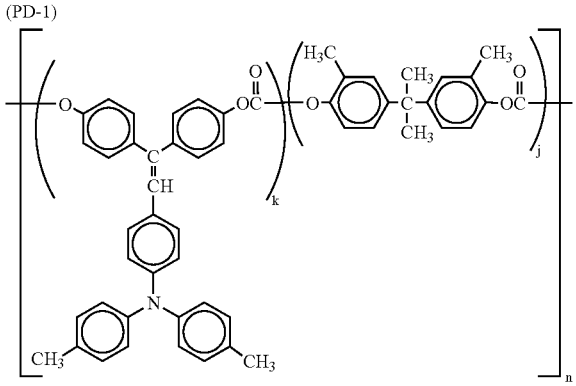

k = 042, j = 0.58 Mw = 160000 (polystyrene conversion)

| | |
|---|---|
| Tetrahydrofuran | 100 parts |
| 1% tetrahydrofuran solution in silicone oil (KF50-100 CS, Shin-Etsu Chemical Co., Ltd.) | 0.3 parts |

Example 15

A coating solution for a cross-linked surface layer of the following composition was spray coated on the charge generation layer of Example 1 and irradiated under the same conditions with Example 1 except for the irradiation time of 40 seconds to prepare a cross-linked surface layer of 22 μm. Thus, a photoconductor according to the present invention was formed.

| [Coating solution for a cross-linked surface layer] | |
|---|---|
| Tri- or more-functional radical polymerizable monomer without having a charge transporting structure Caprolactone-modified dipentaerythritol hexacrylate (KAYARAD DPCA-60, Nippon Kayaku Co., Ltd.) Molecular weight: 1263, number of functional group: 6 functionality, molecular weight/number of functional group = 211 (Compound No. 54) | 10 parts |
| Photopolymerization initiator 1-hydroxy-cyclohexyl-phenyl-ketone (IRGACURE 184, Ciba Specialty Chemicals) | 2 parts |
| Tetrahydrofuran | 60 parts |
| Cyclohexanone | 20 parts |
| 1% tetrahydrofuran solution in silicone oil (KF50-100 CS, Shin-Etsu Chemical Co., Ltd.) | 0.2 parts |

Comparative Example 1

An electrophotographic photoconductor was prepared following the procedures of Example 1 except that the coating solution for a cross-linked surface layer was substituted with the following composition.

| [Coating solution for a cross-linked surface layer] | |
|---|---|
| Tri- or more-functional radical polymerizable monomer without having a charge transporting structure Trimethylolpropane triacrylate (KAYARAD TMPTA, Nippon Kayaku Co., Ltd.) Molecular weight: 296, number of functional group: 3 functionality, molecular weight/number of functional group = 99 | 8 parts |
| Polymer material Bisphenol A polycarbonate (Panlite C1400, Teijin Chemicals) | 2 parts |
| Mono-functional radical polymerizable compound having a charge transporting structure (Compound No. 54) | 10 parts |
| Photopolymerization initiator 1-hydroxy-cyclohexyl-phenyl-ketone (IRGACURE 184, Ciba Specialty Chemicals) | 2 parts |
| Tetrahydrofuran | 100 parts |

Comparative Example 2

An electrophotographic photoconductor was prepared following the same procedures as in Example 1 except that the mono-functional radical polymerizable compound having a charge transporting structure contained in the coating solution for a cross-linked surface layer of Example 1 was substituted with 10 parts of a bi-functional radical polymerizable compound having a charge transporting structure of the following structural formula.

| | |
|---|---|
| Bi-functional radical polymerizable compound having a charge transporting structure | 10 parts |

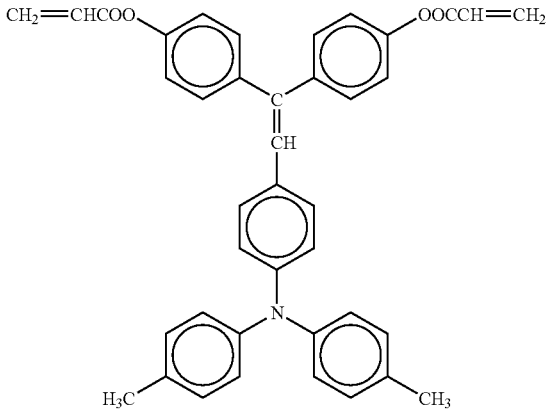

Comparative Example 3

An electrophotographic photoconductor was prepared following the same procedures as in Example 1 except that the tri- or more-functional radical polymerizable monomer without having a charge transporting structure contained in the coating solution for a cross-linked surface layer of Example 1 was substituted with 10 parts of a bi-functional radical polymerizable monomer without having a charge transporting structure of the following structural formula.

| | |
|---|---|
| Bi-functional radical polymerizable monomer without having a charge transporting structure<br>1,6-hexanediol diacrylate (Wako Pure Chemical Industries, Ltd.)<br>Molecular weight: 226, number of functional group: 2<br>functionality, molecular weight/number of functional group = 113 | 10 parts |

Comparative Example 4

An electrophotographic photoconductor was prepared following the same procedures as in Example 1 except that the tri- or more-functional radical polymerizable monomer without having a charge transporting structure which had been contained in the coating solution for a cross-linked surface layer of Example 1 was not used and the amount of the mono-functional radical polymerizable compound having a charge transporting structure was changed to 20 parts.

Comparative Example 5

An electrophotographic photoconductor was prepared following the same procedures as in Example 1 except that the mono-functional radical polymerizable compound having a charge transporting structure which had been contained in the coating solution for a cross-linked surface layer of Example 1 was not used and the amount of the tri- or more-functional radical polymerizable monomer without having a charge transporting structure was changed to 20 parts.

Comparative Example 6

An electrophotographic photoconductor was prepared following the same procedures as in Example 1 except that instead of the mono-functional radical polymerizable compound having a charge transporting structure which had been contained in the coating solution for a cross-linked surface layer of Example 1, 10 parts of a low molecular charge transport material (D-1) of the structural formula (II) used in the coating solution for a charge transport layer was used.

Comparative Example 7

An electrophotographic photoconductor was prepared following the same procedures as in Example 1 except that tetrahydrofuran contained as a solvent in the coating solution for a cross-linked surface layer of Example 8 was substituted with 80 parts of butanol.

Comparative Example 8

An electrophotographic photoconductor was prepared by a cross-linked surface layer of 4 μm which had been formed using the same light source as in the curing of the surface layer in Example 1 under the conditions as described for Example 1 except for the irradiation intensity of 1500 mW/cm$^2$ and the irradiation of 5 seconds.

Comparative Example 9

An electrophotographic photoconductor was prepared by a cross-linked surface layer of 4 μm which had been formed using the same light source as in the curing of the surface layer in Example 10 under the conditions as described for the surface layer in Example 8 except for the heat at 180° C. for 1 hour.

Comparative Example 10

An electrophotographic photoconductor was prepared following the same procedures as in Example 1, except that the cross-linked surface layer was not provided and the charge transport layer has a thickness of 22 μm.

The electrophotographic photoconductors prepared in Examples 1 to 15 and Comparative examples 1 to 10 were measured for their surface roughness Rz (a ten point average roughness, JIS B 0601-1994 standard) with an evaluation distance of 2.5 mm, a reference distance of 0.5 mm, using SURFCOM1400D (TOKYO SEIMITSU CO., LTD.). The measurement points included 3 points, two at 50 mm from each axial end of a drum and one at the center of the drum, for every 90 degrees in the circumferential direction, so that there were a total of 12 points. The average was a surface roughness Rz of the drum. The results are shown in Table 3-1 and 3-2.

Also, the electrophotographic photoconductors as prepared in Examples 1 to 15 and Comparative examples 1 to 10 were subjected to a paper passage test with 30,000 A4-sized sheets. Firstly, each photoconductor was mounted on a process cartridge for an electrophotographic apparatus and the initial dark potential was set at −700 V by Imagio Neo 270 copier (Ricoh) using a semiconductor laser at 655 nm as light source for image exposure. Then, the paper passage test was initiated. Images at the initial point and every 5,000 sheets, potentials at the dark part and light exposing part at the initial point and after 30,000 sheets copying, the reduction in the membrane thickness after 30,000 sheets copying were examined. The results are shown in Table 3-1 and 3-2. For the photoconductors showing significant image inferiority from the beginning, the test was stopped.

TABLE 3-1

| | Surface roughness Rz (μm) | Image evaluation | | | | | | | Reduction of membrane thickness (μm) | Initial potential (-V) | | Potential after 30,000 sheets (-V) | |
|---|---|---|---|---|---|---|---|---|---|---|---|---|---|
| | | Initial | 5000 sheets | 10000 sheets | 15000 sheets | 20000 sheets | 25000 sheets | 30000 sheets | | Dark part | Light exposing part | Dark part | Light exposing part |
| Example 1 | 0.38 | G | G | G | G | G | G | G | 0.6 | 700 | 40 | 710 | 60 |
| Example 2 | 0.45 | G | G | G | G | G | G | G | 0.7 | 700 | 40 | 700 | 65 |
| Example 3 | 0.66 | G | G | G | G | G | G | G | 0.5 | 700 | 40 | 700 | 70 |
| Example 4 | 0.60 | G | G | G | G | G | G | G | 0.6 | 700 | 40 | 720 | 65 |
| Example 5 | 0.33 | G | G | G | G | G | G | G | 1.0 | 700 | 40 | 690 | 55 |
| Example 6 | 0.25 | G | G | G | G | G | G | A | 1.6 | 700 | 35 | 680 | 55 |
| Example 7 | 0.96 | G | G | G | G | G | G | B | 0.9 | 700 | 40 | 710 | 70 |
| Example 8 | 0.32 | G | G | G | G | G | G | G | 0.6 | 700 | 50 | 710 | 70 |
| Example 9 | 0.81 | G | G | G | G | G | G | G | 0.9 | 700 | 50 | 720 | 75 |
| Example 10 | 1.09 | G | G | G | G | G | G | A, B | 1.3 | 700 | 50 | 710 | 75 |
| Example 11 | 1.21 | G | G | G | G | G | G | A, B | 1.1 | 700 | 50 | 720 | 75 |
| Example 12 | 1.14 | G | G | G | G | G | G | A | 1.5 | 700 | 30 | 670 | 45 |
| Example 13 | 0.40 | G | G | G | G | G | D | D | 0.3 | 700 | 55 | 720 | 135 |
| Example 14 | 0.24 | G | G | G | G | G | G | G | 0.4 | 700 | 45 | 710 | 75 |
| Example 15 | 1.23 | G | G | G | G | G | B, D | B, D | 1.3 | 700 | 60 | 710 | 150 |

Image evaluation
G: good
A: Partial contamination of the ground surface
B: Partial contamination of striped pattern
C: Slight reduction of resolution
D: Slight reduction of image density
AA: Contamination of the ground surface all over the paper
BB: Contamination of striped patter all over the paper
CC: Significant reduction of resolution
DD: Signification reduction of image density

TABLE 3-2

| | Surface roughness Rz (μm) | Image evaluation | | | | | | | Reduction of membrane thickness (μm) | Initial potential (-V) | | Potential after 30,000 sheets (-V) | |
|---|---|---|---|---|---|---|---|---|---|---|---|---|---|
| | | Initial | 5000 sheets | 10000 sheets | 15000 sheets | 20000 sheets | 25000 sheets | 30000 sheets | | Dark part | Light exposing part | Dark part | Light exposing part |
| Comp. Ex. 1 | 1.57 | G | B | B | BB | BB | BB, C | BB, C | 1.5-4.2 | 700 | 40 | 660 | 55 |
| Comp. Ex. 2 | 1.91 | B | B | B | BB | BB, C | BB, C | BB, C | 3.0 | 700 | 50 | 670 | 110 |
| Comp. Ex. 3 | 0.30 | G | G | G | A | A | AA | AA | 3.7 | 700 | 40 | 670 | 60 |
| Comp. Ex. 4 | 2.52 | A, BB | | | | | | | stopped | 700 | 60 | | |
| Comp. Ex. 5 | 0.24 | D | DD | DD | DD | DD | DD | DD | 0.2 | 700 | 160 | 740 | 280 |
| Comp. Ex. 6 | 1.76 | A | A | AA, D | AA, D | AA, D | AA, D | AA, D | 1.3-3.6 | 700 | 50 | 720 | 170 |
| Comp. Ex. 7 | 3.19 | AA, BB | | | | | | | stopped | 700 | 40 | | |
| Comp. Ex. 8 | 2.66 | A, BB | | | | | | | stopped | 700 | 70 | | |
| Comp. Ex. 9 | 2.35 | A, BB | | | | | | | stopped | 700 | 60 | | |
| Comp. Ex. 10 | <0.1 | G | G | G | G | A | A | AA | 3.5 | 700 | 30 | 660 | 45 |

Image evaluation
G: good
A: Partial contamination of the ground surface
B: Partial contamination of striped pattern
C: Slight reduction of resolution
D: Slight reduction of image density
AA: Contamination of the ground surface all over the paper
BB: Contamination of striped patter all over the paper
CC: Significant reduction of resolution
DD: Signification reduction of image density Comparative examples 1 and 6 showed a considerably large difference of reduction in the membrane thickness according to the measurement position. In Comparative example 4, the surface layer was not cured.

From the result of the paper passage test described in Table 3-1 and 3-2 the photoconductors having the cross-linked surface layer of Examples 1 to 15 according to the present invention had high abrasion resistance and excellent electrical properties and could produce high quality images over the time. Meanwhile, the photoconductors of Comparative examples 1, 7 to 9 which has a surface roughness Rz of the cross-linked surface layer of 1.3 μm or more according to the cross-linked surface layer composition or curing conditions shows image inferiorities at the beginning and over the time. The photoconductors of Comparative examples 2 to 6 having radical polymerizable compositions different from the present invention showed poor surface uniformity, abrasion resistance or electrical properties and low durability. The photoconductor of Comparative example 10 using a conventional thermoplastic binder resin in the charge transport layer showed poor abrasion resistance and durability, as compared to the photoconductor according to the present invention.

Example 16

A photoconductor was prepared following the procedures of Example 1 and subjected to a continuous 2000 sheets copying of a A4 crosswise chart with an image area of 1%, using Imagio MF200 copier (Ricoh, recording LD wave length: 655 nm, AC overlapped charge: amplitude 2 KV, frequency 1 KHz, DC voltage −750 V) under a circumstance at temperature of 22° C. and a humidity of 55%. Then, the photoconductor and the copier were transferred to a circumstance at a temperature of 30° C. and a relative humidity of 90% and subjected to a copying process. The resulting image was compared with the initial image. As a result, it was possible to obtain an image having a resolution equal to the initial image, without character thickening.

Comparative Example 11

A photoconductor was prepared following the procedures of Comparative example 1 and tested following the procedures of Example 16 to compare an image at a temperature of 30° C. and a humidity of 90% with an initial image. As a result, the image at a temperature of 30° C. and a humidity of 90% show an excessive reduction in resolution and a reduction in half tone image density, as compared to the initial image.

As compared to the photoconductor of Comparative example 11 having severe irregularity on the cross-linked surface, the photoconductor having the cross-linked surface layer of Example 16 according to the present invention can maintain the cross-linked surface at a high resistance by eliminating oxidizing gas generated from the charging unit and deteriorated substances on the photoconductor, thereby stably providing a high quality image even in a high humidity circumstance.

Therefore, it is concluded that since the outermost surface layer of the photoconductive layer according to the present invention comprises a cross-linked layer formed by applying a coating solution containing a tri- or more-functional radical polymerizable monomer without having a charge transporting structure and a mono-functional radical polymerizable compound having a charge transporting structure, followed by curing, in which the cross-linked layer has a surface roughness Rz of 1.3 μm or less, it is possible to provide a photoconductor with a long life span and high performance capable of maintaining a good image for a long period of time without being affected by environment. Also, it is concluded that the image forming process, the image forming apparatus and the process cartridge for an image forming apparatus using the photoconductor according to the present invention have high performance and high reliability.

As clearly shown from the above-described concrete description, according to the present invention, it is possible to provide a photoconductive layer with good electrical properties and cleaning properties, high durability and high performance, and high abrasion resistance, without reduction of resolution in a high humidity circumstance, which comprises a smooth cross-linked surface layer which is formed by curing a tri- or more-functional radical polymerizable monomer without having a charge transporting structure and a mono-functional radical polymerizable compound having a charge transporting structure, and has a surface roughness Rz of 1.3 μm or less. By using this photoconductor, it is possible to provide an image forming process, an image forming apparatus and a process cartridge for an image forming apparatus which show high performance and high reliability, thereby providing a good image for a long period of time.

What is claimed is:

1. An electrophotographic photoconductor, comprising:

an electroconductive substrate; and a photoconductive layer on or above the electroconductive substrate, the photoconductive layer comprising:

a cross-linked surface layer which comprises:

a cured tri- or more-functional radical polymerizable monomer without having a charge transporting structure; and a cured mono-functional radical polymerizable compound having a charge transporting structure, wherein the cross-linked surface layer has a surface roughness Rz of 1.3 μm or less; and the cured tri- or more-functional radical polymerizable monomer without having a charge transporting structure has a functional group selected from the group consisting of an acryloyloxy group and a methacryloyloxy group.

2. An electrophotographic photoconductor according to claim 1, wherein the cross-linked surface layer has a surface roughness Rz of 1.0 μm or less.

3. An electrophotographic photoconductor according to claim 1, wherein the cured tri- or more-functional radical polymerizable monomer without having a charge transporting structure has a ratio (molecular weight/number of functional group) of molecular weight to the number of functional group of 250 or less.

4. An electrophotographic photoconductor according to claim 1, wherein the cured mono-functional radical polymerizable compound having a charge transporting structure has a functional group selected from the group consisting of an acryloyloxy group and a methacryloyloxy group.

5. An electrophotographic photoconductor according to claim 1, wherein the charge transporting structure of the cured mono-functional radical polymerizable compound having a charge transporting structure is a triarylamine structure.

6. An electrophotographic photoconductor according to claim 1, wherein the cured mono-functional radical polymerizable compound having a charge transporting structure is represented by one of the formulae (1) and (2):

(1)

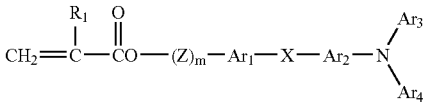

(2)

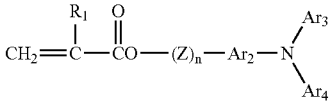

wherein, $R_1$ represents a hydrogen atom, a halogen atom, an alkyl group which may be substituted, an aralkyl group which may be substituted, an aryl group which may be substituted, a cyano group, a nitro group, an alkoxy group, —$COOR_7$ ($R_7$ represents a hydrogen atom, an alkyl group which may be substituted, an aralkyl group which may be substituted or an aryl group which may be substituted), a halogenated carbonyl group or $CONR_8R_9$ ($R_8$ and $R_9$ represent a hydrogen atom, a halogen atom, an alkyl group which may be substituted, an aralkyl group which may be substituted or an aryl group which may be substituted, which may be identical or different);

$Ar_1$ and $Ar_2$ represent a substituted or unsubstituted arylene group, which may be identical or different;

$Ar_3$ and $Ar_4$ represent a substituted or unsubstituted aryl group, which may be identical or different;

X represents a single bond, a substituted or unsubstituted alkylene group, a substituted or unsubstituted cycloalkylene group, a substituted or unsubstituted alkylene ether group, an oxygen atom, a sulfur atom or a vinylene group;

Z represents a substituted or unsubstituted alkylene group, a substituted or unsubstituted alkylene ether group or an alkyleneoxycarbonyl group; and "m" and "n" represent an integer of 0 to 3.

7. An electrophotographic photoconductor according to claim 1, wherein the cured mono-functional radical polymerizable compound having a charge transporting structure is represented by the following formula (3):

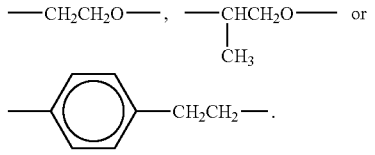

8. An electrophotographic photoconductor according to claim 1, wherein the cured tri- or more-functional radical polymerizable monomer without having a charge transporting structure is 30% to 70% by weight, based on the total amount of the cross-linked surface layer.

9. An electrophotographic photoconductor according to claim 1, wherein the cured mono-functional radical polymerizable compound having a charge transporting structure is 30% to 70% by weight, based on the total amount of the cross-linked surface layer.

10. An electrophotographic photoconductor according to claim 1, wherein the photoconductive layer comprises:

a charge generation layer;

a charge transport layer; and the cross-linked surface layer laminated on or above the electroconductive substrate in this order.

11. An electrophotographic photoconductor according to claim 10, wherein the charge transport layer comprises a polymer charge transport material.

12. An electrophotographic photoconductor according to claim 11, wherein the polymer charge transport material is a polycarbonate having a triarylamine structure in the main chain or side chain thereof.

13. An electrophotographic photoconductor according to claim 1, wherein the cross-linked surface layer is cured by one of heating and light irradiation.

14. An electrophotographic photoconductor according to claim 10, wherein the cross-linked surface layer has a thickness of from 1 μm to 10 μm.

15. An electrophotographic photoconductor according to claim 10, wherein the thickness is from 2 μm to 8 μm.

(3)

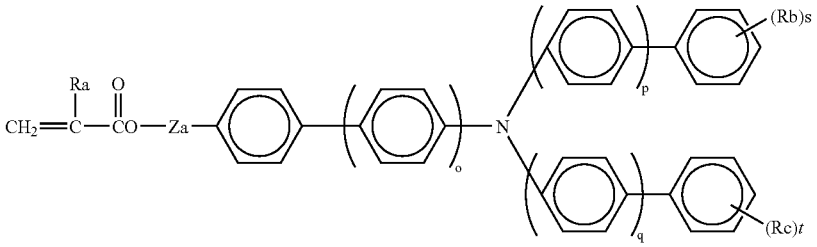

wherein, "o," "p" and "q" each represent an integer of 0 or 1;

Ra represents a hydrogen atom or a methyl group;

Rb and Rc represent an alkyl group having 1 to 6 carbon atoms, wherein each of Rb and Rc may be different when there are two or more Rb and Rc, respectively;

"s" and "t" represent an integer of 0 to 3; and

Za represents a single bond, a methylene group, an ethylene group,

16. An electrophotographic photoconductor according to claim 10, wherein the cross-linked surface layer is insoluble in an organic solvent.

17. A process for forming an image, comprising:

charging an electrophotographic photoconductor;

exposing the electrophotographic photoconductor which is charged to a recording light so as to form an electrostatic latent image;

developing the electrostatic latent image by a developing agent so as to visualize the electrostatic latent image and form a toner image; and transferring the toner image formed by developing onto a transfer material, wherein the electrophotographic photoconductor comprises:

an electroconductive substrate;

a photoconductive layer on or above the electroconductive substrate, the photoconductive layer comprising:

a cross-linked surface layer which comprises:

a cured tri- or more-functional radical polymerizable monomer without having a charge transporting structure; and a cured mono-functional radical polymerizable compound having a charge transporting structure, wherein the cross-linked surface layer has a surface roughness Rz of 1.3 μm or less; and the cured tri- or more-functional radical polymerizable monomer without having a charge transporting structure has a functional group selected from the group consisting of an acryloyloxy group and a methacryloyloxy group.

18. An apparatus for forming an image, comprising:

an electrophotographic photoconductor;

a charger to charge the electrophotographic photoconductor;

an exposer to expose the electrophotographic photoconductor charged by the charger to a recording light to form an electrostatic latent image;

a developing unit to supply a developing agent to the electrostatic latent image to visualize the electrostatic latent image and form a toner image; and a transferring unit to transfer the toner image formed by the developing unit on a transfer material, wherein the electrophotographic photoconductor comprises:

an electroconductive substrate;

a photoconductive layer on or above the electroconductive substrate, the photoconductive layer comprising:

a cross-linked surface layer which comprises:

a cured tri- or more-functional radical polymerizable monomer without having a charge transporting structure; and a cured mono-functional radical polymerizable compound having a charge transporting structure, wherein the cross-linked surface layer has a surface roughness Rz of 1.3 μm or less; and the cured tri- or more-functional radical polymerizable monomer without having a charge transporting structure has a functional group selected from the group consisting of an acryloyloxy group and a methacryloyloxy group.

19. A process cartridge for an image forming apparatus, comprising:

an electrophotographic photoconductor; and at least one selected from the group consisting of:

a charger to charge the electrophotographic photoconductor;

a developing unit to supply a developing agent to an electrostatic latent image formed by exposure on the electrophotographic photoconductor to visualize the electrostatic latent image and form a toner image;

a transferring unit to transfer the toner image formed by the developing unit on a transfer material;

a cleaning unit to remove toner remaining on the electrophotographic photoconductor after transferring; and a discharging unit to remove the latent image on the photoconductor after transferring so as to form a monolithic structure, wherein the process cartridge is adapted to be attached to and detached from a main body of the image forming apparatus, and the electrophotographic photoconductor comprises:

an electroconductive substrate;

a photoconductive layer on or above the electroconductive substrate, the photoconductive layer comprising:

a cross-linked surface layer which comprises:

a cured tri- or more-functional radical polymerizable monomer without having a charge transporting structure; and a cured mono-functional radical polymerizable compound having a charge transporting structure, wherein the cross-linked surface layer has a surface roughness Rz of 1.3 μm or less; and the cured tri- or more-functional radical polymerizable monomer without having a charge transporting structure has a functional group selected from the group consisting of an acryloyloxy group and a methacryloyloxy group.

* * * * *